US006153370A

United States Patent [19]

Maruyama et al.

[11] Patent Number: 6,153,370

[45] Date of Patent: Nov. 28, 2000

[54] SILVER HALIDE EMULSION AND SILVER HALIDE LIGHT-SENSITIVE MATERIAL USING THE SAME

[75] Inventors: Yoichi Maruyama; Kimiyasu Morimura; Nobuyuki Haraguchi; Hiroyuki Mifune; Tetsuro Kojima, all of Minami-ashigara, Japan

[73] Assignee: Fuji Photo Film Co., Ltd., Kanagawa-ken, Japan

[21] Appl. No.: 08/842,361

[22] Filed: Apr. 24, 1997

[30] Foreign Application Priority Data

| | | | |
|---|---|---|---|
| Apr. 25, 1996 | [JP] | Japan | 8-127713 |
| Apr. 30, 1996 | [JP] | Japan | 8-111520 |
| Jun. 24, 1996 | [JP] | Japan | 8-182785 |

[51] Int. Cl.[7] ..... G03C 1/035; G03C 1/005; G03C 1/10; G03C 1/34

[52] U.S. Cl. ..... 430/567; 430/569; 430/570; 430/600; 430/614

[58] Field of Search ..... 430/567, 569, 430/600, 614, 570

[56] References Cited

U.S. PATENT DOCUMENTS

| | | | |
|---|---|---|---|
| 5,244,782 | 9/1993 | Mifune et al. | 430/567 |
| 5,316,886 | 5/1994 | Koide et al. | 430/611 |
| 5,420,005 | 5/1995 | Saitou | 430/567 |
| 5,472,836 | 12/1995 | Haga | 430/567 |
| 5,573,903 | 11/1996 | Yamashita et al. | 430/600 |

FOREIGN PATENT DOCUMENTS

| | | | |
|---|---|---|---|
| 515894A1 | 12/1992 | European Pat. Off. | G03C 1/035 |

*Primary Examiner*—Mark F. Huff
*Attorney, Agent, or Firm*—Birch, Stewart, Kolasch, & Birch, LLP.

[57] ABSTRACT

There is disclosed a light-sensitive silver halide photographic emulsion, which comprises light-sensitive silver halide grains mainly composed of (100) planes and (111) planes, at least one compound that is adsorbed selectively on the (100) planes of the silver halide grains, and at least one spectrally sensitizing dye. There is also disclosed a light-sensitive material using the emulsion. The emulsion is high in sensitivity and excellent in graininess.

13 Claims, No Drawings

SILVER HALIDE EMULSION AND SILVER HALIDE LIGHT-SENSITIVE MATERIAL USING THE SAME

FIELD OF THE INVENTION

The present invention relates to a silver halide photographic emulsion and a light-sensitive material. More specifically, the present invention relates to a silver halide photographic emulsion high in sensitivity and excellent in graininess and further low in fogging, and also relates to a light-sensitive material using the emulsion.

The present invention also relates to a silver halide photographic emulsion having an excellent sensitivity/graininess ratio, and a silver halide color photographic light-sensitive material in which the emulsion is used.

BACKGROUND OF THE INVENTION

The most known shapes of silver halide grains are cubes and octahedrons, which are composed respectively of (100) planes and (111) planes as outer surfaces.

However, in the case of photographic emulsions used in practice, it is difficult to prepare perfect cubes or perfect octahedrons, and generally tetradecahedrons resulting from chipping of apexes of cubes and octahedrons are used, in many cases. In the case of such tetradecahedrons, (111) planes and (100) planes are exposed as outer surfaces. The surfaces of tabular grains having parallel double twinned crystal planes are (111) planes, crystallographically. However, in fact, most contain (100) planes, because the activity of side planes of tabular grains is particularly high. The following publications relate to surfaces of crystals that are composed of (111) planes and (100) planes, JP-B ("JP-B" means examined Japanese patent publication) No. 42738/1980, JP-A ("JP-A" means unexamined published Japanese patent application) No. 142439/1991, and European Patent No. 515894. However, even the emulsions prepared according to the descriptions in these publications result in unsatisfactory photographic properties.

With respect to tabular silver halide grains, their preparation and use techniques are already disclosed, for example, in U.S. Pat. Nos. 4,434,226, 4,439,520, 4,414,310, 4,433,048, 4,414,306, and 4,459,353, and their advantages are known, such as an improvement in sensitivity/graininess relation, as well as an improvement in the efficiency of color sensitization by spectrally sensitizing dyes.

However, it is generally known that, as the added amount of a sensitizing dye is increased, the inherent sensitivity of the emulsion is decreased. Therefore, even when tabular grains having a large surface area are used and a large amount of spectrally sensitizing dyes is added, a desired improvement in sensitivity/graininess cannot be obtained, and the characteristics of tabular grains are not fully exhibited.

On the other hand, in the field of color photographic light-sensitive materials, particularly color reversal light-sensitive materials very often used by professional photographers, color light-sensitive materials high in sensitivity are demanded for sports photographs, wherein high shutter speeds are required, and for photographs for special scenes, including stage photographs, wherein the amount of light needed for exposure is insufficient. However, color photographic light-sensitive materials high in sensitivity are rough in graininess. Therefore, improvement in the relationship of sensitivity/graininess is desired.

The following means exist for increasing the sensitivity of silver halide emulsions: (1) increasing the number of photons to be absorbed into respective grains, (2) increasing the efficiency for converting photoelectrons generated by the absorption of light to silver clusters (latent images), and (3) increasing development activity in order to effectively utilize the produced latent images.

Making the size of grains large is an effective means of increasing the number of photons absorbed in respective grains, but it is not a preferable means in that it is generally accompanied by deterioration of graininess. In order to increase the sensitivity without deterioration of graininess, it is most preferable to increase the efficiency of converting photoelectrons to latent images, i.e. to increase the quantum sensitivity. To increase the quantum sensitivity, it is required to eliminate inefficient processes as much as possible, such as the recombination of photoelectrons with light positive holes and the dispersion of latent images.

As one means of decreasing the recombination of photoelectrons with light positive holes, reduction sensitization has been studied for a long time. For example, tin compounds are disclosed as a useful reduction sensitizer in U.S. Pat. No. 2,487,850, polyamine compounds are disclosed as a useful reduction sensitizer in U.S. Pat. No. 2,512,925, and thiourea dioxide-series compounds are disclosed as a useful reduction sensitizer in British Patent No. 789,823. Further, in "Photographic Science and Engineering," Vol. 23, page 113 (1979), the shapes and properties of silver nuclei formed by various reduction sensitization methods are compared, and, in the methods, dimethylamine borane, stannous chloride, hydrazine, high-pH ripening, and low-pAg ripening are used.

Further, U.S. Pat. Nos. 2,518,698, 3,201,254, 3,411,917, 3,779,777, and 3,930,867 also disclose reduction sensitization methods. Not only the selection of reduction sensitizers but also the design of reduction sensitization methods are described in JP-B Nos. 33572/1982 and 1410/1983.

Further, it is also known that in view of high sensitization, tabular silver halide grains are more advantageous than other grains such as octahedrons, tetradecahedrons, and the like. This is because, since the surface area of tabular silver halide grains per unit volume is large, tabular silver halide grains can absorb a larger amount of a sensitizing dye at the time of spectral sensitization, and they are high in trapping ability to incident light.

In view of the above, methods wherein tabular silver halide grains are subjected to reduction sensitization, to obtain a highly sensitive emulsion, are described, for example, in JP-A Nos. 288145/1991, 355748/1992, and 313282/1993. High sensitization by these methods was studied, and although a considerable increase in sensitivity was positively confirmed, new problems occurred, in that deterioration of graininess and a remarkable change in development progression were also brought about. It was found that, for example, when gold sensitization and chalcogen sensitization were additionally used, and YF colloidal silver was used, the problems became extremely serious, and when tabular grains high in aspect ratio, or silver halide grains having a low iodine content, were used, the problems became conspicuous. Consequently, further technical improvement for solving these problems is desired.

In addition, although silver halide emulsion grains are basically not sensitive to the visible region, they have been caused to adsorb various dyes on the surfaces thereof, in order to get a desired spectral sensitivity. In particular, in comparison with spherical grains, tabular emulsion grains can absorb dyes on their principal planes, to increase the light absorption ratio. Therefore they are very advantageous in spectral sensitization. In particular, color photographic light-sensitive materials are composed of emulsion grains having various sizes, and for color photographic light-sensitive materials, there is need for a technique of preparing emulsion grains composed of tabular grains wherein the above advantages are taken and the side planes are thin in comparison with the principal planes, i.e., the aspect ratio is high.

In some cases, a hitherto developed dye addition method, as disclosed in JP-A No. 318839/1992, makes it possible to apply dyes having desired spectral absorption to tabular grains having various sizes without impairing the graininess/sensitivity ratio. However, according to the investigation done by the inventors of the present invention, it has been made clear that regardless of various dye addition methods, in comparison with thick grains, thin tabular grains have a problem that the extent of the graininess to the sensitivity (hereinafter referred to as graininess/sensitivity ratio) is poor.

SUMMARY OF THE INVENTION

An object of the present invention is to provide a silver halide photographic emulsion high in sensitivity and excellent in graininess.

Another object of the present invention is to provide a silver halide photographic light-sensitive material containing the above emulsion.

Still another object of the present invention is to provide a silver halide photographic light-sensitive material wherein sensitivity and fogging fluctuate less during the storage period before the use of the light-sensitive material after its production.

Further another object of the present invention is to provide a silver halide emulsion excellent in sensitivity/graininess ratio and having suitability for sensitization processing.

Further another object of the present invention is to provide a silver halide photographic light-sensitive material containing the above emulsion.

Other and further objects, features, and advantages of the invention will appear more fully from the following description.

DETAILED DESCRIPTION OF THE INVENTION

The above objects of the present invention have been attained by the following means:

That is, the present provides:

(1) A light-sensitive silver halide photographic emulsion, comprising light-sensitive silver halide grains mainly composed of (100) planes and (111) planes, at least one compound that is adsorbed selectively on the (100) planes of the silver halide grains, and at least one spectrally sensitizing dye.

(2) The light-sensitive silver halide photographic emulsion stated in the above (1), wherein tabular grains having an aspect ratio in the range of 2 to 100, amount to at least 50% of all the silver halide grains in number, the tabular grains are composed of principal planes and side planes, and the side planes comprise (100) planes.

(3) The light-sensitive silver halide photographic emulsion stated in the above (1) or (2), wherein the (100) plane-selective compound that is more selectively adsorbed on the (100) planes than on the (111) planes is a compound represented by the following formula (I)

formula (I)

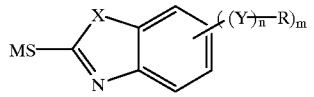

wherein R's each represent a substituted or unsubstituted alkyl group, alkenyl group, alkynyl group, aryl group, or aralkyl group; Y represents —O—, —S—, $—NR_1—$, $—NR_2CO—$, $—CONR_3—$, $—NR_4SO_2—$, $—SO_2NR_5—$, —COO—, —OCO—, —CO—, $—SO_2—$, $—NR_6CONR_7—$, $—NR_8CSNR_9—$, or $—NR_{10}COO—$ in which $R_1$, $R_2$, $R_3$, $R_4$, $R_5$, $R_6$, $R_7$, $R_8$, $R_9$, and $R_{10}$ each represent a hydrogen atom or a substituted or unsubstituted alkyl group, alkenyl group, alkynyl group, aryl group, or aralkyl group; n is 0 or 1, m is from 1 to 4; X represents —O—, —S—, or —NR'—, in which R' represents a hydrogen atom or a substituted or unsubstituted alkyl group or alkenyl group; and M represents a hydrogen atom, an alkali metal atom, an alkali earth metal atom, an ammonium group, or a group capable of cleaving under alkaline condition, provided that the total number of carbon atoms of $—((Y)_n—R)_m$ is from 1 to 30.

(4) The light-sensitive silver halide photographic emulsion stated in any one of the above (1) to (3), wherein the adsorption of the said at least one spectrally sensitizing dye to the silver halide grains is (111) plane-selective.

(5) The light-sensitive silver halide photographic emulsion stated in any one of the above (1) to (4), wherein at least 50% of all the silver halide grains in number are tabular grains having an aspect ratio in the range of 2 to 100, and dislocation lines are observed in the said tabular grains.

(6) A silver halide photographic light-sensitive material having at least one light-sensitive silver halide emulsion layer on a support, wherein use is made of the light-sensitive silver halide photographic emulsion stated in any one of the above (1) to (5) in at least one of the said emulsion layers.

(7) A silver halide photographic emulsion, comprising tabular silver halide grains having an aspect ratio in the range of 2 to 100, that comprise (111) planes (principal planes) and side planes having (100) planes, and that have been subjected to reduction sensitization, and comprising at least one compound having (100) plane selectivity.

(8) The silver halide photographic emulsion stated in the above (7), wherein at least 50% of the said tabular silver halide grains in number have dislocation lines.

(9) The silver halide photographic emulsion stated in the above (7) or (8), wherein the said (100) plane-selective compound is a compound represented by the above formula (I).

(10) A silver halide photographic light-sensitive material having at least one light-sensitive silver halide emulsion layer on a support, wherein use is made of the silver halide photographic emulsion stated in any one of the above (7) to (9) in at least one of the said silver halide emulsion layers.

(11) A silver halide emulsion, which is prepared by allowing, in a step of forming silver halide grains having a thickness in the range of 0.01 μm to 0.30 μm, a compound that will be adsorbed more selectively on the (100) planes of the said silver halide grains than on the (111) planes of the said silver halide grains, to be present during the formation of the said grains.

(12) The silver halide emulsion as stated in the above (11), wherein the said silver halide grains are tabular grains composed of principal planes and side planes, and the said side planes comprise (100) planes.

(13) The silver halide emulsion as stated in the above (12), wherein the said compound that is adsorbed is a spectrally sensitizing dye.

(14) The silver halide emulsion as stated in the above (12), wherein the said compound that is adsorbed is a compound represented by the above formula (I).

(15) A silver halide photographic light-sensitive material, comprising at least one silver halide emulsion as stated in the above (11) in a light-sensitive layer.

The present invention relates to a silver halide photographic emulsion which comprises silver halide grains mainly composed of (100) planes and (111) planes, at least one (100) plane-selective compound, and at least one spectrally sensitizing dye.

In the present invention, the term "compound that is adsorbed selectively on (100) planes" (hereinafter referred to as (100) plane-selective compound) means a compound that is adsorbed more selectively on (100) planes than on other planes, and the term "selective adsorption on (111) planes" means more selective adsorption on (111) planes than on other planes.

Now the invention is described in detail.

With respect to the silver halide emulsion of the present invention, the halogen composition is not particularly specified, but preferably the silver halide of the emulsion is silver iodobromide, silver iodochloride, or silver iodochlorobromide, which contains silver iodide in an amount of about 30 mol % or less, and particularly preferably silver iodobromide or silver chloroiodobromide, which contains silver iodide in an amount in the range of about 2 mol % to about 10 mol %.

Preferably the average silver iodide content of the silver halide emulsion of the present invention is from 1 mol % to 30 mol %, more preferably from 1 mol % to 20 mol %, and most preferably from 1 mol % to 10 mol %.

The relative standard deviation of the iodine distribution among the grains of the silver halide emulsion of the present invention is not particularly specified, but preferably it is not more than 50%, more preferably not more than 35%, and most preferably not more than 20%.

The silver iodide content of individual emulsion grains can be measured by analyzing the composition of grains, grain by grain, using, for example, an X-ray micro-analyzer. Herein the term "relative standard deviation of the silver iodide content of individual grains" means the value obtained by dividing the standard deviation of the silver iodide content of at least 100 emulsion grains measured, for example, by an X-ray micro-analyzer, by the average silver iodide content, and then multiplying the resulting value by 100. A specific method for measuring the silver iodide content of individual emulsion grains is described, for example, in European Patent No. 147,868 A.

If the relative standard deviation of the silver iodide content of individual grains is large, the optimum points of the chemical sensitization of individual grains are different, it becomes impossible to bring out the function of all of the emulsion grains, and the relative standard deviation of dislocation in number among the grains is apt to become large.

In some cases, there is an interrelation between the silver iodide content Yi [mol %] of individual grains and the sphere-equivalent diameter Xi [micron] of the individual grains, and in other cases there is no such interrelation. The "sphere-equivalent diameter (Xi)" is the diameter of a sphere that is equivalent to a grain volume. In the present invention, desirably there is no such an interrelation.

The structure of the halogen composition of the grains according to the present invention can be identified, for example, by a combination of X-ray diffraction, EPMA (also called XMA) (a method wherein silver halide grains are scanned by an electron beam, to detect the silver halide composition), and ESCA (also called XPS) (a method wherein grains are irradiated with an X ray, and the spectrum of the photoelectrons emitted from the grain surfaces is analyzed).

The silver halide grains in the photographic emulsion may have a regular crystal form, such as a cubic shape, an octahedral shape, and a tetradecahedral shape, or a irregular crystal shape, such as spherical shape or a tabular shape, or they may have a crystal defect, such as twin planes, or they may have a composite crystal form of these.

The silver halide grains according to the present invention are composed mainly of (100) planes and (111) planes. By the term "mainly" is meant that at least 50%, preferably at least 65%, and most preferably at least 85%, of the grain surfaces are made up of (100) planes and (111) planes.

The silver halide grains may be fine grains having a diameter of about 0.2 $\mu$m or less, or large-size grains with the diameter of the projected area being down to about 10 $\mu$m. As the silver halide emulsion, a polydisperse emulsion or a monodisperse emulsion can be used.

The silver halide photographic emulsions that can be used in the present invention may be prepared, for example, by the methods described in *I. Emulsion Preparation and Types*, in *Research Disclosure* (RD) No. 17643 (December 1978), pp. 22–23, and ibid. No. 18716 (November 1979), p. 648, and ibid. No. 307105 (November, 1989), pp. 863–865; the methods described by P. Glafkides, in *Chimie et Phisique Photographique*, Paul Montel (1967), by G. F. Duffin, in *Photographic Emulsion Chemistry*, Focal Press (1966), and by V. L. Zelikman et al., in *Making and Coating of Photographic Emulsion*, Focal Press (1964).

A monodisperse emulsion, such as described in U.S. Pat. Nos. 3,574,628 and 3,655,394, and in British Patent No. 1,413,748, is also preferable.

The crystals may have a uniform crystal structure, or the crystals may have a different halogen composition structure, in which the halogen composition is different between the inside and the outside of the crystals, or the crystals may have a layered structure. A silver halide having a different halogen composition may be joined on the host silver halide grains by epitaxial growth, or alternatively such a compound other than silver halide like silver rhodanide and lead oxide, may be joined on the silver halide grains. Further, a mixture of grains having various kinds of crystal forms may be used.

The above-described emulsion may be any of a surface latent image-type emulsion, wherein a latent image is mainly formed on the grain surface; an internal latent image-type emulsion, wherein a latent image is formed inside the grain; and another type of emulsion, wherein a latent image is formed both on the grain surface and inside the grain; but in any case the above-described emulsion must be a negative-working emulsion. The internal latent image-type emulsion may be a core/shell-type emulsion, as described in JP-A No. 264740/1988. A method of preparing the core/shell-type, internal latent image-type emulsion is described in JP-A No. 133542/1984. The thickness of shells of the core/shell grains is different due to such conditions as the development process, but preferably it is from 3 nm to 40 nm, and particularly preferably from 5 to 20 nm.

The silver halide emulsion is generally subjected to physical ripening, chemical ripening, and spectral sensitization. Additives that are used in these steps are described in RD Nos. 17643, 18716, and 307105, whose appropriate portions are compiled in a table shown below.

The emulsion of the present invention preferably contains at least 50% (in number) of tabular silver halide grains having an aspect ratio in the range of 2 to 100. Herein, the tabular silver halide grains collectively include silver halide grains having one twin plane or two or more parallel twin-planes, and grains that do not have twin planes and whose outer surfaces are mainly (100) planes. When ions of all the lattice points on the opposite sides of a (111) plane are in a mirror image relation, that (111) plane is called a twin plane, herein. When the tabular grains are seen from above, they are in triangular shapes, hexagonal shapes, or circular shapes formed by rounding the corners of triangles or hexagons. The triangular tabular grains have triangular parallel outer surfaces, the hexagonal tabular grains have hexagonal parallel outer surfaces, and the circular tabular grains have circular parallel outer surfaces.

When silver halide grains are observed by the usual replica method, the outer surface observed to occupy the largest area is called "a principal surface", in the present invention. For example, when tabular grains having double parallel twin planes are observed, hexagonal outer surfaces occupy the largest area, and these outer surfaces are called principal surfaces. On the other hand, the term "side plane" means the plane adjacent to a principal surface. That is, in the case of the above tabular grains, the side plane means a plane wherein a so-called re-entrant corner is observed.

In the present invention, the aspect ratio of tabular silver halide grains is the value obtained by dividing the circle-equivalent diameter of the grains by the thickness of the grains.

In the present invention, the circle-equivalent diameter is the diameter of a circle having an area equal to the projected area of the parallel outer surfaces of the grain.

The projected areas of grains are obtained by measuring the areas on an electronmicrograph and correcting it by the image magnification.

The thickness of grains can be easily found by vacuum deposition of a metal together with a reference latex in a slanted direction onto the grains, measuring the length of their shadows (the shadows of replicas by the replica method) on an electronmicrograph, and calculating the thickness of the grains based on the length of the shadows of the reference latex.

Preferably the circle-equivalent diameter of the tabular silver halide grains is 0.2 to 5.0 $\mu$m, and more preferably 0.3 to 5.0 $\mu$m. Preferably the thickness of the tabular silver halide grains is 0.03 to 0.5 $\mu$m, more preferably 0.03 to 0.3 $\mu$m, furthermore preferably 0.03 to 0.20 $\mu$m. Alternatively, the thickness is preferably 0.05 to 0.5 $\mu$m, and particularly preferably 0.05 to 0.20 $\mu$m.

Preferably the aspect ratio of the tabular silver halide grains for use in the present invention is in the range of 2 to 100, more preferably 2 to 50, furthermore preferably 2 to 30, particularly preferably not less than 3 but less than 20, and more particularly preferably not less than 2 but less than 8.

The proportion of the tabular silver halide grains for use in the present invention in the emulsion in number (or in the projected areas of all the silver halide grains) is at least 50%, preferably at least 70%, and particularly preferably at least 80%, of all the silver halide grains in the emulsion.

When monodisperse tabular silver halide grains are used, more preferable results can be obtained, in some cases. The structure and the preparation method of monodisperse tabular silver halide grains are described, for example, in JP-A No. 151618/1988. Briefly, on their shapes, monodisperse tabular silver halide grains are those wherein 70% or more of all the projected areas of the silver halide grains are occupied by tabular silver halide grains that are in the shape of hexagons, with the ratio of the longest side to the shortest side being 2 or less, and they possess two parallel outer surfaces. The monodispersion of such the grains is that the deviation coefficient of the grain size distribution of these hexagonal tabular silver halide grains [the deviation coefficient being the value obtained by dividing the scatter (standard deviation) of the grain sizes, represented by the circle-equivalent diameters of their projected areas, by the average grain size] is 20% or less.

In the silver halide light-sensitive material of the present invention, each light-sensitive emulsion layer contains the above tabular silver halide grains preferably in a proportion of at least 40%, more preferably at least 70%, and furthermore preferably at least 85%, in a projected area ratio. The term "projected area ratio" means the proportion of tabular silver halide grains in the projected areas of all the silver halide grains in the light-sensitive emulsion layer. If the projected area ratio is too small, in some cases, there arise problems that the sensitivity and the graininess of the light-sensitive material become deteriorated, and that the sharpness is poor. In passing, preferably the average aspect ratio of the tabular silver halide grains is 3.0 or more, more preferably 4.0 or more, and particularly preferably 5.0 or more. The average aspect ratio can be determined by extracting, randomly, 1,000 silver halide grains from the emulsion, measuring the aspect ratios of the individual grains, choosing tabular grains having larger aspect ratios and occupying 50% of all the projected areas, and calculating the arithmetic mean of the aspect ratios of the individual grains in that group of the tabular grains.

Further, the tabular silver halide grains for use in the present invention are composed of principal planes and side planes, and preferably the side planes have (100) planes. By "the side planes of the tabular silver halide grains have (100) planes" is meant that the side planes of the tabular silver halide grains have (100) planes in an amount of at least 10% of all the side areas. More preferably the side planes have (100) planes in an amount of at least 20%, furthermore preferably at least 30%, particularly preferably at least 40%, and most preferably at least 60%, of all the side areas.

The ratio of the side planes of the tabular silver halide grains is found as follows.

(1) When the Principal Surfaces are (111) Planes

In accordance with the method described in Nihon Kagaku-shi 1984, No. 6, page 942, various amounts of benzocyanine dye are adsorbed to a certain amount of the emulsion, at 40° C. for 17 hours. Thereafter the total of the surface areas of the grains (S) per unit emulsion amount, and the total of the areas of the (100) planes (S1) per unit emulsion amount, are found, by optical absorption at 625 nm.

Separately from the above, from an electronmicrograph of the emulsion, the circle-equivalent diameters, and the thicknesses of the grains, are found as stated above, to find the total of the side areas (S2) per unit emulsion amount. R is found in accordance with the following equation, to find the (100) plane ratio of the side planes of the grains:

$$R\ (\%)=(S1/S2)\times 100$$

(2) When the Principal Surfaces are (100) Planes

In the same way as above, measurement is carried out to find S, S1, and S2, and R is found as shown below, to find the (100) plane ratio of the side planes of the grains:

$$R\ (\%)=(S2/S)\times 100 \text{ or}$$

$$R\ (\%)=\{(S1+S2-S)/S2\}\times 100$$

Further, more preferably, tabular silver halide grains wherein dislocation lines have been introduced are used.

Dislocations of tabular silver halide grains can be observed by a direct method using a transmission-type electron microscope at low temperatures, as described, for example, by the above-described J. E. Hamilton in Photo. Sci. Eng., 11, 57 (1967), or by T. Shiozawa in J. Soc. Phot. Sci. Japan, 35, 213 (1972). That is, silver halide grains, carefully taken out from the emulsion in such a way that pressure is not applied to generate dislocations in the grains, are placed on a mesh for electron microscope observation and are observed by the transmission method, with the sample cooled to prevent it from suffering damage (e.g. print-out) by the electron beam. In this case, the greater the thickness of the grains is, the more difficult it is for the electron beam to be transmitted. Therefore clearer observation can be effected using an electron microscope of a high-pressure type (200 kv or over for grains having a thickness of 0.25 $\mu$m). From the photograph of the grains obtained in this way, the locations of dislocations of the individual grains, seen in the direction vertical to the principal planes, can be found.

The locations of dislocations of the tabular silver halide grains for use in the present invention are generated to the sides from distances of x % of the lengths from the centers to the sides with respect to the longitudinal direction of the tabular silver halide grains. The value of x is preferably such that $10 \leqq x < 100$, more preferably $30 \leqq x < 98$, and furthermore preferably $50 \leqq x < 95$. In this case, the shape formed by joining the starting points of the dislocations is approximately similar to the shape of the grain, and sometimes the similar figure is distorted. The dislocation lines are directed approximately from the center to the sides, and often they meander.

With respect to the number of dislocations of the tabular silver halide grains for use in the present invention, at least 50% of the grains in number have at least 5 dislocation lines, and preferably at least 10 dislocation lines, per grain. More preferably at least 80% of the grains in number have at least 5 dislocation lines, and more preferably at least 10 dislocation lines, per grain. Particularly preferably at least 80% of the grains in number have at least 10 dislocation lines, and preferably at least 20 dislocation lines, per grain. The upper limit of the number of dislocations is not particularly restricted to, but preferably it is 300 or less.

The preparation of the tabular silver halide grains for use in the present invention is described now.

The tabular silver halide grains for use in the present invention can be prepared by making improvements in methods described, for example, by Cleve in "Photography Theory and Practice," (1930), page 13; by Gutuff in "Photographic Science and Engineering," Vol. 14, pages 248 to 257 (1970); and in U.S. Pat. Nos. 4,434,226, 4,414,310, 4,433,048, and 4,439,520 and British Patent No. 2,112,157.

As a tabular silver halide used in the silver halide emulsion of the present invention, any of silver bromide, silver iodobromide, silver chloride, silver chlorobromide, silver iodochlorobromide, and silver iodochloride can be used. A preferable silver halide is silver iodobromide containing silver iodide in an amount of about 30% mol or less, silver iodochloride containing silver iodide in an amount of about 30 mol % or less, or silver iodochlorobromide containing silver iodide in an amount of about 30 mol % or less. A particularly preferable tabular silver halide is silver iodobromide containing silver iodide in an amount of about 2 mol %, to about 10 mol %, or silver iodochlorobromide containing silver iodide in an amount of about 2 mol %, to about 10 mol %. The grain size distribution of the tabular silver halide is not particularly restricted and may be narrow or wide, with preference given to a narrow grain size distribution.

Further, with respect to the halogen composition in the grains of the silver halide emulsion of the present invention, the halogen composition may have a structure.

Dislocations of the tabular silver halide grains of the present invention can be introduced by providing a high-iodine phase in the grains.

The term "high-iodine phase" refers to a silver halide solid solution containing iodine, wherein, as the silver halide, silver iodide, silver iodobromide, or silver chloroiodobromide is preferable, silver iodide or silver iodobromide is more preferable, and silver iodide is particularly preferable.

The amount of the silver halide forming the high-iodine phase in terms of silver is not more than 30 mol %, and preferably not more than 10 mol %, of the amount of silver of all the grains.

It is required that the iodine content of the phase grown outside of the high-iodine phase be lower than the iodine content of the high-iodine phase. Preferably the iodine content of the phase grown outside of the high-iodine phase is 0 to 12 mol %, more preferably 0 to 6 mol %, and most preferably 0 to 3 mol %.

The composition of the tabular silver halide grains used in the present invention may be uniform or may have a structure having two or more layers substantially different in halogen composition in the grains. For example, in the case comprising tabular silver halide grains having a structure with layers different in halogen composition, the core part may contain a high-iodine layer and the outermost layer may contain a low-iodine layer, or the core part may contain a low-iodine layer and the outermost layer may contain a high-iodine layer. Further, the layered structure may have three or more layers, and in that case preferably the outer layer has a lower iodine content. If the sensitivity of the light-sensitive emulsion layer containing tabular silver halide grains is higher, the iodine content of the said tabular silver halide grains should be smaller, and thereby the interlayer effect from the highlight can be increased. For example, a high-sensitive layer can contain 0 to 3.0 mol % of iodine, a medium-sensitive layer can contain 1.0 to 5.0 mol % of iodine, and a low-sensitive layer can contain 2.3 to 6.0 mol % of iodine. Incidentally, in addition to the adjustment of the iodine content of the tabular silver halide grains, the amount of potassium iodide or the like that can be added may be changed to adjust the iodine content in the light-sensitive emulsion layer.

To the silver halide emulsion of the present invention may be added a polyvalent metal, such as iridium, rhodium, and lead, during the formation of the grains.

The silver halide emulsion of the present invention may be doped with thiocyanide ions during the formation of the grains.

The emulsion of the present invention contains a compound that is adsorbed more selectively on (100) planes of the silver halide emulsion than on (111) planes thereof ((100) plane-selective compound).

Now, (100) plane-selective compounds are described.

Compounds that will be adsorbed on silver halides (dyes and additives) are roughly of two groups, based on their molecular skeletons or substituents possessed by them; that is, they are (100) plane-selective or other-plane-selective than (100) planes (e.g. (111) plane-selective). In particular, when the initial adsorption of the compound to silver halide grains occurs more preferentially to (100) planes than to crystal habit planes other than (100) planes, the compound is said to be (100) plane-selective. On the other hand, when the initial adsorption of the compound occurs more preferentially to (111) planes than to other crystal habit planes, the compound is said to be (111) plane-selective.

In the present invention, the judgment as to whether the compound is (100) plane-selective or (111) plane-selective can be made by the below-described plane selectivity judgment method.

The judgment method of plane-selective compounds is described now.

(No. 1) Judgment Method Depending on Grain Formation 0.85 $\mu$m silver bromide tetradecahedral grains, wherein the ratio of the (100) planes to the (111) planes of the crystal habit of the grain surfaces is 52 to 48, are prepared in the below-described manner. Various dyes and additives are adsorbed, in amounts of $4\times10^{-4}$ mol/mol of Ag ($8\times10^{-4}$ mol/mol of Ag in the case of additives), at 75° C. for 5 min, and then an aqueous silver nitrate solution and an aqueous potassium bromide solution are added, over 150 min, so that the final amount of silver may be 2.25, with the amount of the silver of the said silver bromide tetradecahedral grains assumed to be 1. At that time, the electric potential is kept at 60 mV. In this way, the silver bromide tetradecahedral grains are allowed to serve as cores, and silver, in an amount equal to 125% of the amount of silver of the core grains, is attached as shells to the cores. When the (100)/(111) ratio of the crystal habit of the grains after growing is 0.63 or more, the compound is defined as a (100) plane-selective compound, and when the (100)/(111) ratio of the crystal habit of the grains after growing is less than 0.63, the compound is defined as a (111) plane-selective compound. (The (100)/(111) ratio when growing was effected without any additive was 62%.) That is, when a compound highly selective for (100) planes is adsorbed, thereafter the grain growth is highly apt to form layers on (111) planes, so that (100) planes are formed. In the (100) plane-selective compounds, the (100)/(111) ratio is preferably 0.65 or more, more preferably 0.80 or more.

Additionally stated, the grain crystal habit ratio is calculated by preparing a sample for grain crystal habit after growing by the replica method, observing the sample under a transmission-type electron microscope, and finding the ratio of (100) planes in the surface areas, from the lengths of the edges surrounding the (100) planes and the grain sizes.

Now, the preparation method of the above tetradecahedral grains is described. Preparation method of silver bromide tetradecahedral grains:

To 21 liters of an aqueous solution, containing 8.4 g of potassium bromide and 420 g of deionized ossein gelatin, and kept at 60° C. and a pH of 5, were added 750 ml of an aqueous silver nitrate solution (0.392 M) and an aqueous potassium bromide solution (0.477 M), simultaneously over 1 min, with stirring. Then, 300 ml of a 50% aqueous ammonium nitrate solution and 127.5 ml of a 25% aqueous ammonia solution were added. Thereafter, 21,000 ml of an aqueous silver nitrate solution (1.18 M) and an aqueous potassium bromide solution (1.30 M) were added, over 50 min, with the silver electric potential kept at 28 mV to a saturated calomel electrode. After the completion of the formation of grains, desalting was carried out by the usual flocculation method, followed by washing with water, and then gelatin and water were added to bring the pH to 6.3 and the pAg to 8.4. The resulting silver bromide tetradecahedral emulsion was a monodisperse tetradecahedral emulsion, wherein the grain diameter was 0.85 $\mu$m, and the deviation coefficient of the grain diameters was 12%. The (100)/(111) ratio ((100) plane ratio) of this emulsion was measured by the above-described method and was found to be 52%.

(No. 2) Judgment Method Depending on Absorption Spectra

Silver bromide octahedral grains comprising (111) planes, and silver bromide cubic grains comprising (100) planes, are prepared. From electronmicrographs of the respective grains, the surface areas of the grains are found, and the octahedral grains and the cubic grains are mixed, to prepare a silver halide emulsion so that the area of the (111) planes and the area of the (100) planes may be equal. If the adsorption spectrum of the dye differs depending on whether the dye is adsorbed on the (111) planes or the (100) planes of the surfaces of the silver halide grains, then to which planes selective adsorption occurs is judged from the absorption spectrum. That is, beforehand, the absorption spectrum of the dye adsorbed on cubic grains, and the absorption spectrum of the dye adsorbed on octahedral grains, are found, and by measuring the absorption spectrum of the dye added to the above mixed emulsion, it can be known from the peaks of the absorption wavelengths to which of the (100) planes or the (111) planes the selective adsorption occurs.

(No. 3) Judgment Method Depending on Emulsion Separation

Silver bromide octahedral grains and silver bromide cubic grains, greatly different in grain sizes, are mixed so that the area of the (111) planes and the area of the (111) planes may be equal. After the dye is added to the resulting mixed emulsion to be adsorbed, the octahedral grains and the cubic grains are separated through a filter, and the amounts of the dye in the respective separated emulsions are determined.

In the present invention, the plane selectivity of adsorption of each of various compounds to the particular silver halide emulsion was determined by the above method (No. 1).

Specific examples of (100) plane-selective sensitizing dyes are shown below:

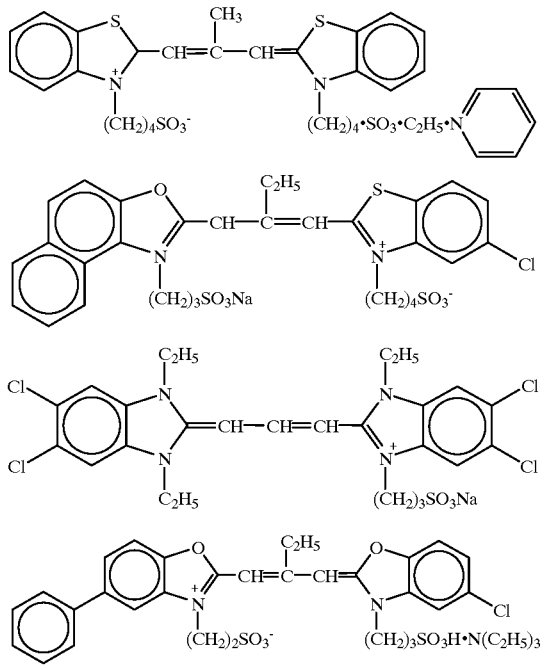

-continued

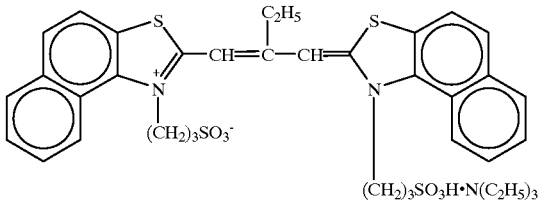

As the (100) plane-selective compound, any compound can be used without particular restrictions, as long as the particular compound is judged (100) plane-selective by the above judgment methods, and two or more such compounds can be used in combination.

Among such compounds, a compound represented by the following formula (I) is preferable.

formula (I)

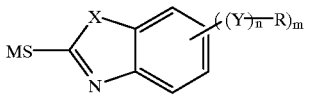

wherein R's each represent a substituted or unsubstituted alkyl group, alkenyl group, alkynyl group, aryl group, or aralkyl group; Y represents —O—, —S—, —$NR_1$—, —$NR_2CO$—, —$CONR_3$—, —$NR_4SO_2$—, —$SO_2NR_5$—, —COO—, —OCO—, —CO—, —$SO_2$—, —$NR_6CONR_7$—, —$NR_8CSNR_9$—, or —$NR_{10}COO$—, in which $R_1$, $R_2$, $R_3$, $R_4$, $R_5$, $R_6$, $R_7$, $R_8$, $R_9$, and $R_{10}$ each represent a hydrogen atom or a substituted or unsubstituted alkyl group, alkenyl group, alkynyl group, aryl group, or aralkyl group; n is 0 or 1, m is from 1 to 4; X represents —O—, —S—, or —NR'—, in which R' represents a hydrogen atom or a substituted or unsubstituted alkyl group or alkenyl group; and M represents a hydrogen atom, an alkali metal atom, an alkali earth metal atom, an ammonium group, or a group capable of cleaving under alkaline condition, provided that the total number of carbon atoms of —$((Y)_n—R)_m$ is from 1 to 30.

The (100) plane-selective compound is dissolved in a solvent, such as water or alcohols, and the solution can be added at any stage during the formation of the grains, before or after the chemical sensitization, or at the time of the application of the emulsion. Particularly preferably the addition is made before the chemical sensitization after the completion of the formation of the grains.

The amount of the (100) plane-selective compound to be added is not particularly restricted and is preferably $1\times10^{-6}$ to $1\times10^{-1}$ mol, more preferably $1\times10^{-6}$ to $1\times10^{-2}$ mol, furthermore preferably $1\times10^{-5}$ to $1\times10^{-2}$ mol, and most preferably $1\times10^{-5}$ to $1\times10^{-3}$ mol, based on the amount of silver.

Now, the compound represented by formula (I) is described in detail.

In the formula, R's each represent a substituted or unsubstituted alkyl group (e.g. methyl, ethyl, n-propyl, isopropyl, n-butyl, t-butyl, n-hexyl, 1-ethylpentyl, 1-methylbutyl, 2-methylpropyl, 2-methylbutyl, n-heptyl, n-nonyl, n-decyl, 2-hydroxyethyl, and 2-dimethylaminoethyl), alkenyl group (e.g. vinyl, allyl, and 3-butenyl), alkynyl group (e.g. propargyl), aryl group (e.g. phenyl, naphthyl, 4-methylphenyl, 3-chlorophenyl, and 4-methoxyphenyl), or aralkyl group (e.g. benzyl and phenetyl). The substituted or unsubstituted alkyl group, alkenyl group, alkynyl group, aryl group, and aralkyl group represented by $R_1$, $R_2$, $R_3$, $R_4$, $R_5$, $R_6$, $R_7$, $R_8$, $R_9$, and $R_{10}$ have the same meanings as those groups represented by R. When m is 2 or more, —$(Y)_n$—R groups are the same or different. R' represents a hydrogen atom, a substituted or unsubstituted lower alkyl group having 1 to 4 carbon atoms (e.g. methyl, ethyl, n-propyl, isopropyl, n-butyl, and 2-hydroxyethyl), or a substituted or unsubstituted alkenyl group having 2 to 4 carbon atoms (e.g. vinyl and allyl).

M represents a hydrogen atom, an alkali metal atom (e.g. a sodium atom and a potassium atom), an alkali earth metal atom (e.g. a magnesium atom and a calcium atom), an ammonium group (e.g. trimethylammonium and dimethylbenzylammonium), or a group capable of cleaving under alkaline condition (e.g. 2-cyanoethyl group and a methanesulfonylethyl group).

In the present invention, each of the groups represented by $R_1$, $R_2$, $R_3$, $R_4$, $R_5$, $R_6$, $R_7$, $R_8$, $R_9$, $R_{10}$, and R' in formula (I) may be substituted, and the groups include both substituted groups and unsubstituted ones. Examples of the substituent include a halogen atom (e.g. fluorine, chlorine, and bromine), an alkyl group (e.g. methyl, ethyl, n-propyl, isopropyl, t-butyl, n-octyl, cyclopentyl, and cyclohexyl), an alkenyl group (e.g. allyl, 2-butenyl, and 3-pentenyl), an alkynyl group (e.g. propargyl and 3-pentynyl), an aralkyl group (e.g. benzyl and phenetyl), an aryl group (e.g. phenyl, naphthyl, and 4-methylphenyl), a heterocyclic group (e.g. pyridyl, furyl, imidazolyl, piperidyl, and morpholino), an alkoxy group (e.g. methoxy, ethoxy, and butoxy), an amino group (e.g. unsubstituted amino, dimethylamino, ethylamino, and anilino), an acylamino group (e.g. acetylamino and benzoylamino), a ureido group (e.g. unsubstituted ureido, N-methylureido, and N-phenylureido), a urethane group (e.g. methoxycarbonylamino and phenoxycarbonylamino), a sulfonylamino group (e.g. methylsulfonylamino and phenylsulfonylamino), a sulfamoyl group (e.g. unsubstituted sulfamoyl, N,N-dimethylsulfamoyl, and N-phenylsulfamoyl), a carbamoyl group (e.g. unsubstituted carbamoyl, N,N-diethylcarbamoyl, and N-phenylcarbamoyl), a sulfonyl group (e.g. mesyl and tosyl), an alkyloxycarbonyl group (e.g. methoxycarbonyl and ethoxycarbonyl), an aryloxycarbonyl group (e.g. phenoxycarbonyl), an acyl group (e.g. acetyl, benzoyl, formyl, and pivaloyl), an acyloxy group (e.g. acetoxy and benzoyloxy), a phosphoric acid amido group (e.g. N,N-diethylphosphoric acid amido), an alkylthio group (e.g. methylthio and ethylthio), an arylthio group (e.g. phenylthio), a cyano group, a sulfo group, a carboxy group, a hydroxy group, a phosphono group, a nitro group, a sulfino group, an ammonio group (e.g. trimethylammonio), a phosphonio group, and a hydrazino group, which groups may be further substituted. If there are two or more substituents, they are the same or different.

In formula (I), preferably R represents a substituted or unsubstituted alkyl group; Y represents —$NR_2CO$—, —$CONR_3$—, —$NR_4SO_2$—, —$SO_2NR_5$—, or —$NR_6CONR_7$—; $R_2$, $R_3$, $R_4$, $R_5$, $R_6$, and $R_7$ each represent a hydrogen atom or a substituted or unsubstituted lower alkyl group having 1 to 4 carbon atoms; n is 1, m is 1 to 2; X represents —NR'—, wherein R' represents a hydrogen atom or a substituted or unsubstituted lower alkyl group; and M represents a hydrogen atom, an alkali metal atom, or an ammonium group, with the proviso that the total of the carbon atoms of —$((Y)_n—R)_m$ is from 1 to 20.

In formula (I), more preferably R represents a substituted or unsubstituted alkyl group having 1 to 2 carbon atoms, Y represents —NHCO— or —NHCONH—, n is 1, m is 1, and X represents —NH—. In formula (I), most preferably R represents an unsubstituted branched alkyl group having 4 to 10 carbon atoms, and Y represents —NHCO—.
Now, specific examples of the compound for use in the present invention are shown below, but the present invention is not limited to them:
1.
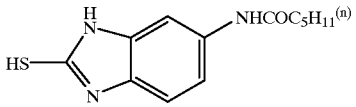
2.
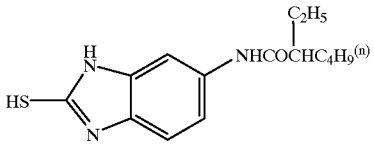
3.
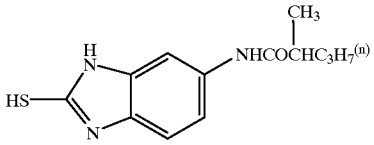
4.
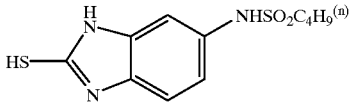
5.
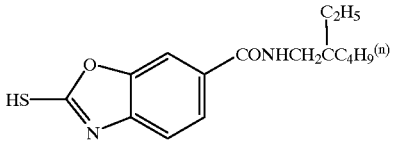
6.
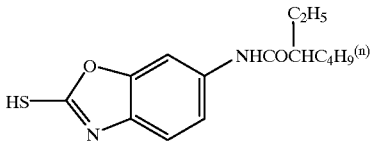
7.
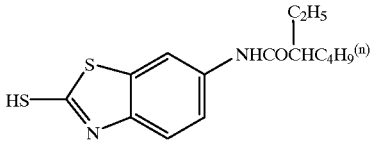
8.
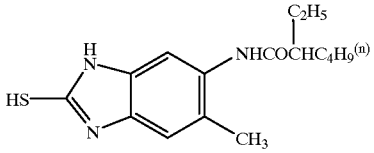
9.
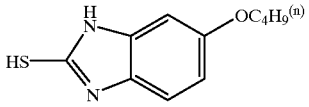
-continued
10.
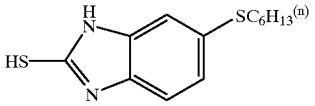
11.
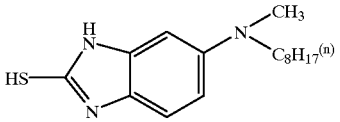
12.
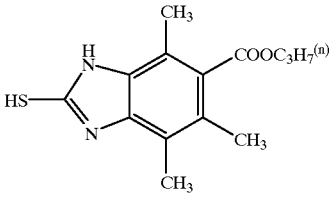
13.
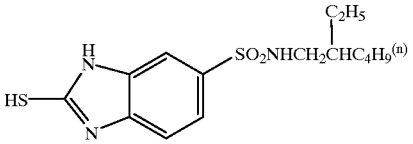
14.
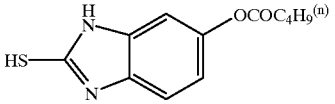
15.
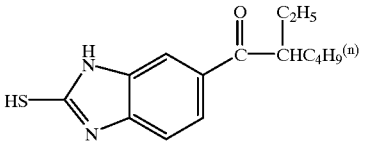
16.
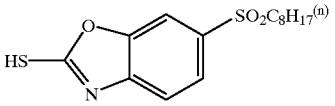
17.
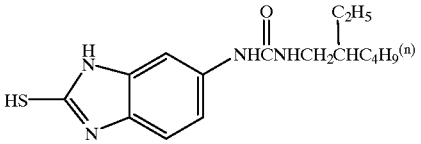
18.
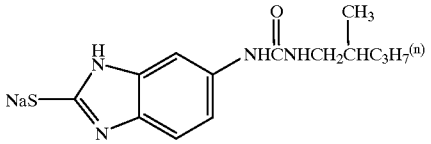
19.
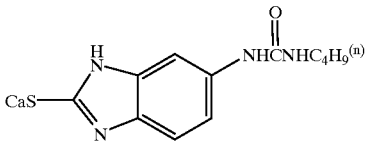

-continued

20.

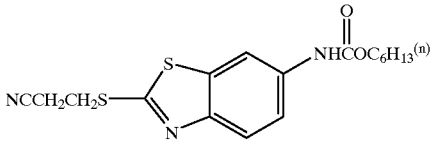

21.

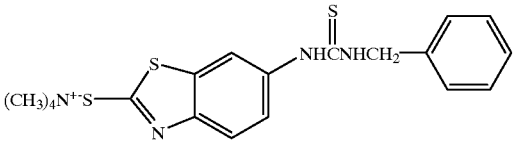

22.

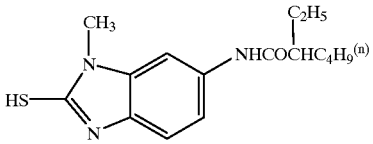

23.

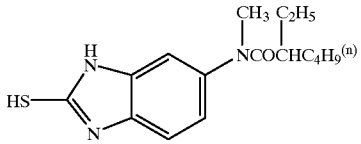

24.

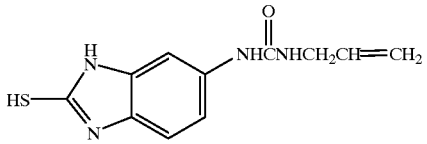

25.

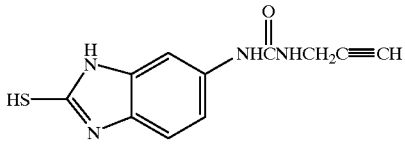

26.

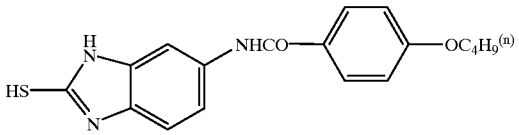

27.

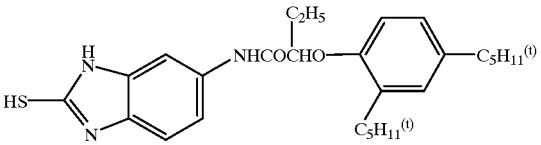

28.

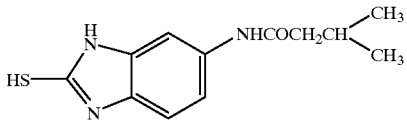

-continued

29.

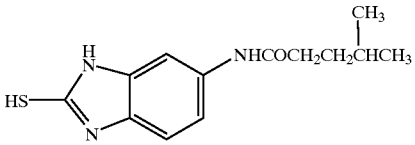

30.

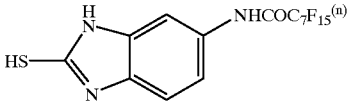

31.

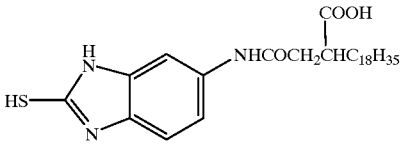

32.

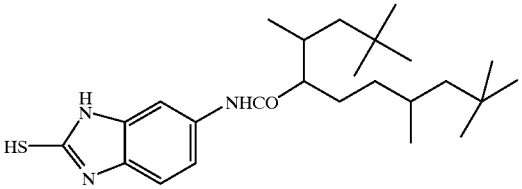

The compound represented by formula (I) can be synthesized in accordance with methods described in known literatures, for example, by J. Van Alan and B. D. Deacon in Org. Synth., IV, 569 (1963); by J. Bunner in Ber., 9, 465 (1876); by L. B. Sebrell and C. E. Boord in J. Am. Chem. Soc., 45, 2390 (1923); and in JP-A No. 48832/1986.

The improvement in the sensitivity/graininess ratio and the reduction in the fogging of tabular silver halide grains by the addition of the compound that shows (100) plane selectivity are unexpectedly surprising results.

The silver halide emulsion used in the present invention is spectrally sensitized by the addition of a sensitizing dye.

The amount of the sensitizing dye to be added during the preparation of the silver halide emulsion cannot be described simply, because it changes depending on the kind of additive and the amount of the silver halide. However, the amount of the sensitizing dye to be added during the preparation of the silver halide emulsion may be preferably the amount added in the conventional method, i.e. not less than 50% but not more than 90%, of the saturation covering amount of the emulsion grains.

That is, preferably the amount of the sensitizing dye to be added is from 0.001 mmol to 100 mmol, and more preferably from 0.01 mmol to 10 mmol, per mol of the silver halide.

When the dye used in the present invention is (111) plane-selective, it is preferable in some cases.

The term "(111) plane-selective" means that (100) planes are less than 63% in the above-described test methods.

The sensitizing dye is added at any time during the preparation of the emulsion; i.e., the sensitizing dye may be added at any time during or after the formation of the grains, at the time of the dispersion, or before, during, or after the chemical ripening.

Together with a sensitizing dye, the emulsion may contain a substance that exhibits supersensitization (supersensitizer). The supersensitizer may be a dye that itself provides no spectral sensitization action, or it may be a substance that absorbs substantially no visible light. Examples of the supersensitizers include aminostyryl compounds substituted with a nitrogen-containing heterocyclic group (e.g. those described in U.S. Pat. Nos. 2,933,390 and 3,635,721), condensates of aromatic organic acids and formaldehyde (e.g. those described in U.S. Pat. No. 3,743,510), cadmium salts, and azaindene compounds. Such combinations as described in U.S. Pat. Nos. 3,615,613, 3,615,641, 3,617,295, and 3,635,721 are especially useful.

The silver halide emulsion of the present invention may be subjected to chemical sensitization. For example the silver halide emulsion of the present invention may be chemically sensitized using active gelatin, as described by T. H. James in "The Theory of the Photographic Process," 4th ed., Macmillan (1977), pages 67 to 77, or by using sulfur, selenium, tellurium, gold, platinum, palladium, or iridium, or a combination of these sensitizers at a pAg of 5 to 10, a pH of 5 to 8, and a temperature of 30 to 80° C., as described in Research Disclosure Vol. 120, April 1974, 12008; Research Disclosure Vol. 34, June 1975, 13452; U.S. Pat. Nos. 2,642,361, 3,297,446, 3,772,031, 3,857,711, 3,901,714, 4,266,018, and 3,904,415, and British Patent No. 1,315,755. Optimally the chemical sensitization is carried out in the presence of a gold compound and a thiacyanate compound. The chemical sensitization may also be carried out in the presence, for example, of a sulfur-containing compound, hypo, a thiourea compound, or a sulfur-containing compound of a rhodanine compound, as described in U.S. Pat. Nos. 3,857,711, 4,266,018, and 4,054,457. The chemical sensitization can also be carried out in the presence of a chemical sensitization auxiliary. Examples of the chemical sensitization auxiliary that can be used include compounds that are known to suppress fogging and to increase sensitivity during the process of the chemical sensitization, such as azaindene, azapyridazine, and azapyrimidine. Examples of chemical sensitization auxiliary improvers are described in U.S. Pat. Nos. 2,131,038, 3,411,914, and 3,554,757, JP-A No. 126526/1983, and by Duffin in "Photographic Emulsion Chemistry," pages 138 to 143.

Further, for the emulsion of the present invention, chemical sensitization with a selenium compound can preferably be used.

The selenium sensitization for the silver halide emulsion of the present invention can be carried out in a conventionally known manner. That is, the selenium sensitization for the silver halide emulsion of the present invention can be carried out generally by adding an unstable selenium compound and/or a not-unstable selenium compound and stirring the resulting emulsion for a certain period at a high temperature, preferably at at least 40° C. Preferably the selenium sensitization using an unstable selenium sensitizer, described in JP-B No. 15748/1969, is carried out. Specific examples of the unstable selenium sensitizer are aliphatic isoselenocyanates, such as ally isoselenocyanate; selenoureas, selenoketones, selenoamides, selenocarboxylic acids, selenoesters, and selenophosphates. Particularly preferable unstable selenium compounds are shown below:

I. Colloidal metal selenium

II. Organoselenium compounds (formed by covalent bonding of a selenium atom to a carbon atom of an organic compound through double bonding)

a. Isoselenocyanates

For example, aliphatic isoselenocyanates, such as allyl isoselenocyanate.

b. Selenoureas (including enol forms)

For example, aliphatic selenoureas, such as methylselenourea, ethylselenourea, isopropylselenourea, butylselenourea, hexylselenourea, octylselenourea, dioctylselenourea, tetramethylselenourea, N-(β-carboxyethyl)-N',N'-dimethylselenourea, N,N-dimethylselenourea, diethylselenourea, and dimethylselenourea; aromatic selenoureas having one or more aromatic groups, such as phenyl and tolyl groups; and heterocyclic selenoureas having a heterocyclic group, such as pyridyl and benzothiazolyl.

c. Selenoketones

For example, selenoacetone, selenoactophenone, selenoketones having an alkyl group bonded to —C(=Se)—, and selenobenzophenone.

d. Selenoamides

For example, selenoacetamide.

e. Selenocarboxylic acids and their esters

For example, 2-selenopropionic acid, 3-selenobutyric acid, and methyl 3-selenobutyrate.

III. Others a. Selenides

For example, diethyl selenide, diethyl diselenide, and triphenylphosphine selenide.

b. Selenophosphates

For example, tri-p-tolyl selenophosphate and tri-n-butyl selenophosphate.

Preferable unstable selenium compounds are given above, but the present invention is not limited to them. With respect to unstable selenium compounds as sensitizers of photographic emulsions, the following matters are generally understood by those skilled in the art. That is, the structure of unstable selenium compounds is not very important, as long as the selenium is unstable, and the organic moiety of the molecule of the selenium sensitizer carries selenium and allows the selenium to be present in an unstable form in the emulsion, but the organic moiety has no role besides the above. In the present invention, unstable selenium compounds falling in the above wide concept can be used advantageously.

Selenium sensitization using not-unstable selenium sensitizers, as described in JP-B Nos. 4553/1971, 34492/1977, and 34491/1997, can also be carried out. Examples of the not-unstable selenium compound include, for example, selenious acid, potassium selenocyanate, selenazoles, quaternary ammonium salts of selenazoles, diaryl selenides, diaryl diselenides, 2-thioselenazolidinedione, 2-selenooxodinethione, and their derivatives.

Thioselenazolidinedione compounds and not-unstable selenium sensitizers described in JP-B No. 38408/1987 are also effective.

These selenium sensitizers are dissolved in water, an organic solvent, such as methanol and ethanol, or a mixed solvent, and the solution is added at the time of chemical sensitization. Preferably the solution is added before the start of some other chemical sensitization besides selenium sensitization. The selenium sensitizers can be used not only alone but also as a combination of two or more. A combination of a unstable selenium compound with a not-unstable selenium compound is preferable.

The amount of the selenium sensitizer to be added that is used in the present invention varies depending, for example, on the activity of the particular selenium sensitizer, the type and size of the silver halide, and the temperature and the time of the ripening, and the amount is preferably $1\times10^{-8}$ mol or more, and more preferably $1\times10^{-7}$ mol or more, and not more than $5\times10^{-5}$ mol, per mol of silver halide. The temperature of the chemical ripening when the selenium sensitizer is used is preferably 45° C. or higher, and more preferably 50° C. or higher, and 80° C. or lower.

The ripening pAg when the selenium sensitizer is used is arbitrary, and preferably it is 7.5 or more, but 11 or less, and more preferably 8.0 or more, but 10 or less. The pH is also arbitrary and is preferably 4 or more but 7.5 or less, and more preferably 5 or more but 6.8 or less. These preferable conditions may be used singly, but more preferably they used in a combination.

It is more effective when the selenium sensitization for use in the present invention is carried out in the presence of a silver halide solvent.

Examples of the silver halide solvent that can be used in the present invention include (a) organic thioethers described, for example, in U.S. Pat. Nos. 3,271,157, 3,531,289, and 3,574,628, and JP-A Nos. 1019/1979 and 158917/1979, (b) thiourea derivatives described, for example, in JP-A Nos. 82408/1978, 77737/1980, and 2982/1980, (c) silver halide solvents having a thiocarbonyl group between an oxygen atom or a sulfur atom and a nitrogen atom, as described in JP-A No. 144319/1978, (d) imidazoles described in JP-A No. 100717/1979, (e) sulfites, and (f) thiocyanates.

Particularly preferable solvents are thiocyanates and tetramethylthiourea. The amount of the solvent to be used varies depending on the type of the solvent, and in the case of thiocyanates the amount to be used is preferably $1\times10^{-4}$ mol or more, but $1\times10^{-2}$ mol or less, per mol of the silver halide.

In the chemical sensitization of the silver halide grains according to the present invention, in addition to the selenium sensitization, desirably sulfur sensitization and gold sensitization are used alone or in combination.

The sulfur sensitization is generally carried out by adding a sulfur sensitizer and stirring the resulting emulsion for a certain period at a high temperature, preferably at 40° C. or higher, and more preferably at 50° C. or higher but 80° C. or lower.

The gold sensitization is generally carried out by adding a gold sensitizer and stirring the resulting emulsion for a certain period at a high temperature, preferably at 40° C. or higher, and more preferably at 50° C. or higher but 80° C. or lower.

In the above sulfur sensitization, known sulfur sensitizers can be used. Examples include thiosulfates, ally thiocarbamidethiourea, allyl isothiocyanate, cystine, p-toluenethiosulfonates, and rhodanine. In addition, sulfur sensitizers described in U.S. Pat. Nos. 1,574,944, 2,410,689, 2,278,947, 2,728,668, 3,501,313, and 3,656,955, German Patent No. 1,422,869, JP-B No. 24937/1981, and JP-A No. 45016/1980 can be used.

The amount of the sulfur sensitizer to be added is suitably an amount sufficient to effectively increase the sensitivity of the emulsion. That amount varies in a substantially wide range depending on various conditions, such as the pH, the temperature, and the size and type of the silver halide grains, and preferably the amount is $1\times10^{-7}$ mol or more but $1\times10^{-4}$ mol or less, per mol of the silver halide.

The oxidation number of the gold in the gold sensitizers of the gold sensitization that can be used in the present invention may be +1 or +3, and as the gold sensitizer, a gold compound usually used can be used. Typical examples include chloroaurates, potassium chloroaurate, auric trichloride, potassium auric thiocyanate, potassium iodoaurate, tetracyanoauric cyanide, ammonium aurothiocyanate, and pyridyltrichlorogold.

The amount of the gold sensitizer to be added varies depending on various conditions, and preferably the amount is roughly $1\times10^{-7}$ mol or more but $1\times10^{-4}$ mol or less, per mol of silver halide.

In the chemical ripening, it is not required to place any particular restrictions on the timing of the addition and the order of the addition of the silver halide solvent and/or the selenium sensitizer and/or the sulfur sensitizer, the gold sensitizer, etc., and, for example, the above compounds may be added simultaneously or at intervals, preferably at the initial stage of the chemical ripening or during the process of the chemical ripening. When the above compounds are added, they may be dissolved in water, an organic solvent miscible with water, such as methanol, ethanol, and acetone, or a mixture of these, and then they may be added.

The emulsion of the present invention may be chemically sensitized in such a way that the surface or arbitrary positions from the surface are chemically sensitized, with preference given to the former. When the inside is chemically sensitized, reference can be made to a method described in JP-A No. 264740/1988.

The silver halide emulsion of the present invention may be subjected to reduction sensitization.

The production steps of a silver halide emulsion are classified into the steps of grain formation, desalting, chemical sensitization, and the like. The grain formation includes nucleus formation, ripening, and growth. These steps are not necessarily performed in this order, and the order of these steps may be reversed, or alternatively these steps may be repeated. The reduction sensitization may be carried out for a silver halide emulsion, and this means the reduction sensitization may be, basically, carried out at any steps. The reduction sensitization may be carried out at the time of the nucleus formation, which is an initial stage of the grain formation, or at the time of the physical ripening, or at the time of the growth, or alternatively in advance of, or after completion of, a chemical sensitization other than the reduction sensitization. When a chemical sensitization includes a gold sensitization, preferably the reduction sensitization is performed in advance of the chemical sensitization, so that undesirable fog will not occur. A method in which the reduction sensitization is conducted during the growth of silver halide grains is most preferred. The term "during the growth" referred to herein means that the above-mentioned method includes a method in which the reduction sensitization is carried out such that silver halide grains are physically ripening, or they are growing by the addition of a water-soluble silver salt and a water-soluble alkali halide, and also a method in which the reduction sensitization is effected such that the growth of silver halide grains is tentatively stopped during growth of the grains, and then the growth is further continued.

The reduction sensitization for use in the present invention includes such known methods as one in which a known reducing agent is added to a silver halide emulsion, a method in which silver halide grains are grown or ripened at a low-pAg atmosphere of from 1 to 7, which is called "silver ripening," and a method in which silver halide grains are grown or ripened at a high-pH atmosphere of from 8 to 11, which is called "high-pH ripening." Further, two or more of these methods may be used in combination.

A method in which a reduction sensitizer is added to a silver halide emulsion, is preferred from the viewpoint that the level of the reduction sensitization can be minutely controlled.

For use as a reduction sensitizer, stannous salts, amines and polyamines, hydrazine derivatives, formamidinesulfinic acid, silane compounds, borane compounds, and the like are known. The reduction sensitizer for use in the present invention may be selected from these known compounds. Further, two or more kinds of these compounds may be used in combination. Preferred of these reduction sensitizers are stannous chloride, thiourea dioxide, dimethylamineborane, and ascorbic acids and derivatives thereof. The amount of the reduction sensitizer to be added is determined depending on the condition for the production of a silver halide emulsion, but suitably it is in the range of from $10^{-7}$ mol to $10^{-3}$ mol, per mol of silver halide.

Specific examples of ascorbic acids and derivatives thereof (hereinafter referred to as ascorbic acid compounds) are illustrated below.

(A-1) L-ascorbic acid
(A-2) Sodium L-ascorbate
(A-3) Potassium L-ascorbate
(A-4) DL-ascorbic acid
(A-5) Sodium D-ascorbate
(A-6) L-ascorbic acid-6-acetate
(A-7) L-ascorbic acid-6-palmitate
(A-8) L-ascorbic acid-6-benzoate
(A-9) L-ascorbic acid-5,6-diacetate
(A-10) L-ascorbic acid-5,6-o-isopropylidene Desirably, ascorbic acid compounds for use in the present invention are used in a larger amount than that in which a reduction sensitizer is preferably used hitherto. For example, JP-B No. 33572/1982 describes that "the amount of a reduction sensitizer is usually not more than $0.75\times10^{-2}$ milliequivalents, per g of silver ion ($8\times10^{-4}$ mol/AgX mol), and the amount of 0.1 to 10 mg, per kg of silver nitrate ($10^{-7}$ to $10^{-5}$ mol, per mol of Ag in terms of ascorbic acid) is effective in many cases" (the conversion values in parentheses were calculated by the present inventors). U.S. Pat. No. 2,487,850 describes that the amount of a tin compound to be added for use as a reduction sensitizers is in the range of from $1\times10^{-7}$ mol to $44\times10^{-6}$ mol. Further, JP-A No. 179835/1982 describes that the addition amount of thiourea dioxide is in the range of from about 0.01 mg to about 2 mg, per mol of silver halide, and stannous chloride is suitably used in the range of from about 0.01 mg to about 3 mg, per mol of silver halide. The preferable addition amount of the ascorbic acid compound for use in the present invention varies depending on such factors as the grain size of a photographic emulsion, the halogen composition, and the temperature, pH, or pAg at the time of preparation of a photographic emulsion, but preferably the amount of the ascorbic acid compound is selected from the range of from $5\times10^{-5}$ to $1\times10^{-1}$ mol, more preferably from $5\times10^{-4}$ mol to $1\times10^{-2}$ mol, and particularly preferably from $1\times10^{-3}$ mol to $1\times10^{-2}$ mol, per mol of silver halide.

A reduction sensitizer may be added to an emulsion during the formation of silver halide grains, or alternatively before or after the completion of chemical sensitization, in the form of a solution having the reduction sensitizer dissolved in water or such a solvent as alcohols, glycols, ketones, esters, and amides. The time when the reduction sensitizer is added to the emulsion may be any stage during preparation of the emulsion, but especially preferably the reduction sensitizer is added during the growth of silver halide grains. The reduction sensitizer may be added to a reaction vessel in advance, but preferably the reduction sensitizer is added at any proper stage during the formation of silver halide grains. Alternatively, use can be made of a method in which the reduction sensitizer is added to an aqueous solution of a water-soluble silver salt, or a water-soluble alkali halide in advance, and then grain formation is performed using these aqueous solutions. Further, a method in which a solution of the reduction sensitizer is added in parts and/or successively for a long period of time during the formation of silver halide grains, is also preferred.

The photographic emulsion of the present invention may contain various compounds in order to prevent fogging in the process of the production of the light-sensitive material, during the storage of the light-sensitive material, or during the photographic processing of the light-sensitive material, or in order to stabilize the photographic property. That is, many compounds known as antifoggants and stabilizers can be added, examples of which are azoles, such as benothiazolium salts, nitroindazoles, triazoles, benzotriazoles, and benzimidazoles (particularly nitro-substituted benzimidazoles or halogen-substituted benzimidazoles); heterocyclic mercapto compounds, such as mercaptothiazoles, mercaptobenzothiazoles, mercaptobenzimidazoles, mercaptothiazoles, mercaptotetrazoles (particularly 1-phenyl-5-mercaptotetrazole), and mercaptopyrimidines; heterocyclic mercapto compounds having a water-soluble group, such as a carboxyl group and a sulfon group; thioketo compounds, such as oxazolithione; azaindenes, such as tetraazaindenes (particularly 4-hydroxy-substituted (1,3,3a,7)tetraazaindenes); benzenethiosulfonic acids, and benzenesulfinic acid.

The addition of these antifoggants and stabilizers may be carried out generally after the chemical sensitization, and preferably it is carried out during the chemical ripening or before the start of the chemical ripening. That is, in the process of the formation of the silver halide emulsion grains, the antifoggants and the stabilizers may be added during the addition of the silver salt solution, between the addition of the silver salt solution and the start of the chemical ripening, or during the chemical ripening (preferably within the period of 50%, and more preferably 20%, from the start of the chemical ripening).

The silver halide emulsion of the present invention may be used singly or as a mixture with other light-sensitive silver halide emulsion. In addition to the silver halide emulsion of the present invention, a non-light-sensitive silver halide emulsion, wherein the surface and the inside have been fogged, may be used in the same layer or in a separate layer.

In the light-sensitive material of the present invention, a mixture of two or more kinds of light-sensitive silver halide emulsions, each of which has at least one different property in terms of grain size, grain size distribution, halogen composition, shape of the grain, and sensitivity, can be used in the same layer.

Silver halide grains whose surface was previously fogged, as described in U.S. Pat. No. 4,082,553; silver halide grains whose internal portion was previously fogged, as described in U.S. Pat. No. 4,626,498 and JP-A No. 214852/1984, or a colloidal silver, may be preferably applied to a light-sensitive silver halide emulsion layer and/or a substantially non-light-sensitive hydrophilic colloid layer. The silver halide grains whose inside or surface was previously fogged means silver halide grains that are developable uniformly (non-image wise) without a distinction of an unexposed part and an exposed part of the photosensitive material. A method of preparing silver halide grains whose inside or surface is previously fogged is described in U.S. Pat. No. 4,626,498 and JP-A No. 214852/1984.

Silver halides that form internal nuclei of the core/shell-type silver halide grains whose inside is previously fogged may be those having the same halogen composition or those having different halogen compositions. As a silver halide whose inside or surface of grain is previously fogged, any of silver chloride, silver chlorobromide, silver iodobromide, and silver chloroiodobromide can be used. Sizes of these previously fogged silver halide grains are not limited in particular, but an average grain size thereof is preferably from 0.01 μm to 0.75 μm, and particularly preferably from 0.05 μm to 0.6 μm. Further, a grain shape is not limited in particular, and grains may be regular in shape. Moreover, these emulsions may be a poly-dispersion emulsion, but a mono-dispersion emulsion (at least 95% of silver halide grains in weight or number have grain diameters within ±40% of the average grain diameter) is preferred.

The photographic emulsion of the present invention can be applied to various color and black-and-white light-sensitive materials. Typical examples are general-purpose or motion picture color negative films, color reversal films for slides or television, color papers, color positive films, color reversal papers, color diffusion light-sensitive materials, and heat-development color light-sensitive materials.

The photographic emulsion of the present invention can also be applied to process films, such as lith films and scanner films, direct/indirect medical or industrial X-ray films, negative black-and-white films for shooting, black-and-white photographic printing papers, computer output microfilms, conventional microfilms, silver salt diffusion transfer light-sensitive materials, and print-out light-sensitive materials.

It is sufficient that the light-sensitive material of the present invention has, on a support, at least one silver halide emulsion layer of a blue-sensitive layer, a green-sensitive layer, or a red-sensitive layer, and there is no particular restriction on the number of silver halide emulsion layers and non-light-sensitive layers or on the order of these layers. A typical example is a silver halide photographic light-sensitive material having, on a support, at least one photosensitive layer comprising multiple silver halide emulsion layers that have substantially the same color sensitivity but are different in photographic sensitivity, wherein said photosensitive layer is a unit photosensitive layer having color sensitivity to any one of blue light, green light, and red light. In the case of a multilayer silver halide color photographic light-sensitive material, generally the arrangement of unit photosensitive layers is such that a red-sensitive layer, a green-sensitive layer, and a blue-sensitive layer are placed in the stated order from the support side. However, the order of the arrangement may be reversed in accordance with the purpose, and between layers having the same color sensitivity there may be placed a photosensitive layer having a different color sensitivity.

The photographic light-sensitive material of the present invention is preferably a multi-layer color photographic light-sensitive material having at least one silver halide emulsion layer and at least one non-light-sensitive layer, provided on a support. In many cases, the photographic light-sensitive material of the present invention has at least two silver halide emulsion layers sensitive to lights in substantially different wavelength regions. More preferably, the photographic light-sensitive material of the present invention has a color-image-forming unit comprising a red-sensitive silver halide emulsion layer, a color-image-forming unit comprising a green-sensitive silver halide emulsion layer, and a color-image-forming unit comprising a blue-sensitive silver halide emulsion layer.

Further, the photographic light-sensitive material of the present invention contains, in a silver halide emulsion layer, at least one nondifusion color-forming coupler capable of coupling with the oxdation product of an aromatic primary amine developing agent, to form a dye. Preferably the photographic light-sensitive material of the present invention has a blue-sensitive silver halide emulsion layer containing a yellow coupler, a green-sensitive silver halide emulsion layer containing a magenta coupler, and a red-sensitive silver halide emulsion layer containing a cyan coupler. After the multi-layer color photographic light-sensitive material of the present invention is exposed to light and is subjected to development, it is processed with a bleaching solution or a bleach/fix solution.

Nonphotosensitive layers such as various intermediate layers may be placed between, on top of, or under the above-mentioned silver halide photosensitive layers.

The intermediate layer may contain, for example, couplers and DIR compounds, as described in JP-A Nos. 43748/1986, 113438/1984, 113440/1984, 20037/1986, and 20038/1986 and may also contain a color-mixing inhibitor as generally used.

Two or more kinds of silver halide emulsion layers that constitute each of the unit light-sensitive layers are preferably configurated in the order of a high-sensitive emulsion layer and a low-sensitive emulsion layer from a support, so that the sensitivities of these emulsion layers successively become lower in the direction toward the support, as described in German Patent No. 1,121,470 and British Patent No. 923,045. Further, a non-light-sensitive layer may be provided between each two silver halide emulsion layers. Further, a low-sensitive emulsion layer at the position further from a support, and a high-sensitive emulsion layer nearer the support, can also be set, as described in JP-A Nos. 112751/1982, 200350/1987, 206541/1987, and 206543/1987.

Two or more kinds of silver halide emulsion layers that constitute each of the unit photosensitive layers, particularly preferably have a three-layer constitution at least comprising a high-sensitive emulsion layer, a medium-sensitive emulsion layer, and a low-sensitive emulsion layer. In the arrangement of the above constitution, a low-sensitive emulsion layer or alternatively a high-sensitive emulsion layer may be placed nearer to the support, and there is no particular restriction.

Specific examples of the order include an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), an order of BH/BL/GL/GH/RH/RL, and an order of BH/BL/GH/GL/RL/RH, stated from the side away from the support.

As described in JP-B No. 34932/1980, an order of a blue-sensitive layer/GH/RH/GL/RL stated from the side away from the support is also possible. Further as described in JP-A Nos. 25738/1981 and 63936/1987, an order of a blue-sensitive layer/GL/RL/GH/RH stated from the side away from the support is also possible.

Further as described in JP-B No. 15495/1974, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A No. 202464/1984.

Further, for example, an order of a high-sensitive emulsion layer/low-sensitive emulsion layer/medium-sensitive emulsion layer or an order of a low-sensitive emulsion layer/medium-sensitive emulsion layer/high-sensitive emulsion layer can be taken. In the case of four layers or more layers, the arrangement can be varied as above.

In order to improve color reproducibility, a donor layer (CL), for use to attain an interlayer effect, whose spectral sensitivity distribution is different from that of such main light-sensitive layers as BL, GL, and RL, is preferably set adjacent to or near the main light-sensitive layer, as described in U.S. Pat. Nos. 4,663,271, 4,705,744, and 4,707,436, and in JP-A Nos. 160448/1987 and 89850/1988.

As stated above, various layer constitutions and arrangements can be selected in accordance with the purpose of the particular light-sensitive material.

The light-sensitive emulsion layer containing tabular silver halide grains that constitutes the light-sensitive material of the present invention, can be prepared through steps, for example, of forming grains, desalting, chemical sensitizing, and coating, by using a known method. Out of these steps, the step of forming grains can include steps, for example, of forming nuclei, ripening, and growing, which are not necessarily carried out in the stated order, and they can be carried out in an arbitrary manner with the order reversed or changed. It is recommended that the adsorbable compound that will be contained in the silver halide emulsion of the present invention be added at the step of forming grains.

In the method of producing the photographic light-sensitive material of the present invention, generally, photographically useful materials are added to a photographic coating solution, i.e. a hydrophilic colloid solution.

Generally the photographic light-sensitive material of the present invention is exposed to light imagewise and is then processed with an alkali developer containing a developing agent, and after this color development the color photographic light-sensitive material is subjected to an image-forming process, wherein the color photographic light-sensitive material is processed with a processing solution containing a bleaching agent and having bleaching ability.

As various techniques and inorganic and organic materials that can be used for the silver halide photographic emulsion of the present invention and the silver halide photographic light-sensitive material wherein said silver halide photographic emulsion is used, generally those described in Research Disclosure Nos. 308119 (1989) and 37038 (1995) can be used.

In addition thereto, more specifically, for example, techniques and inorganic and organic materials that can be used for color photographic light-sensitive materials to which the silver halide photographic emulsion of the present invention can be applied, are described in the below-shown sections in European Patent No. 436,938 A2 and the below-shown patents cited therein. By referring to these disclosures, those skilled in the art can suitably select substances, techniques, and materials that can be used in producing the light-sensitive material of the present invention. Accordingly, the disclosures of these publications are to be included as disclosures of this specification.

| Item | Corresponding section |
|---|---|
| 1) Layer structures | page 146, line 34 to page 147, line 25 |
| 2) Silver halide emulsions | page 147, line 26 to page 148, line 12 |
| 3) Yellow couplers | page 137, line 35 to page 146, line 33, and page 149, lines 21 to 23 |
| 4) Magenta couplers | page 149, lines 24 to 28; and European Patent No. 421,453 A1, page 3, line 5 to page 25, line 55 |
| 5) Cyan couplers | page 149, lines 29 to 33; and European Patent No. 432,804 A2, page 3, line 28 to page 40, line 2 |
| 6) Polymer couplers | page 149, lines 34 to 38; and European Patent No. 435,334 A2, page 113, line 39 to page 123, line 37 |
| 7) Colored couplers | page 53, line 42 to page 137, line 34, and page 149, lines 39 to 45 |
| 8) Other functional couplers | page 7, line 1 to page 53, line 41, and page 149, line 46 to page 150, line 3; and European Patent No. 435,334 A2, page 3, line 1 to page 29, line 50 |
| 9) Antiseptics and mildewproofing agents | page 150, lines 25 to 28 |
| 10) Formalin scavengers | page 149, lines 15 to 17 |
| 11) Other additives | page 153, lines 38 to 47; and European Patent No. 421,453 A1, page 75, line 21 to page 84, line 56, and page 27,line 40 to page 37, line 40 |
| 12) Dispersion methods | page 150, lines 4 to 24 |
| 13) Supports | page 150, lines 32 to 34 |
| 14) Film thickness and film physical properties | page 150, lines 35 to 49 |
| 15) Color development/black-and-white development/fogging steps | page 150, line 50 to page 151, line 47; and European Patent No. 442,323 A2, page 34, lines 11 to 54, and page 35, lines 14 to 22 |
| 16) Desilvering step | page 151, line 48 to page 152, line 53 |
| 17) Automatic processors | page 152, line 54 to page 153, line 2 |
| 18) washing/stabilizing steps | page 153, lines 3 to 37 |

Preferable embodiments of the present invention are shown below:

(1) The grain thickness of the silver halide tabular grains is in the range of 0.2 $\mu$m to 0.01 $\mu$m.

(2) More preferably the thickness of the silver halide tabular grains is in the range of 0.15 $\mu$m to 0.01 $\mu$m.

(3) At least 20% of all of the side surfaces of the silver halide grains are made up of (100) planes.

(4) More preferably at least 40% of all of the side surfaces of the silver halide grains are made up of (100) planes.

(5) Most preferably at least 60% of all of side surfaces of the silver halide grains are made up of (100) planes.

(6) When the formation of grains has proceeded 20% or more, but 100% or less, the adsorbable substance (specific plane-selective compound) has been added.

(7) The amount of the adsorbable substance to be used is $5\times10^{-5}$ mol/mol of Ag or more, but $1\times10^{-2}$ mol/mol of Ag or less.

(8) The composition of the emulsion grains comprises AgBr, AgCl, AgBrI, and AgClBr.

(9) The surface of the emulsion grains has been sensitized with sulfur, selenium, tellurium, gold/sulfur, gold/selenium, gold/tellurium, gold/sulfur/selenium, gold/sulfur/selenium/tellurium, or gold/sulfur/tellurium.

(10) The surface or inside of the emulsion grains has been subjected to reduction sensitization.

(11) Chemical sensitization has been carried out by using silver rhodanide additionally.

(12) A dissolvable developer is used.

(13) The developer in (10) contains a rhodanide.

(14) The emulsion comprises an emulsion for color reversal.

The silver halide emulsion and the silver halide photographic light-sensitive material of the present invention are characterized by high sensitivity and excellent RMS granularity.

Further, the silver halide emulsion and the silver halide photographic light-sensitive material of the present invention are characterized by high sensitivity, excellent RMS granularity, and excellent development progress balance.

EXAMPLES

Now, the present invention is described in more detail with reference to the following Examples, but the present invention is not restricted to them.

The structural formulas of the compounds used in the Examples 1 and 2 are shown after Example 2. In passing, as a (100) plane-selective compound, Exemplified Compound 2 was used in Examples 1 and 2. That compound had a (100) plane ratio of 0.90, measured by the above-described plane selectivity judgment test, and it was a compound definded in the present invention. Further, as dyes, ExS-1 and ExS-3 were used, which showed 0.50 (ExS-1) and 0.80 (ExS-3) in the plane selectivity judgment method.

Example 1

Preparation of Emulsion-1

The temperature and the pBr of 1.6 liters of an aqueous solution, containing 0.6 g of KBr and 0.8 g of a gelatin having an average molecular weight of 15,000, were kept at 35° C. and 2.8, respectively. Then, into the above aqueous solution, 60 ml of an aqueous silver nitrate solution (containing 20.0 g of silver nitrate per 100 ml) and 60 ml of an aqueous potassium bromide solution (containing a low-molecular weight gelatin at a concentration of 0.02 g/ml, and 14.0 g of potassium bromide per 100 ml) were added, simultaneously, respectively at 60 ml/min by the double-jet process, with stirring. Immediately thereafter, 5.3 g of potassium bromide was added, and the temperature was elevated to 40° C., to effect the ripening. Eighty-five minutes after the addition of the silver nitrate, again, an aqueous silver nitrate solution (containing 32.0 g of silver nitrate in 100 ml) and an aqueous potassium bromide solution (containing 22.4 g of potassium bromide in 100 ml) were added, over 16 min, with the flow rate accelerated and with the silver electric potential for a saturated calomel electrode kept at −15 mV. Until this, 50% of all of the amount of silver nitrate had been consumed.

Then, an aqueous silver nitrate solution (containing 14.2 g of silver nitrate in 100 ml) and an aqueous potassium iodide solution (containing 1.8 g of potassium iodide in 100 ml) were added, over 4 min by the double-jet process. Until this, 54% of all of the amount of silver nitrate had been consumed.

Thereafter, again, an aqueous silver nitrate solution (containing 32.0 g of silver nitrate in 100 ml) and an aqueous potassium bromide solution (containing 22.4 g of potassium bromide in 100 ml) were added, over 43 min by the double-jet process, with the pAg kept at 9.7. Until this, 212 g of silver nitrate had been consumed.

The resulting emulsion was washed with water at 35° C. by a known flocculation method; then gelatin was added, followed by heating to 40° C., and Compound 2, in an amount of 23 mg, and ExS-3, in an amount of $1.3\times10^{-3}$ mol/mol of Ag, were added. After 10 min, the mixture was heated to 76° C., and sodium thiosulfate, in an amount of $3.5\times10^{-5}$ mol/mol of Ag, potassium thiocyanate, in an amount of $3.5\times10^{-3}$ mol/mol of Ag, and chloroauric acid, in an amount of $1.2\times10^{-5}$ mol/mol of Ag, were added, to carry out ripening, so that the sensitivity would be highest when it was exposed to light for 1/100 sec, and then sodium 3-(5-mercaptotetrazole)-benzenesulfonate, in an amount of $4.0\times10^{-4}$ mol/mol of Ag, was added. The thus obtained emulsion was named Em-1.

Em-1 comprised AgBrI tabular grains (having a silver iodide content of 4.0 mol %) wherein the deviation coefficient of the circle-equivalent diameters of the projected areas (hereinafter referred to as circle-equivalent diameters) was 23%, the circle-equivalent diameter was 0.31 μm, and the average thickness was 0.07 μm.

Preparation of Em-2

Em-2 was prepared in the same manner as in Em-1, except that, instead of the aqueous potassium iodide solution, an aqueous potassium bromide solution was used, and instead of the aqueous potassium bromide solution at the time of growing used thereafter, an aqueous solution of a mixture of potassium iodide and potassium bromide was used. Em-2 comprised AgBrI tabular grains (having a silver iodide content of 4.0 mol %) wherein the deviation coefficient of the circle-equivalent diameters was 21%, the circle-equivalent diameter was 0.31 μm, and the average thickness was 0.07 μm.

Preparation of Em-3

Em-3 was prepared in the same manner as in Em-1, except that, instead of Compound 2, the below-shown compound was added, in an amount of 23 mg. The below-shown compound had a (100) plane ratio of 4.0, measured by the plane selectivity judgment test, and so it was a compound falling outside the scope of the present invention.

Structure:

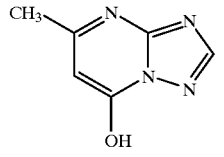

Preparation of Em-4

Emulsion Em-4 was prepared in the same manner as in Em-1, except that Compound 2 was not added.

Preparation of Em-5

Em-5 was prepared in the same manner as in Em-1, except that, instead of ExS-3, ExS-1 was added, in an amount of $1.3\times10^{-3}$ mol/mol of Ag.

Preparation of Em-6

Em-6 was prepared in the same manner as in Em-2, except that, instead of Compound 2, the following compound was added, in an amount of 23 mg. Structure:

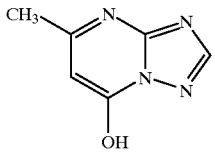

Preparation of Em-7

Em-7 was prepared in the same manner as in Em-2, except that Compound 2 was not added.

Preparation of Em-8

Em-8 was prepared in the same manner as in Em-2, except that, instead of ExS-3, ExS-1 was added, in an amount of $1.3\times10^{-3}$ mol/mol of Ag.

The properties of the emulsions are shown in Table 1.

Dislocation lines of each of Emulsions Em-1 to Em-8 were directly observed under a transmission electron microscope (a JEM-2000 FXII, trade name; manufactured by LEOL Ltd.), with the acceleration voltage being 200 kv and the temperature being −120° C. In the cases of Emulsions Em-1, Em-3, Em-4, and Em-5, dislocation lines were observed at the peripheral parts of the grains, whereas in the cases of Emulsions Em-2, Em-6, Em-7, and Em-8, dislocation lines were not observed.

(2) Preparation of Coated Samples

To each of the emulsions obtained in (1), were added a dodecylbenzenesulfonate, as a coating auxiliary, a p-vinylbenzenesulfonate, as a thickener, a vinylsulfon-series compound, as a hardener, and a polyethylene oxide-series compound, as a photographic property improver, to prepare each emulsion coating solution. Then, each of the coating solutions was coated uniformly on a polyester base coated with an undercoat, and then a surface protective layer mainly made of an aqueous gelatin solution was coated on the coated base, to prepare Coated Samples 101 to 108 having Em-1 to Em-8, respectively. The coated amount of silver of each of Samples 101 to 108 was 4.0 g/m$^2$, the coated amount of the gelatin in the protective layer was 1.3 g/m$^2$, and the coated amount of the gelatin in the emulsion layer was 2.7 g/m$^2$.

To evaluate the thus-obtained coated samples, the following experiment was carried out:

A test piece of each of Coated Samples 101 to 108 was subjected to a wedge exposure for a exposure time of 1/100 sec, with the exposure amount being 10 CMS; it was subjected to development treatment at 20° C. for 4 min, with a processing solution having the below-shown composition; and it was fixed, washed with water, dried, and subjected to sensitometry. Then, in each test piece's sensitometry, the sensitivity was measured, from the reciprocal of the exposure amount giving a density of fog +0.1, to measure the fog.

| Processing solution | |
|---|---|
| 1-Phenyl-3-pyrazolydone | 0.5 g |
| Hydroquinone | 10 g |
| Disodium ethylenediaminetetraacetate | 2 g |
| Potassium sulfite | 60 g |
| Boric acid | 4 g |
| Potassium carbonate | 20 g |
| Sodium bromide | 5 g |
| Diethylene glycol | 20 g |
| pH was adjusted by using sodium hydroxide to pH 10.0 | |
| Water to make | 1 liter |

The thus obtained results (results of property evaluation) with characteristics of each coated sample are shown in Table 1 below.

TABLE 1

| Sample No. | Emulsion | Existence of dislocation lines | Plane selectivity of added compound | Plane selectivity of added dye | Relative sensitivity | Fog | Remarks |
|---|---|---|---|---|---|---|---|
| 101 | Em-1 | ○ | (100) | (111) | 160 | 70 | This invention |
| 102 | Em-2 | X | (100) | (111) | 130 | 70 | This invention |
| 103 | Em-3 | ○ | (111) | (111) | 70 | 120 | Comparative example |
| 104 | Em-4 | ○ | not added | (111) | 110 | 70 | Comparative example |
| 105 | Em-5 | ○ | (100) | (100) | 120 | 70 | This invention |
| 106 | Em-6 | X | (111) | (111) | 60 | 110 | Comparative example |
| 107 | Em-7 | X | not added | (111) | 100 | 100 | Comparative example |
| 108 | Em-8 | X | (100) | (100) | 120 | 70 | This invention |

Note: (1) Sensitivity and Fog were relatively represented assuming that those of Sample 107 were to be 100, respectively. In relative sensitivity, the bigger the value is, the more preferable it is, and in fog, the smaller the value is, the more preferable it is.
(2) Existence of dislocation lines "○": present "X": none As is apparent from the results in Table 1, the emulsions of the present invention are low in fog and high in sensitivity, and thus the effect of the present invention is remarkable.

That is, by comparing Sample 107 with Sample 102, or Sample 104 with Sample 101, it can be seen that the sample to which the compound for use in the present invention was added is high in relative sensitivity and low in fog. In contrast, in the cases wherein compounds falling outside the scope of the present invention were added (Sample 103 and Sample 106), it can be seen that the sensitivity decreases and the fog becomes high.

Further, by comparing Sample 101 with Sample 105, or Sample 102 with Sample 108, it can be seen that when the plane selectivity of the added dye is (111) plane-selective, favorable results are brought about.

Example 2

Preparation of Coated Sample 201

Layers having the below-shown compositions were formed on a cellulose triacetate film support, having a thickness of 127 $\mu$m, that had been provided an undercoat, to prepare a multi-layer color light-sensitive material, which was named Sample 201. Each figure represents the added amount per square meter. In passing, it should be noted that the effect of the added compounds is not limited to the described use.

First Layer (Halation-prevention layer)

| | |
|---|---|
| Black colloidal silver | 0.30 g |
| Gelatin | 2.30 g |
| Ultraviolet ray absorbent U-1 | 0.10 g |
| Ultraviolet ray absorbent U-3 | 0.040 g |
| Ultraviolet ray absorbent U-4 | 0.10 g |
| High-boiling organic solvent Oil-1 | 0.10 g |
| Fine crystal solid dispersion of Dye E-1 | 0.25 g |
| Fine crystal solid dispersion of Dye E-2 | 0.10 g |

Second Layer (Intermediate layer)

| | |
|---|---|
| Gelatin | 0.40 g |
| Compound Cpd-A | 5.0 mg |
| High-boiling organic solvent Oil-3 | 0.10 g |
| Dye D-4 | 10.0 mg |
| Dye D-5 | 4.0 mg |

Third Layer (Intermediate layer)

| | |
|---|---|
| Yellow colloidal silver | silver 0.010 g |
| Gelatin | 0.40 g |

Fourth Layer (Low sensitivity red-sensitive emulsion layer)

One emulsion selected from

| | |
|---|---|
| Emulsions 1 to 8 | silver 0.69 g |
| Gelatin | 0.80 g |
| Coupler C-1 | 0.10 g |
| Coupler C-2 | 0.04 g |
| Coupler C-6 | 0.050 g |
| Compound Cpd-A | 5.0 mg |
| Compound Cpd-E | 0.1 mg |
| High-boiling organic solvent Oil-2 | 0.10 g |

Fifth Layer (Medium sensitivity red-sensitive emulsion layer)

| | |
|---|---|
| Emulsion | silver 0.50 g |
| Gelatin | 0.80 g |
| Coupler C-1 | 0.13 g |
| Coupler C-2 | 0.06 g |
| Coupler C-6 | 0.01 g |
| High-boiling organic solvent Oil-2 | 0.10 g |

Sixth Layer (High sensitivity red-sensitive emulsion layer)

| | |
|---|---|
| Emulsion | silver 0.50 g |
| Gelatin | 1.70 g |
| Coupler C-3 | 0.70 g |
| Coupler C-6 | 0.02 g |
| Additive P-1 | 0.20 g |
| High-boiling organic solvent Oil-2 | 0.04 g |

Seventh Layer (Intermediate layer)

| | |
|---|---|
| Gelatin | 0.60 g |
| Compound Cpd-D | 0.04 g |
| Compound Cpd-G | 0.16 g |
| Fine crystal solid dispersion of Dye E-4 | 0.02 g |

Eighth Layer (Intermediate layer)

| | |
|---|---|
| Gelatin | 1.20 g |
| Compound Cpd-A | 0.10 g |
| Compound Cpd-B | 0.10 g |
| Compound Cpd-C | 0.17 g |
| High-boiling organic solvent Oil-3 | 0.20 g |

Ninth Layer (Low sensitivity green-sensitive emulsion layer)

| | |
|---|---|
| Emulsion | silver 0.95 g |
| Gelatin | 0.50 g |
| Coupler C-7 | 0.03 g |
| Coupler C-8 | 0.09 g |
| Coupler C-10 | 0.04 g |
| Coupler C-11 | 0.04 g |
| Compound Cpd-A | 0.01 g |
| Compound Cpd-E | 0.01 g |
| Compound Cpd-F | 0.3 mg |
| High-boiling organic solvent Oil-2 | 0.10 g |

Tenth Layer (Medium sensitivity green-sensitive emulsion layer)

| | |
|---|---|
| Emulsion | silver 0.50 g |
| Gelatin | 0.50 g |
| Coupler C-4 | 0.12 g |
| Coupler C-10 | 0.06 g |
| Coupler C-11 | 0.06 g |
| Compound Cpd-F | 0.03 g |
| High-boiling organic solvent Oil-2 | 0.01 g |

Eleventh Layer (High sensitivity green-sensitive emulsion layer)

| | |
|---|---|
| Emulsion | silver 0.44 g |
| Gelatin | 0.50 g |
| Coupler C-4 | 0.18 g |
| Coupler C-10 | 0.09 g |
| Coupler C-11 | 0.09 g |
| Compound Cpd-F | 0.080 g |
| High-boiling organic solvent Oil-2 | 0.020 g |

Twelfth Layer (Intermediate layer)

| | |
|---|---|
| Gelatin | 0.30 g |

Thirteenth Layer (Yellow filter layer)

| | |
|---|---|
| Yellow colloidal silver | silver 0.08 g |
| Gelatin | 0.50 g |
| Compound Cpd-B | 0.02 g |
| Compound Cpd-D | 0.03 g |
| Compound Cpd-G | 0.10 g |
| Fine crystal solid dispersion of Dye E-3 | 0.27 g |

Fourteenth Layer (Low sensitivity blue-sensitive emulsion layer)

| | |
|---|---|
| Emulsion | silver 0.43 g |
| Gelatin | 0.80 g |
| Coupler C-5 | 0.30 g |
| Coupler C-6 | 5.0 mg |
| Coupler C-9 | 0.03 g |

Fifteenth Layer (Medium sensitivity blue-sensitive emulsion layer)

| | |
|---|---|
| Emulsion | silver 0.16 g |
| Gelatin | 0.60 g |
| Coupler C-5 | 0.30 g |
| Coupler C-6 | 5.0 mg |
| Coupler C-9 | 0.03 g |

Sixteenth Layer (High sensitivity blue-sensitive emulsion layer)

| | |
|---|---|
| Emulsion | silver 0.47 g |
| Gelatin | 2.60 g |
| Coupler C-5 | 0.10 g |
| Coupler C-6 | 0.12 g |
| Coupler C-9 | 1.00 g |
| High-boiling organic solvent Oil-2 | 0.40 g |

Seventeenth Layer (First protective layer)

| | |
|---|---|
| Gelatin | 1.00 g |
| Ultraviolet ray absorber U-1 | 0.10 g |
| Ultraviolet ray absorber U-2 | 0.03 g |
| Ultraviolet ray absorber U-5 | 0.20 g |
| Dye D-1 | 0.15 g |
| Dye D-2 | 0.050 g |
| Dye D-3 | 0.10 g |
| Dye D-4 | 0.01 g |
| Compound Cpd-H | 0.40 g |
| High-boiling organic solvent Oil-2 | 0.30 g |

Eighteenth Layer (Second protective layer)

| | |
|---|---|
| Colloidal silver | silver 0.10 mg |
| Silver iodobromide emulsion of fine grains (average grain diameter 0.06 μm, silver iodide amount 1 mol %) | silver 0.10 g |
| Gelatin | 0.70 g |
| Ultraviolet ray absorber U-1 | 0.06 g |
| Ultraviolet ray absorber U-2 | 0.02 g |
| Ultraviolet ray absorber U-5 | 0.12 g |
| High-boiling organic solvent Oil-2 | 0.07 g |

Nineteenth Layer (Third protective layer)

| | |
|---|---|
| Gelatin | 1.40 g |
| Poly(methylmethacrylate) (average grain diameter 1.5 μm) | 5.0 mg |
| Copolymer of methyl methacrylate and acrylic acid (4:6) (average grain diameter 1.5 μm) | 0.10 g |
| Silicon oil | 0.030 g |

Silver halide light-sensitive emulsions used are shown in Table 2.

TABLE 2

| Used amount | Emulsion 1), 2) | Coated amount of silver ($g/m^2$) | Average aspect ratio of all grains | Diameter of projected area (circle-equivalent) Average diameter (μm) | Diameter of projected area (circle-equivalent) Deviation coefficient (%) | AgI content Average (mol %) | AgI content Deviation coefficient (%) | Feature of grain |
|---|---|---|---|---|---|---|---|---|
| Medium sensitivity red-sensitive emulsion layer | D1 | 0.50 | 1.0 | 0.43 | 18 | 2.6 | 50 | Tetradeca-hedral grain |
| High sensitivity red-sensitive emulsion layer | E1 | 0.50 | 7.1 | 1.43 | 8 | 1.6 | 20 | Tabular grain |
| Low sensitivity | F1 | 0.24 | 1.0 | 0.18 | 15 | 4.0 | 15 | Cubic grain |

TABLE 2-continued

| | | | | | | | | |
|---|---|---|---|---|---|---|---|---|
| green-sensitive | G1 | 0.41 | 1.0 | 0.24 | 11 | 4.0 | 50 | Cubic grain |
| emulsion layer | H1 | 0.30 | 1.0 | 0.37 | 9 | 3.9 | 20 | Cubic grain |
| Medium sensitivity | I1 | 0.22 | 1.0 | 0.37 | 9 | 3.5 | 20 | Cubic grain |
| green-sensitive emulsion layer | J1 | 0.28 | 1.0 | 0.52 | 9 | 3.2 | 25 | Cubic grain |
| High sensitivity green-sensitive emulsion layer | K1 | 0.44 | 8.0 | 1.20 | 15 | 1.7 | 30 | Tabular grain |
| Low sensitivity blue-sensitive | L1 | 0.17 | 3.0 | 0.49 | 12 | 4.7 | 15 | Tabular grain |
| emulsion layer | M1 | 0.04 | 4.5 | 0.65 | 8 | 4.7 | 20 | Tabular grain |
| | N1 | 0.22 | 7.5 | 1.10 | 10 | 4.7 | 35 | Tabular grain |
| Medium sensitivity blue-sensitive | O1 | 0.08 | 4.1 | 0.93 | 18 | 2.0 | 35 | Tabular grain |
| emulsion layer | P1 | 0.08 | 8.0 | 1.20 | 15 | 1.7 | 30 | Tabular grain |
| High sensitivity blue-sensitive | Q1 | 0.21 | 3.0 | 1.52 | 25 | 1.2 | 65 | Tabular grain |
| emulsion layer | R1 | 0.26 | 10.0 | 2.88 | 13 | 1.2 | 20 | Tabular grain |

| | Emulsion | Ratio of (111) plane | Kind and added amount of added sensitizing dye (mg/Ag mol) | | | | | | | |
|---|---|---|---|---|---|---|---|---|---|---|
| Used amount | 1), 2) | on surface 3) | Kind | Amount | Kind | Amount | Kind | Amount | Kind | Amount |
| Medium sensitivity red-sensitive emulsion layer | D1 | 50 | S-1 | 267 | S-4 | 105 | — | — | — | — |
| High sensitivity red-sensitive emulsion layer | E1 | 99 | S-1 | 66 | S-2 | 240 | S-3 | 22 | S-4 | 1 |
| Low sensitivity | F1 | 2 | S-7 | 544 | S-9 | 128 | — | — | — | — |
| green-sensitive | G1 | 1 | S-7 | 422 | S-9 | 122 | — | — | — | — |
| emulsion layer | H1 | 0 | S-7 | 479 | S-9 | 86 | — | — | — | — |
| Medium sensitivity | I1 | 0 | S-5 | 479 | S-6 | 86 | — | — | — | — |
| green-sensitive emulsion layer | J1 | 5 | S-5 | 273 | S-8 | 55 | S-10 | 28 | — | — |
| High sensitivity green-sensitive emulsion layer | K1 | 99 | S-7 | 213 | S-9 | 71 | S-10 | 33 | — | — |
| Low sensitivity | L1 | 55 | S-12 | 185 | S-11 | 42 | S-13 | 42 | — | — |
| blue-sensitive | M1 | 50 | S-12 | 170 | S-11 | 38 | S-13 | 38 | — | — |
| emulsion layer | N1 | 45 | S-12 | 119 | S-11 | 27 | S-13 | 27 | — | — |
| Medium sensitivity | O1 | 98 | S-12 | 260 | S-11 | 25 | S-13 | 24 | — | — |
| blue-sensitive emulsion layer | P1 | 99 | S-12 | 207 | S-11 | 20 | S-13 | 20 | — | — |
| High sensitivity | Q1 | 99 | S-12 | 187 | S-11 | 18 | S-13 | 18 | — | — |
| blue-sensitive emulsion layer | R1 | 99 | S-12 | 173 | S-11 | 12 | S-13 | 11 | — | — |

Note 1) Each of emulsions described above was a core/shell type emulsion having a high-iodine phase in the emulsion grain, and each emulsion was subjected to gold/sulfur/selenium sensitization or gold/sulfur sensitization.
Note 2) To each emulsion described above, compounds F-1, F-3, F-7, F-8, F-9, and F-10 were added appropriately.
Note 3) Ratio of (111) plane on surface was determined by a method with Kubelka-Munk.

Further, to all emulsion layers, in addition to the above-described components, additives F-1 to F-8, surface active agents W-1 to W-6, and gelatin hardener H-1 were added.

Further, as antifungal and antibacterial agents, phenol, 1,2-benzisothiazoline-3-one, 2-phenoxyethanol, phenetylalcohol, and p-benzoic acid butyl ester were added.

The swelling ratio (ratio of swelled film thickness and dry film thickness) of this sample measured was 1.8.

C-1

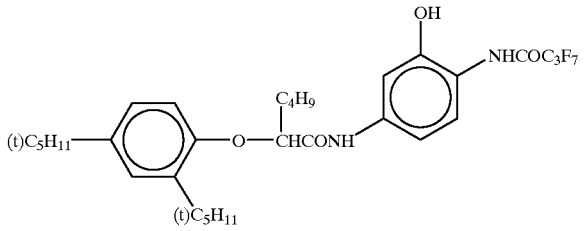

-continued
C-2
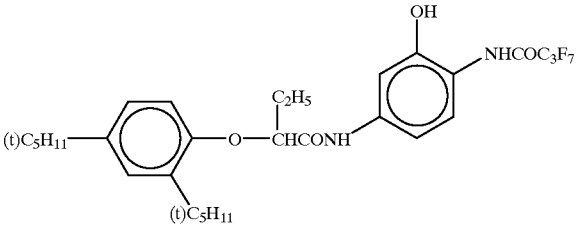
C-3
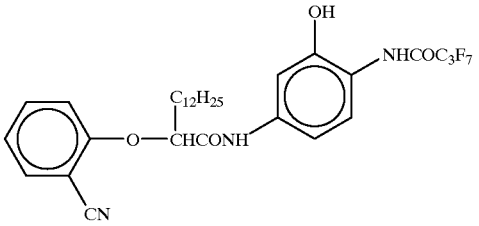
C-4
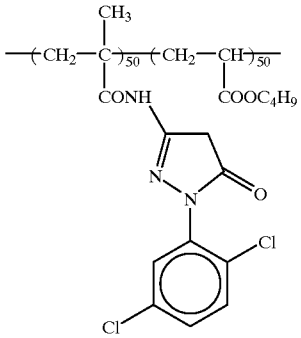
Figures indicates amounts by % by weight
Average molecular weight ca. 25,000
C-5
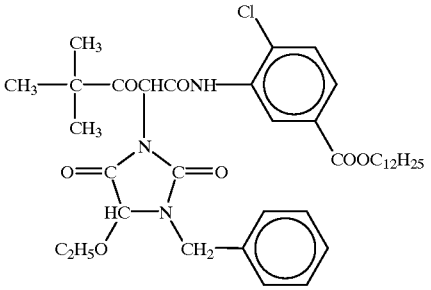
C-6
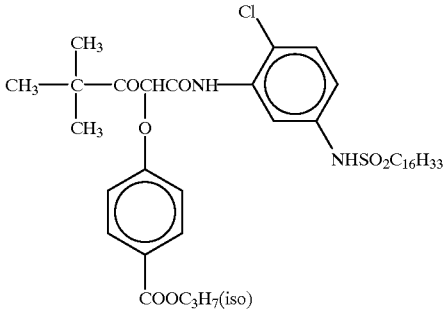
C-7
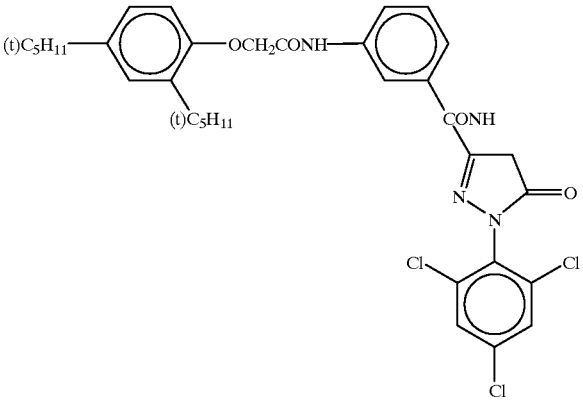

-continued
C-8
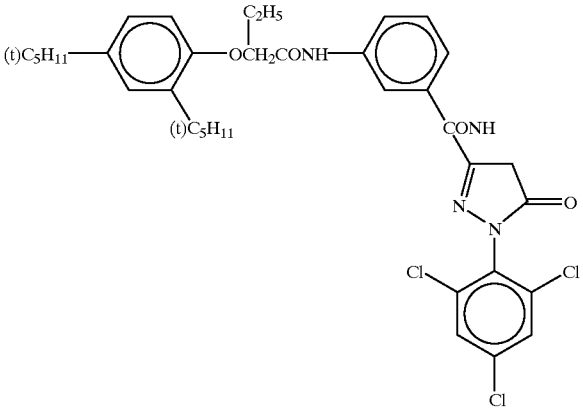
C-9
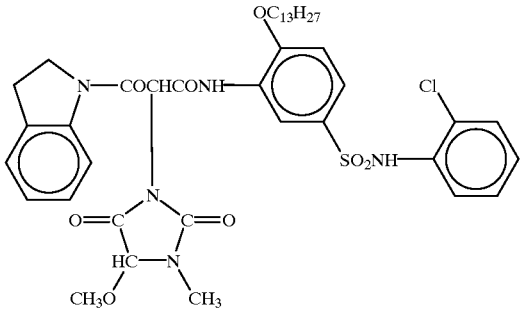
Oil-1
Dibutyl phthalate
Oil-2
Tricresyl phosphate
Oil-3
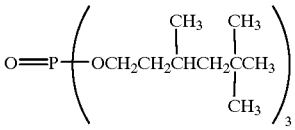
C-10
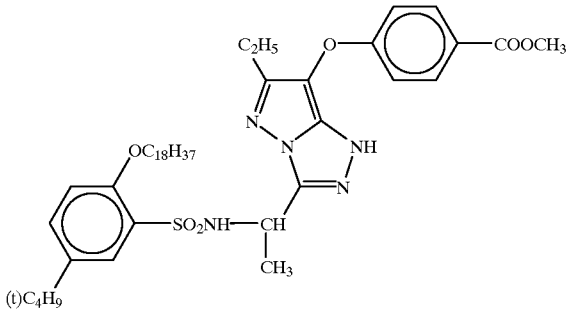

-continued
C-11
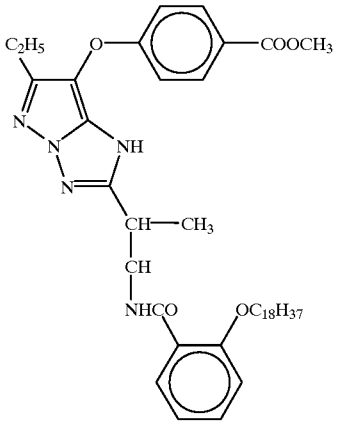
U-1
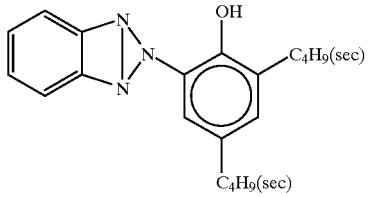
U-2
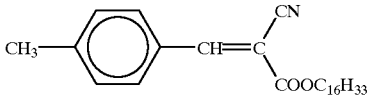
U-3
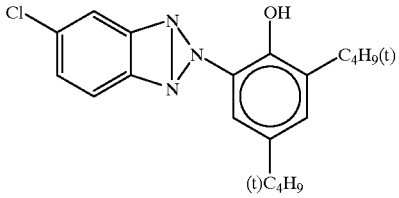
U-4
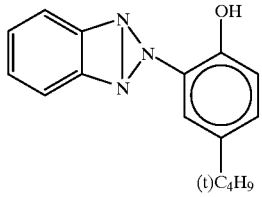
U-5
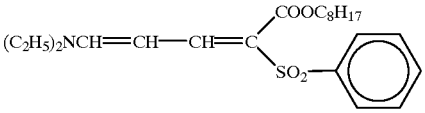
Cpd-A
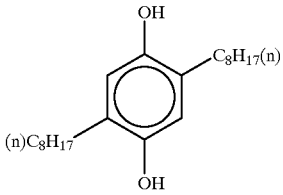
Cpd-B
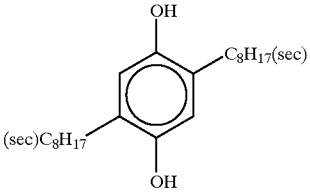
Cpd-C
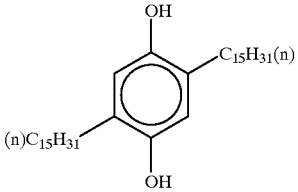
Cpd-D
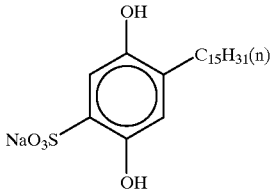
Cpd-E
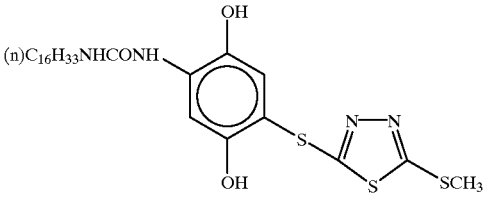

-continued
Cpd-F
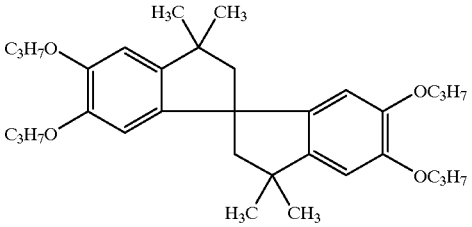
Cpd-G
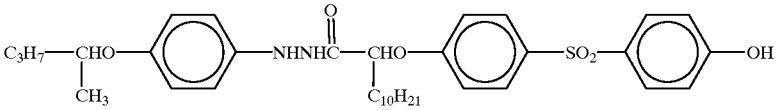
Cpd-H
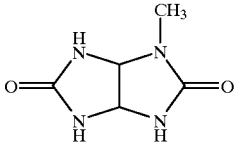
D-1
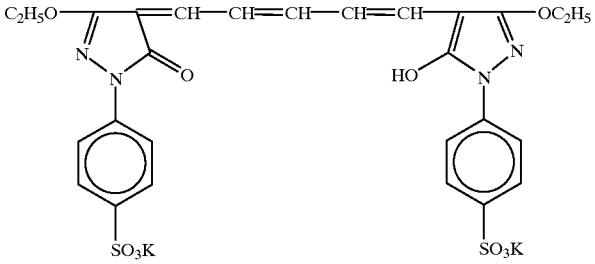
D-2
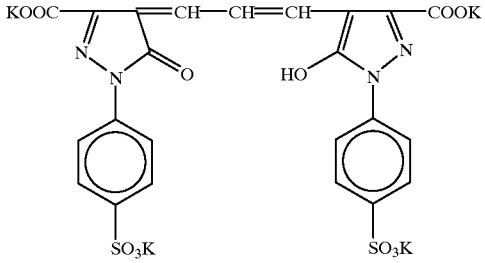
D-3
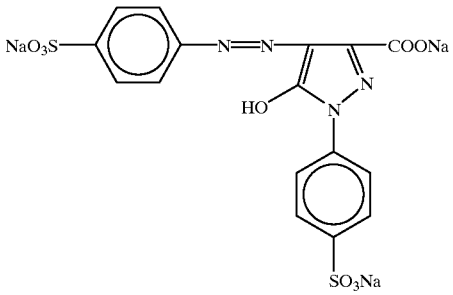
D-4
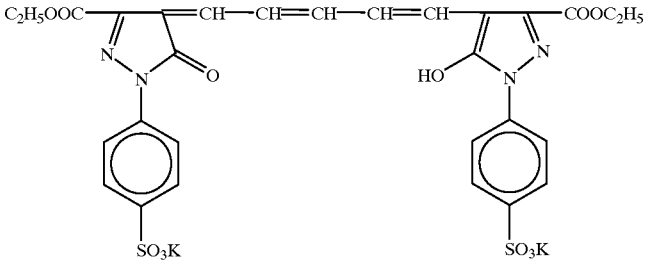

-continued
D-5
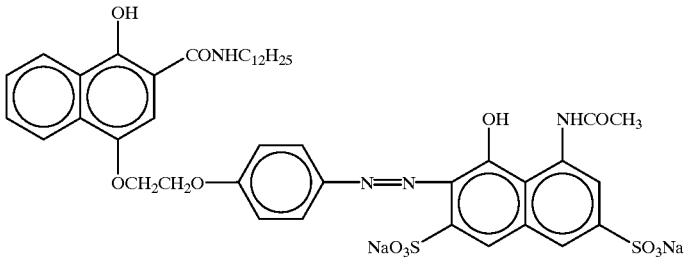
E-1
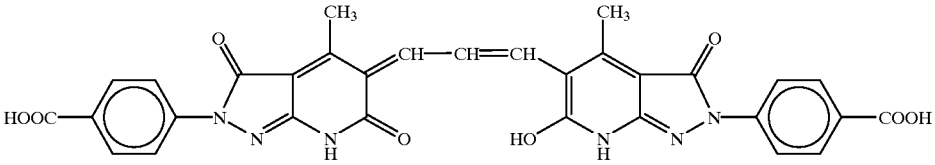
E-2
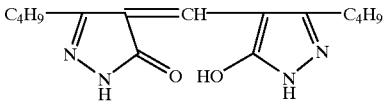
E-3
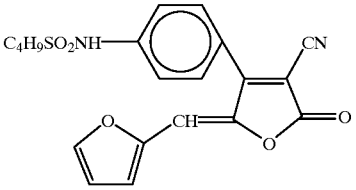
E-4
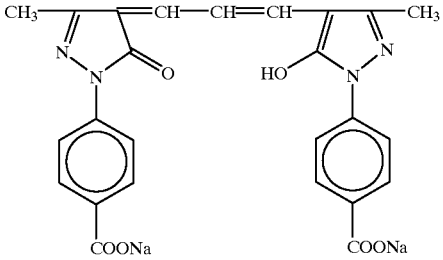
W-2
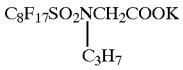
W-3
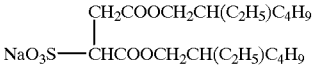
W-4
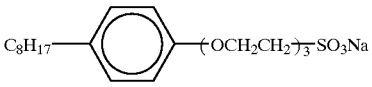
W-5
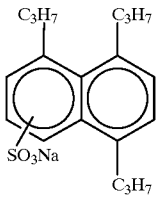
W-6
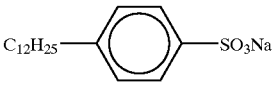
P-1
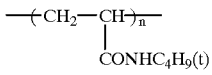
H-1
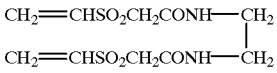

-continued
F-1
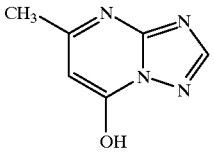
F-2
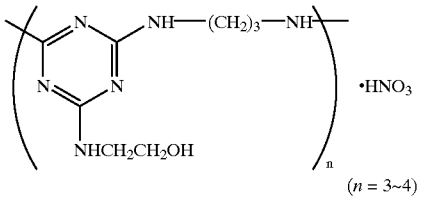
F-3
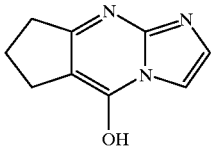
F-4
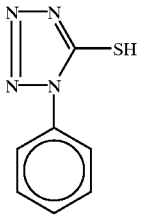
F-5
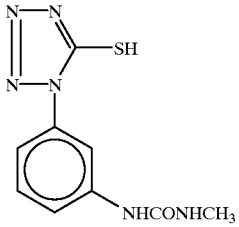
F-6
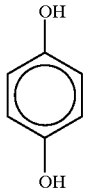
F-7
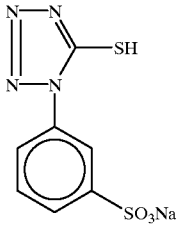
F-8
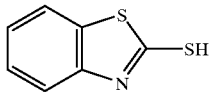
S-1
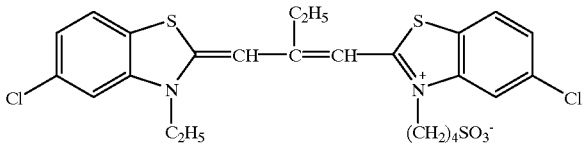
S-2
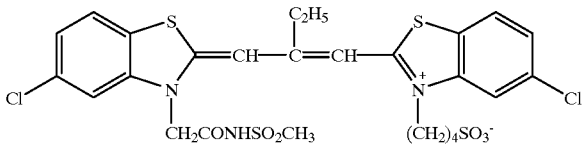
S-3
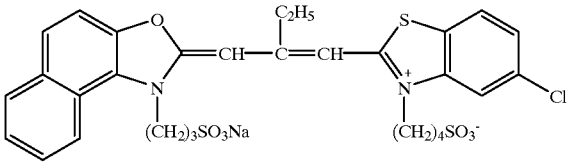

-continued
S-4
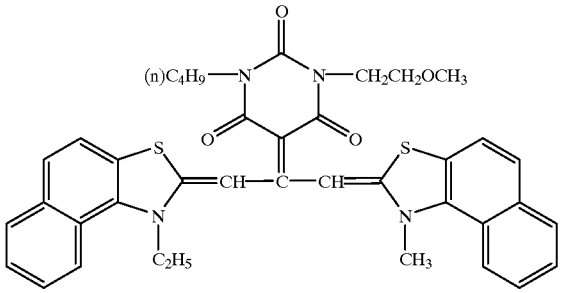
S-5
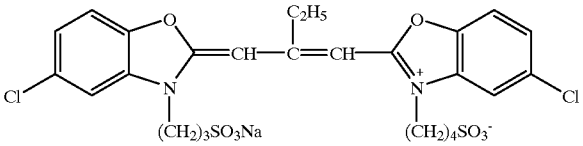
S-6
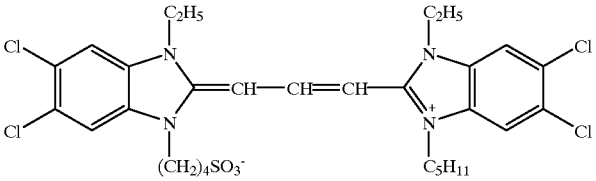
S-7
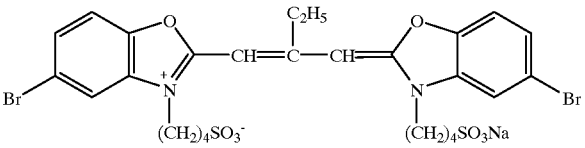
S-8
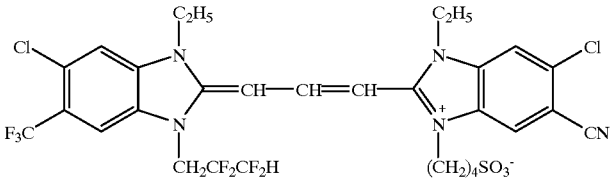
S-9
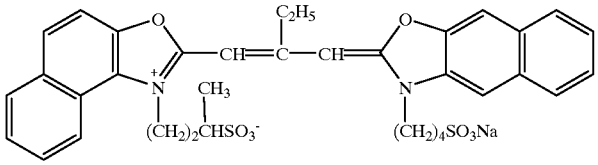
S-10
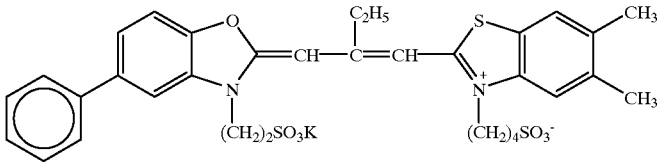
S-11
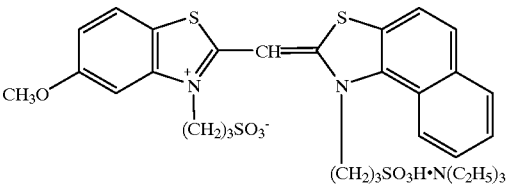
S-12
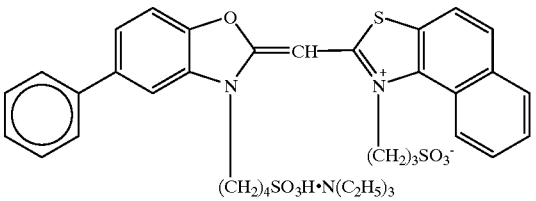

-continued

S-13

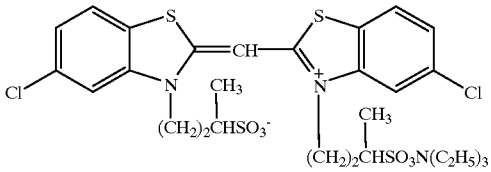

ExS-1

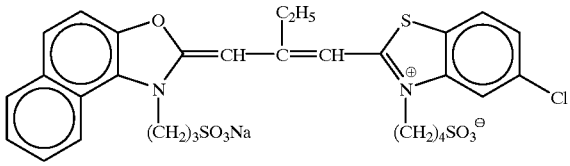

ExS-2

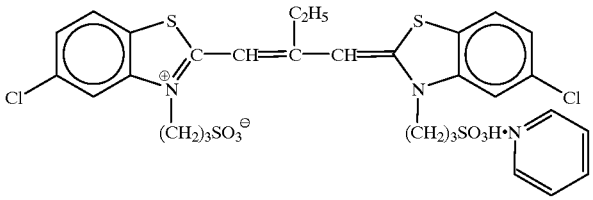

(2) Preparation of Samples 201 to 210

Samples 201 to 208 were prepared in the same manner as Sample 201, except that, instead of the emulsion added into the fourth layer of Sample 201, one of Emulsions 1 to 8 prepared in Example 1 was used. Sample 209 was prepared in the same manner as Sample 204, except that, immediately before the application of the fourth layer, Exemplified Compound 2 was added, in an amount of 23 mg per mol of silver. Sample 210 was prepared in the same manner as Sample 207, except that, immediately before the application of the fourth layer, Exemplified Compound 2 was added, in an amount of 23 mg per mol of silver.

(3) Evaluation of the Samples a. Sensitivity

Each of the thus prepared Samples 201 to 210 was subjected to a wedge exposure, using a white light source of 2,000 lux and a color temperature of 4800 K for 1/100 sec, and was subjected to development processing as shown below, and the sensitivity was measured, from the relative value of the reciprocal of the relative exposure amount giving a cyan density of 0.5.

b. RMS granularity

The RMS granularity with the magenta density of 0.5 was measured. The RMS granularity of Sample 104 was assigned to be 100, and the relative values to it were shown. The smaller the value is, the more excellent the granularity is.

(Processing steps and processing solutions of standard development process)

| Process | Time | Temperature | Tank volume | Replenisher amount |
|---|---|---|---|---|
| 1st development | 6 min | 38° C. | 12 liter | 2,200 ml/m$^2$ |
| Water-washing | 2 min | 38° C. | 4 liter | 7,500 ml/m$^2$ |
| Reversal | 2 min | 38° C. | 4 liter | 1,100 ml/m$^2$ |
| Color development | 6 min | 38° C. | 12 liter | 2,200 ml/m$^2$ |
| Pre-bleaching | 2 min | 38° C. | 4 liter | 1,100 ml/m$^2$ |

-continued

| Process | Time | Temperature | Tank volume | Replenisher amount |
|---|---|---|---|---|
| Bleaching | 6 min | 38° C. | 12 liter | 220 ml/m$^2$ |
| Fixing | 4 min | 38° C. | 8 liter | 1,100 ml/m$^2$ |
| Water-washing | 4 min | 38° C. | 8 liter | 7,500 ml/m$^2$ |
| Final-rinsing | 1 min | 25° C. | 2 liter | 1,100 ml/m$^2$ |

Compositions of each processing solution used were as follows:

| First developer | Tank solution | Replenisher |
|---|---|---|
| Pentasodium nitrilo-N,N,N-trimethylenephosphonate | 1.5 g | 1.5 g |
| Pentasodium diethylenetriamine pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH (pH was adjusted by using sulfuric acid or potassium hydroxide) | 9.60 | 9.60 |

| Reversal solution (Both tank solution and replenisher) | |
|---|---|
| Pentasodium nitrilo-N,N,N-trimethylenephosphonate | 3.0 g |

-continued

| | |
|---|---|
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 6.00 |
| (pH was adjusted by using acetic acid or sodium hydroxide) | |

| | Tank solution | Reple-nisher |
|---|---|---|
| Color developer | | |
| Pentasodium nitrilo-N,N,N-trimethylenephosphonate | 2.0 g | 2.0 g |
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate mono hydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using sulfuric acid or potassium hydroxide) | | |
| Pre-bleaching solution | | |
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde.sodium bisulfite adduct | 30 g | 35 g |
| Water to make | 1,000 ml | 1,000 ml |
| pH | 6.30 | 6.10 |

-continued

| | | |
|---|---|---|
| (pH was adjusted by using acetic acid or sodium hydroxide) | | |
| Bleaching solution | | |
| Disodium ethylenediaminetetraacetate dihydrate | 2.0 g | 4.0 g |
| Iron (III) ammonium ethylenediamine-tetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using nitric acid or sodium hydroxide) | | |

| Fixing solution (Both tank solution and replenisher) | |
|---|---|
| Ammonium thiosulfate | 80.0 g |
| Sodium sulfite | 5.0 g |
| Sodium bisulfite | 5.0 g |
| Water to make | 1,000 ml |
| pH | 6.60 |
| (pH was adjusted by using acetic acid or aqueous ammonia) | |

| Final-rising solution | Tank solution | Reple-nisher |
|---|---|---|
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 7.0 | |

The results (evaluation of properties), together with the characteristics of the coated samples, are shown in Table 3.

TABLE 3

| Sample No. | Emulsion in 4th layer | Timing of addition of compounds | Existence of dislocation lines | Plane selectivity of added compound | Plane selectivity of added dye | Relative sensitivity | RMS granularity | Remarks |
|---|---|---|---|---|---|---|---|---|
| 201 | Em-1 | at preparation of emulsion | ○ | (100) | (111) | 160 | 70 | This invention |
| 202 | Em-2 | at preparation of emulsion | X | (100) | (111) | 130 | 70 | This invention |
| 203 | Em-3 | at preparation of emulsion | ○ | (111) | (111) | 70 | 120 | Comparative example |
| 204 | Em-4 | not added | ○ | not added | (111) | 110 | 70 | Comparative example |
| 205 | Em-5 | at preparation of emulsion | ○ | (100) | (100) | 120 | 70 | This invention |
| 206 | Em-6 | at preparation of emulsion | X | (111) | (111) | 60 | 110 | Comparative example |
| 207 | Em-7 | not added | X | not added | (111) | 100 | 100 | Comparative example |

TABLE 3-continued

| Sample No. | Emulsion in 4th layer | Timing of addition of compounds | Existence of dislocation lines | Plane selectivity of added compound | Plane selectivity of added dye | Relative sensitivity | RMS granularity | Remarks |
|---|---|---|---|---|---|---|---|---|
| 208 | Em-8 | at preparation of emulsion | X | (100) | (100) | 120 | 70 | This invention |
| 209 | Em-4 | at application of emulsion | ○ | (100) | (111) | 150 | 70 | This invention |
| 210 | Em-7 | at application of emulsion | X | (100) | (111) | 130 | 70 | This invention |

Note: (1) Sensitivity and RMS granularity were represented in a relative value, assuming those of Sample 207 to be 100, respectively. The bigger the value for sensitivity is, the more preferable it is, and the smaller the value for RMS granularity is, the more preferable it is.
(2) Existence of dislocation lines "○": present "X": none As is apparent from the results in Table 3, the samples containing the emulsions of the present invention are high in sensitivity and excellent in granularity (graininess).

That is, by comparing Sample 207 with Sample 202, or Sample 204 with Sample 210, it can be seen that the sample to which the compound for use in the present invention is added is high in relative sensitivity and excellent in graininess. In contrast, in the cases wherein compounds falling outside the scope of the present invention are added (Samples 203 and 206), it can been seen that the sensitivity is rather decreased and the graininess is deteriorated.

Further, by comparing Sample 201 with Sample 205, or Sample 202 with Sample 208, it can be seen that when the plane selectivity of the added dye is (111) plane-selective, more preferable results are brought about.

Further, by comparing Sample 201 with Sample 209, or Sample 202 with Sample 210, it can be seen that when the compound is added not at the time of the application of the emulsion but at the time of the preparation of the emulsion, preferable results are brought about.

The similar investigation was carried out with respect to the green-sensitive emulsion and the blue-sensitive emulsion, and it was found that in both systems the emulsions of the present invention were also high in sensitivity and excellent in graininess.

Example 3

In this Example 3, use was made of Exemplified Compounds 1, 2, 3, 8, 17, and 29, as respective (100) plane-selective compounds. It was of course confirmed by the above-described plane selectivity judgment method that these compounds were (100) plane-selective.

Further, with respect to the prepared emulsions shown below, the (100) plane ratios of the side planes were measured by the above method.

(1) Preparation of Emulsions

Preparation of Emulsion Em-11

A 0.5 M silver nitrate solution and a 0.5 M potassium bromide solution, in respective amounts of 41 ml, were added, over 40 sec by the double-jet process, to 0.75 liters of a 0.8% solution of a low-molecular-weight gelatin (molecular weight: 10,000) containing 0.025 mol of potassium bromide, with stirring, during which the gelatin solution was kept at 40° C. Thus, the formation of nuclei was carried out. The pH of the gelatin solution in the formation of nuclei was 5.0.

After the formation of nuclei, the electric potential of the pBr was adjusted to 2.05 with KBr, and thereafter the temperature was elevated to 75° C. Then, after 220 ml of a 10% deionized alkali-processed bone gelatin solution was added, the emulsion was ripened for 10 min.

Thereafter, 150 g of silver nitrate, potassium iodide, and potassium bromide solutions was added, over 60 min at an accelerated flow rate by the controlled double-jet process, with the flow rate at the end of the addition being 19 times as high as the flow rate of the start of the addition, and with the electric potential kept at 0 mV, thereby growing grains. After the completion of addition and growing, the temperature was dropped to 50° C., the pBr was adjusted to 1.5 with potassium bromide, and then 215 ml of a 1% potassium bromide solution was added. Thereafter, 327 ml of a 0.5 M silver nitrate solution and a 0.5 M potassium bromide solution were added, over 20 min by the controlled double-jet process, with the electric potential being kept at 0 mV, to form shells. The emulsion was washed with water, at 35° C. by a known flocculation method, and after gelatin was added, followed by heating to 60° C., Sensitizing Dyes S-2, S-3, and S-4 were added, in optimum amounts. After 20 min, the emulsion was chemically sensitized, optimally, with sodium thiosulfate, sodium thiocyanate, and chloroauric acid. Thereafter, Compound F-3 was added, to prepare Emulsion Em-11 containing tabular AgBrI grains (AgI=1.7 mol %) wherein the deviation coefficient of the circle-equivalent diameters of the projected areas (hereinafter referred to as circle-equivalent diameters) was 15%, the circle-equivalent diameter was 1.42 μm, and the average thickness was 0.12 μm.

Preparation of Emulsion Em-12

Emulsion Em-12 was prepared in the same manner as Emulsion Em-11, except that, after the formation of nuclei and ripening, but before the addition for growth, 2 mg of thiourea dioxide was added, and after the addition for growth, but immediately before the adjustment of the pBr with the aqueous KBr solution, 44 mg of sodium ethylthiosulfonate was added.

Preparation of Emulsion Em-13

Emulsion Em-13 of the present invention was prepared in the same manner as Emulsion Em-12, except that, after washing with water, gelatin was added, followed by heating to 60° C., and then 31 mg of Compound 2 was added.

Preparation of Emulsion Em-14

Emulsion Em-14 of the present invention was prepared in the same manner as Emulsion Em-12, except that, after washing with water, gelatin was added, followed by heating to 60° C., and then 28 mg of Compound 3 was added.

Preparation of Emulsion Em-15

Emulsion Em-15 of the present invention was prepared in the same manner as Emulsion Em-12, except that, after washing with water, gelatin was added, followed by heating to 60° C., and then 34 mg of Compound 8 was added.

Preparation of Emulsion Em-16

Emulsion Em-16 was prepared in the same manner as Emulsion Em-12, except that, 18 min after the addition of Sensitizing dyes S-2, S-3, and S-4, 34 mg of Compound 17 was added.

Preparation of Emulsion Em-17

Emulsion Em-17 was prepared in the same manner as Emulsion Em-12, except that, 18 min after the addition of Sensitizing dyes S-2, S-3, and S-4, 28 mg of Compound 29 was added.

Preparation of Emulsion Em-18

Emulsion Em-18 was prepared in the same manner as Emulsion Em-12, except that, 18 min after the addition of Sensitizing dyes S-2, S-3, and S-4, 28 mg of Compound 1 was added.

Emulsion Em-23 was prepared in the same manner as Emulsion Em-19, except that, 18 min after the addition of Sensitizing dyes S-2, S-3, and S-4, 34 mg of Compound 17 was added.

Preparation of Emulsion Em-24

Emulsion Em-24 was prepared in the same manner as Emulsion Em-19, except that, 18 min after the addition of Sensitizing dyes S-2, S-3, and S-4, 28 mg of Compound 29 was added.

Preparation of Emulsion Em-25

Emulsion Em-25 was prepared in the same manner as Emulsion Em-19, except that, 18 min after the addition of Sensitizing dyes S-2, S-3, and S-4, 28 mg of Compound 1 was added.

Characteristics of each emulsion are shown in Table 4.

TABLE 4

| Emulsion | Circle-equivalent diameters/ μm | Aspect ratio | (100) plane ratio of side plane (%) | Reduction sensitization | Average number of dislocation lines in 300 grains | (100) plane-selective compound Kind | Time of addition |
|---|---|---|---|---|---|---|---|
| Em-11 | 1.42 | 8.9 | 38 | — | 0 | — | — |
| Em-12 | 1.42 | 9.0 | 37 | ○ | 0 | — | — |
| Em-13 | 1.42 | 9.0 | 37 | ○ | 0 | 2 | at the dispersion |
| Em-14 | 1.42 | 9.2 | 38 | ○ | 0 | 3 | at the dispersion |
| Em-15 | 1.42 | 9.1 | 37 | ○ | 0 | 8 | at the dispersion |
| Em-16 | 1.42 | 9.1 | 37 | ○ | 0 | 17 | at the post-ripening after the addition of dyes |
| Em-17 | 1.42 | 8.9 | 38 | ○ | 0 | 29 | at the post-ripening after the addition of dyes |
| Em-18 | 1.42 | 8.8 | 39 | ○ | 0 | 1 | at the post-ripening after the addition of dyes |
| Em-19 | 1.20 | 7.1 | 46 | ○ | 11 | — | — |
| Em-20 | 1.20 | 7.2 | 48 | ○ | 10 | 2 | at the dispersion |
| Em-21 | 1.20 | 7.2 | 45 | ○ | 12 | 3 | at the dispersion |
| Em-22 | 1.20 | 7.1 | 47 | ○ | 12 | 8 | at the dispersion |
| Em-23 | 1.20 | 7 | 47 | ○ | 10 | 17 | at the post-ripening before the addition of dyes |
| Em-24 | 1.20 | 7.1 | 47 | ○ | 11 | 29 | at the post-ripening before the addition of dyes |
| Em-25 | 1.20 | 7.2 | 48 | ○ | 10 | 1 | at the post-ripening before the addition of dyes |

"—": none

Preparation of Emulsion Em-19

Emulsion Em-19 was prepared in the same manner as Emulsion Em-12, except that, instead of the 215 ml of a 1% potassium bromide solution, 300 ml of a 1% potassium iodide solution was added.

Preparation of Emulsion Em-20

Emulsion Em-20 was prepared in the same manner as Emulsion Em-13, except that, instead of the 215 ml of a 1% potassium bromide solution, 300 ml of a 1% potassium iodide solution was added.

Preparation of Emulsion Em-21

Emulsion Em-21 of the present invention was prepared in the same manner as Emulsion Em-19, except that, after washing with water, gelatin was added, followed by heating to 60° C., and then 28 mg of Compound 3 was added.

Preparation of Emulsion Em-22

Emulsion Em-22 of the present invention was prepared in the same manner as Emulsion Em-19, except that, after washing with water, gelatin was added, followed by heating to 60° C., and then 34 mg of Compound 8 was added.

Preparation of Emulsion Em-23

Dislocation lines of each of Emulsions Em-11 to Em-25 were directly observed under a transmission electron microscope (JEM-2000 FXII, trade name; manufactured by LEOL Ltd.) with the acceleration voltage being 200 kv and the temperature being −120° C. In the cases of Emulsions Em-19 to Em-25, dislocation lines were observed at the peripheral parts of the grains, whereas in the cases of Emulsions Em-11 to Em-18, dislocation lines were not observed.

(2) Preparation of Coated Sample 301

Layers having the below-shown compositions were formed on a cellulose triacetate film support, having a thickness of 127 μm, that had been provided an undercoat, to prepare a multi-layer color light-sensitive material, which was named Sample 301. Each figure denotes the added amount per square meter. In passing, the effect of the added compounds is not limited to the described use.

First Layer (Halation-prevention layer)

| | |
|---|---|
| Black colloidal silver | 0.30 g |
| Gelatin | 2.30 g |
| Ultraviolet ray absorbent U-1 | 0.10 g |
| Ultraviolet ray absorbent U-3 | 0.040 g |
| Ultraviolet ray absorbent U-4 | 0.10 g |
| High-boiling organic solvent Oil-1 | 0.10 g |
| Fine crystal solid dispersion of Dye E-1 | 0.25 g |
| Fine crystal solid dispersion of Dye E-2 | 0.10 g |

Second Layer (Intermediate layer)

| | |
|---|---|
| Gelatin | 0.40 g |
| Compound Cpd-A | 5.0 mg |
| High-boiling organic solvent Oil-3 | 0.10 g |
| Dye D-4 | 10.0 mg |
| Dye D-5 | 4.0 mg |

Third Layer (Intermediate layer)

| | |
|---|---|
| Yellow colloidal silver | silver 0.010 g |
| Gelatin | 0.40 g |

Fourth Layer (Low sensitivity red-sensitive emulsion layer)

| | |
|---|---|
| Emulsion | silver 0.69 g |
| Gelatin | 0.80 g |
| Coupler C-1 | 0.10 g |
| Coupler C-2 | 0.04 g |
| Coupler C-6 | 0.050 g |
| Compound Cpd-A | 5.0 mg |
| Compound Cpd-E | 0.1 mg |
| High-boiling organic solvent Oil-2 | 0.10 g |

Fifth Layer (Medium sensitivity red-sensitive emulsion layer)

| | |
|---|---|
| Emulsion | silver 0.50 g |
| Gelatin | 0.80 g |
| Coupler C-1 | 0.13 g |
| Coupler C-2 | 0.06 g |
| Coupler C-6 | 0.01 g |
| High-boiling organic solvent Oil-2 | 0.10 g |

Sixth Layer (High sensitivity red-sensitive emulsion layer)

| | |
|---|---|
| Emulsion | silver 0.50 g |
| Gelatin | 1.70 g |
| Coupler C-3 | 0.70 g |
| Coupler C-6 | 0.02 g |
| Additive P-1 | 0.20 g |
| High-boiling organic solvent Oil-2 | 0.04 g |

Seventh Layer (Intermediate layer)

| | |
|---|---|
| Gelatin | 0.60 g |
| Compound Cpd-D | 0.04 g |

-continued

| | |
|---|---|
| Compound Cpd-G | 0.16 g |
| Fine crystal solid dispersion of Dye E-4 | 0.02 g |

Eighth Layer (Intermediate layer)

| | |
|---|---|
| Gelatin | 1.20 g |
| Compound Cpd-A | 0.10 g |
| Compound Cpd-B | 0.10 g |
| Compound Cpd-C | 0.17 g |
| High-boiling organic solvent Oil-3 | 0.20 g |

Ninth Layer (Low sensitivity green-sensitive emulsion layer)

| | |
|---|---|
| Emulsion | silver 0.95 g |
| Gelatin | 0.50 g |
| Coupler C-7 | 0.03 g |
| Coupler C-8 | 0.09 g |
| Coupler C-10 | 0.04 g |
| Coupler C-11 | 0.04 g |
| Compound Cpd-A | 0.01 g |
| Compound Cpd-E | 0.01 g |
| Compound Cpd-F | 0.3 mg |
| High-boiling organic solvent Oil-2 | 0.10 g |

Tenth Layer (Medium sensitivity green-sensitive emulsion layer)

| | |
|---|---|
| Emulsion | silver 0.50 g |
| Gelatin | 0.50 g |
| Coupler C-4 | 0.12 g |
| Coupler C-10 | 0.06 g |
| Coupler C-11 | 0.06 g |
| Compound Cpd-F | 0.03 g |
| High-boiling organic solvent Oil-2 | 0.01 g |

Eleventh Layer (High sensitivity green-sensitive emulsion layer)

| | |
|---|---|
| Emulsion | silver 0.44 g |
| Gelatin | 0.50 g |
| Coupler C-4 | 0.18 g |
| Coupler C-10 | 0.09 g |
| Coupler C-11 | 0.09 g |
| Compound Cpd-F | 0.080 g |
| High-boiling organic solvent Oil-2 | 0.020 g |

Twelfth Layer (Intermediate layer)

| | |
|---|---|
| Gelatin | 0.30 g |

Thirteenth Layer (Yellow filter layer)

| | |
|---|---|
| Yellow colloidal silver | silver 0.08 g |
| Gelatin | 0.50 g |
| Compound Cpd-B | 0.02 g |
| Compound Cpd-D | 0.03 g |

-continued

| | |
|---|---|
| Compound Cpd-G | 0.10 g |
| Fine crystal solid dispersion of Dye E-3 | 0.27 g |

Fourteenth Layer (Low sensitivity blue-sensitive emulsion layer)

| | |
|---|---|
| Emulsion | silver 0.43 g |
| Gelatin | 0.80 g |
| Coupler C-5 | 0.30 g |
| Coupler C-6 | 5.0 mg |
| Coupler C-9 | 0.03 g |

Fifteenth Layer (Medium sensitivity blue-sensitive emulsion layer)

| | |
|---|---|
| Emulsion | silver 0.16 g |
| Gelatin | 0.60 g |
| Coupler C-5 | 0.30 g |
| Coupler C-6 | 5.0 mg |
| Coupler C-9 | 0.03 g |

Sixteenth Layer (High sensitivity blue-sensitive emulsion layer)

| | |
|---|---|
| Emulsion | silver 0.47 g |
| Gelatin | 2.60 g |
| Coupler C-5 | 0.10 g |
| Coupler C-6 | 0.12 g |
| Coupler C-9 | 1.00 g |
| High-boiling organic solvent Oil-2 | 0.40 g |

Seventeenth Layer (First protective layer)

| | |
|---|---|
| Gelatin | 1.00 g |
| Ultraviolet ray absorber U-1 | 0.10 g |
| Ultraviolet ray absorber U-2 | 0.03 g |
| Ultraviolet ray absorber U-5 | 0.20 g |
| Dye D-1 | 0.15 g |
| Dye D-2 | 0.050 g |
| Dye D-3 | 0.10 g |
| Dye D-4 | 0.01 g |
| Compound Cpd-H | 0.40 g |
| High-boiling organic solvent Oil-2 | 0.30 g |

Eighteenth Layer (Second protective layer)

| | |
|---|---|
| Colloidal silver | silver 0.10 mg |
| Silver iodobromide emulsion of fine grains (average grain diameter 0.06 μm, silver iodide content of 1 mol %) | silver 0.10 g |
| Gelatin | 0.70 g |
| Ultraviolet ray absorber U-1 | 0.06 g |
| Ultraviolet ray absorber U-2 | 0.02 g |
| Ultraviolet ray absorber U-5 | 0.12 g |
| High-boiling organic solvent Oil-2 | 0.07 g |

Nineteenth Layer (Third protective layer)

| | |
|---|---|
| Gelatin | 1.40 g |
| Poly(methyl methacrylate) (average grain diameter 1.5 μm) | 5.0 mg |
| Copolymer of methyl methacrylate and acrylic acid (4:6) (average grain diameter 1.5 μm) | 0.10 g |
| Silicon oil | 0.030 g |

Silver halide light-sensitive emulsions used are shown in Table 5.

TABLE 5

| Used amount | Emulsion 1), 2) | Coated amount of silver ($g/m^2$) | Average aspect ratio of all grains | Diameter of projected area (circle-equivalent) Average diameter (μm) | Diameter of projected area (circle-equivalent) Deviation coefficient (%) | AgI content Average (mol %) | AgI content Deviation coefficient (%) | Feature of grain |
|---|---|---|---|---|---|---|---|---|
| Low sensitivity red-sensitive emulsion layer | A2 | 0.16 | 1.0 | 0.24 | 13 | 3.5 | 55 | Tetradeca-hedral grain |
| | B2 | 0.34 | 1.0 | 0.25 | 10 | 3.6 | 50 | Tetradeca-hedral grain |
| | C2 | 0.19 | 1.0 | 0.28 | 10 | 3.3 | 20 | Cubic grain |
| Medium sensitivity red-sensitive emulsion layer | D2 | 0.50 | 1.0 | 0.43 | 18 | 2.6 | 50 | Tetradeca-hedral grain |
| High sensitivity red-sensitive emulsion layer | E2 | 0.50 | 2.8 | 0.85 | 8 | 1.6 | 15 | Tabular grain |
| Low sensitivity green-sensitive emulsion layer | F2 | 0.24 | 1.0 | 0.18 | 15 | 4.0 | 15 | Cubic grain |
| | G2 | 0.41 | 1.0 | 0.24 | 11 | 4.0 | 50 | Cubic grain |
| | H2 | 0.30 | 1.0 | 0.37 | 9 | 3.9 | 20 | Cubic grain |
| Medium sensitivity green-sensitive emulsion layer | I2 | 0.22 | 1.0 | 0.37 | 9 | 3.5 | 20 | Cubic grain |
| | J2 | 0.28 | 1.0 | 0.52 | 9 | 3.2 | 25 | Cubic grain |
| High sensitivity green-sensitive emulsion layer | K2 | 0.44 | 3.0 | 1.20 | 25 | 1.6 | 65 | Tabular grain |
| Low sensitivity | L2 | 0.17 | 3.0 | 0.49 | 12 | 4.7 | 15 | Tabular grain |

TABLE 5-continued

| | | | | | | | | |
|---|---|---|---|---|---|---|---|---|
| blue-sensitive | M2 | 0.04 | 4.5 | 0.65 | 8 | 4.7 | 20 | Tabular grain |
| emulsion layer | N2 | 0.22 | 7.5 | 1.10 | 10 | 4.7 | 35 | Tabular grain |
| Medium sensitivity | O2 | 0.08 | 4.1 | 0.93 | 18 | 2.0 | 35 | Tabular grain |
| blue-sensitive emulsion layer | P2 | 0.08 | 8.0 | 1.15 | 15 | 2.5 | 30 | Tabular grain |
| High sensitivity | Q2 | 0.21 | 3.0 | 1.52 | 25 | 1.2 | 65 | Tabular grain |
| blue-sensitive emulsion layer | R2 | 0.26 | 10.0 | 2.88 | 13 | 1.2 | 20 | Tabular grain |

| | Emulsion | Ratio of (111) plane | Kind and added amount of added sensitizing dye (mg/Ag mol) | | | | | | | |
|---|---|---|---|---|---|---|---|---|---|---|
| Used amount | 1), 2) | on surface 3) | Kind | Amount | Kind | Amount | Kind | Amount | Kind | Amount |
| Low sensitivity | A2 | 45 | S-1 | 250 | S-4 | 25 | — | — | — | — |
| red-sensitive | B2 | 35 | S-2 | 381 | S-4 | 20 | — | — | — | — |
| emulsion layer | C2 | 0 | S-2 | 264 | S-3 | 41 | S-4 | 14 | — | — |
| Medium sensitivity red-sensitive emulsion layer | D2 | 50 | S-1 | 267 | S-4 | 105 | — | — | — | — |
| High sensitivity red-sensitive emulsion layer | E2 | 99 | S-1 | 66 | S-2 | 240 | S-3 | 22 | S-4 | 1 |
| Low sensitivity | F2 | 2 | S-7 | 544 | S-9 | 128 | — | — | — | — |
| green-sensitive | G2 | 1 | S-7 | 422 | S-9 | 122 | — | — | — | — |
| emulsion layer | H2 | 0 | S-7 | 479 | S-9 | 86 | — | — | — | — |
| Medium sensitivity | I2 | 0 | S-5 | 479 | S-6 | 86 | — | — | — | — |
| green-sensitive emulsion layer | J2 | 5 | S-5 | 273 | S-8 | 55 | S-10 | 28 | — | — |
| High sensitivity green-sensitive emulsion layer | K2 | 98 | S-7 | 213 | S-9 | 71 | S-10 | 33 | — | — |
| Low sensitivity | L2 | 55 | S-12 | 185 | S-11 | 42 | S-13 | 42 | — | — |
| blue-sensitive | M2 | 50 | S-12 | 170 | S-11 | 38 | S-13 | 38 | — | — |
| emulsion layer | N2 | 45 | S-12 | 119 | S-11 | 27 | S-13 | 27 | — | — |
| Medium sensitivity | O2 | 98 | S-12 | 260 | S-11 | 25 | S-13 | 24 | — | — |
| blue-sensitive emulsion layer | P2 | 99 | S-12 | 207 | S-11 | 20 | S-13 | 20 | — | — |
| High sensitivity | Q2 | 99 | S-12 | 187 | S-11 | 18 | S-13 | 18 | — | — |
| blue-sensitive emulsion layer | R2 | 99 | S-12 | 173 | S-11 | 12 | S-13 | 11 | — | — |

Note 1) Each of emulsions described above was a core/shell type emulsion having a high-iodine phase in the emulsion grain, and each emulsion was subjected to gold/sulfur/selenium sensitization or gold/sulfur sensitization.
Note 2) To each emulsion described above, compounds F-1, F-3, F-7, F-8, F-9, and F-10 were added appropriately.
Note 3) Ratio of (111) plane on surface was determined by a method with Kubelka-Munk.

Further, to all emulsion layers, in addition to the above-described components, additives F-1 to F-8, surface active agents W-1 to W-6, and gelatin hardener H-1 were added.

Further, as antifungal and antibacterial agents, phenol, 1,2-benzisothiazoline-3-one, 2-phenoxyethanol, phenetylalcohol, and p-benzoic acid butyl ester were added.

The swelling ratio (ratio of swelled film thickness and dry film thickness) of this sample measured was 1.8.

C-1

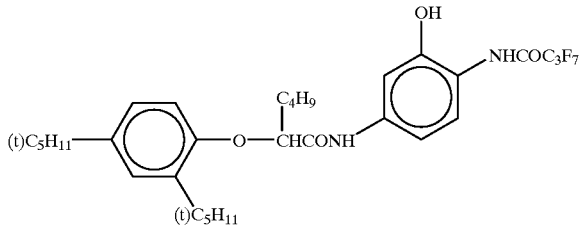

-continued
C-2
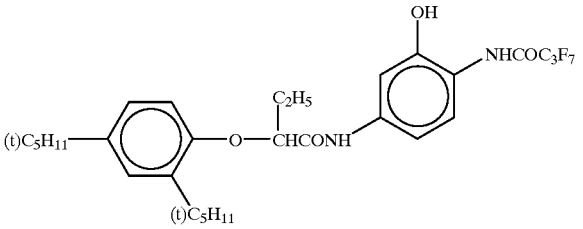
C-3
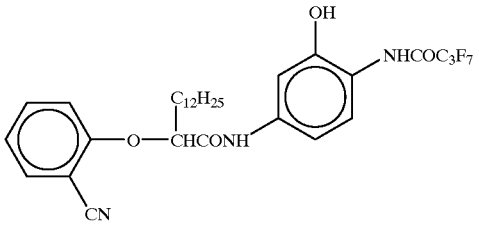
C-4
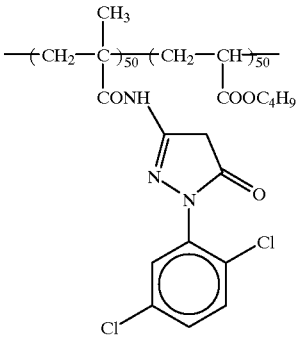
Figures indicates amounts by % by weight
Average molecular weight: ca. 25,000
C-5
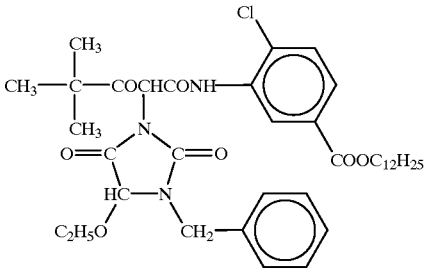
C-6
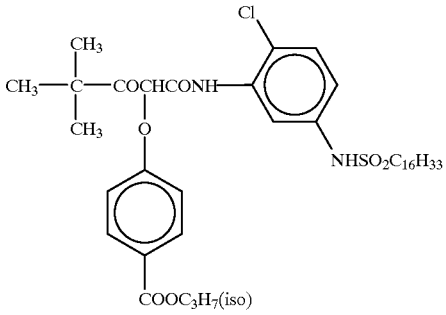
C-7
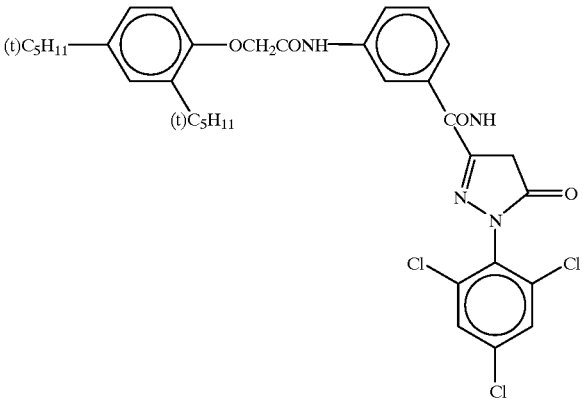

-continued
C-8
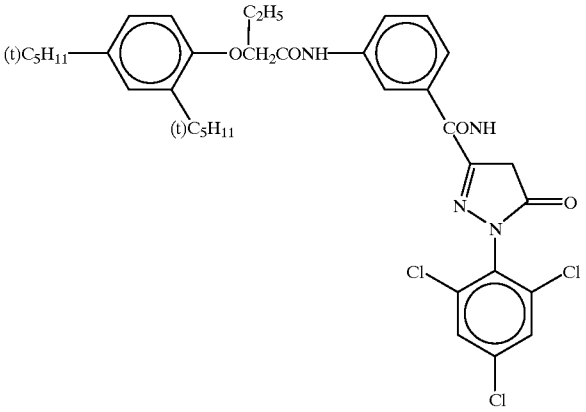
C-9
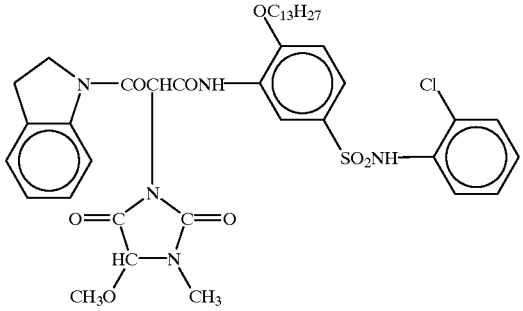
Oil-1
Dibutyl phthalate
Oil-2
Tricresyl phosphate
Oil-3
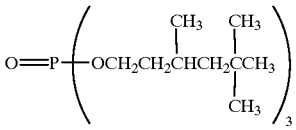
C-10
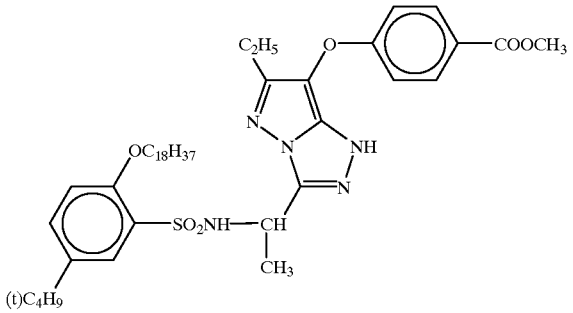

-continued
C-11
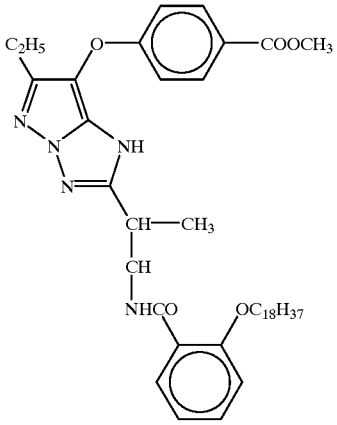
U-1
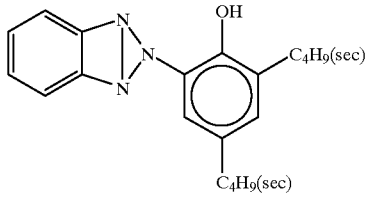
U-2
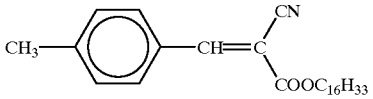
U-3
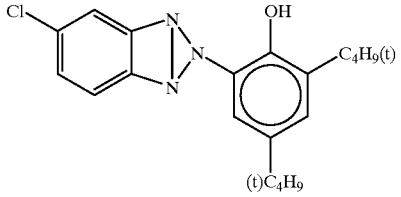
U-4
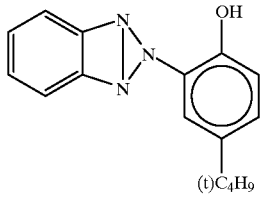
U-5
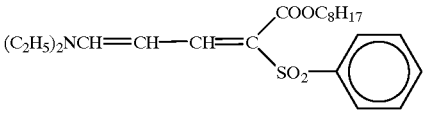
Cpd-A
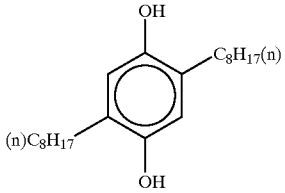
Cpd-B
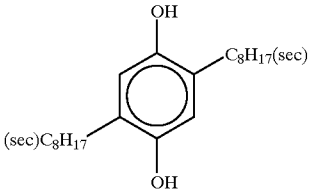
Cpd-C
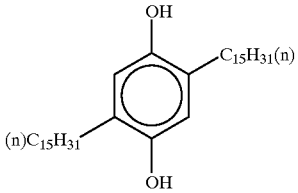
Cpd-D
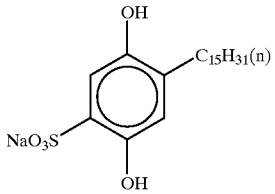
Cpd-E
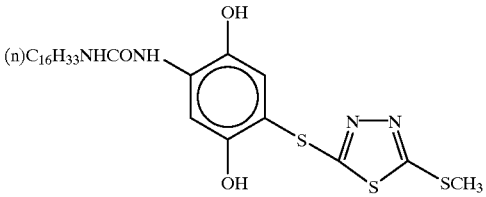

-continued
Cpd-F
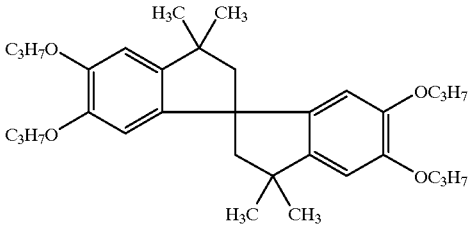
Cpd-G
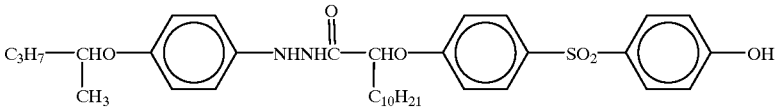
Cpd-H
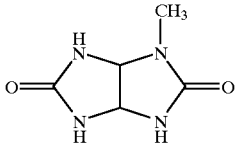
D-1
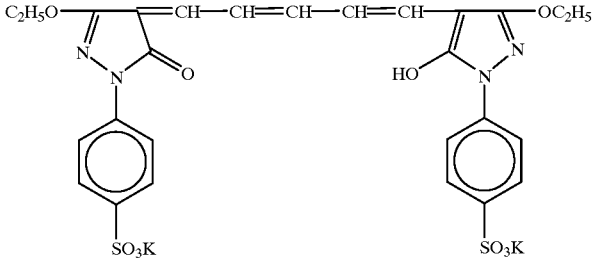
D-2
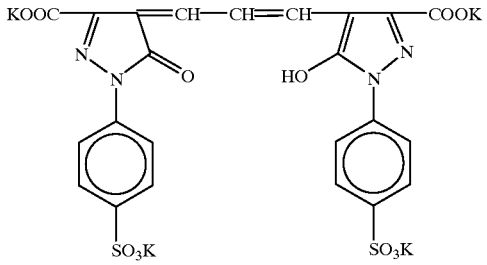
D-3
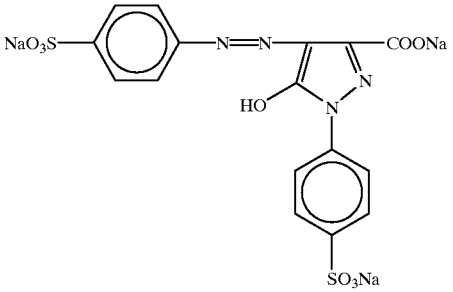
D-4
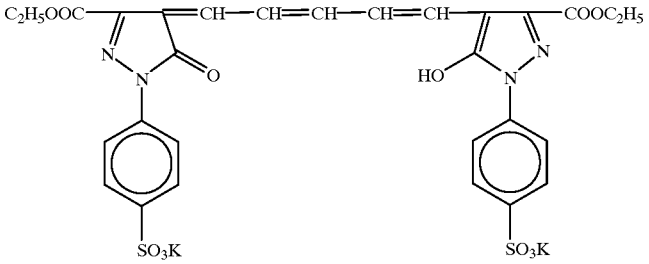

-continued
D-5
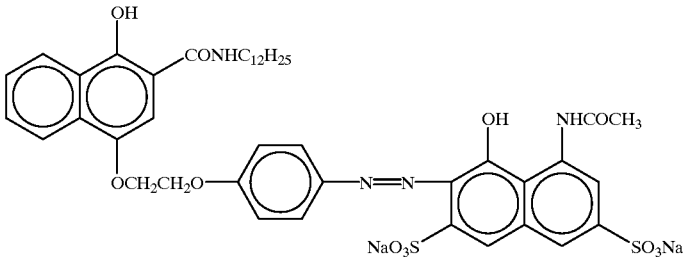
E-1
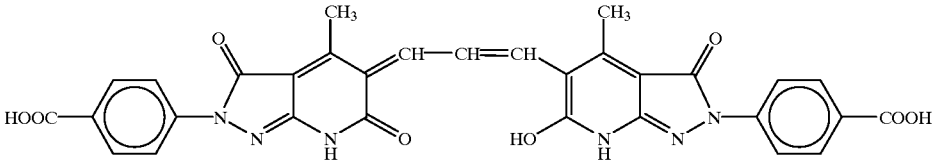
E-2
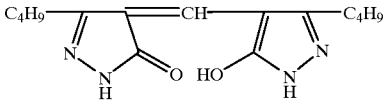
E-3
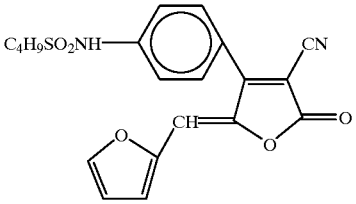
E-4
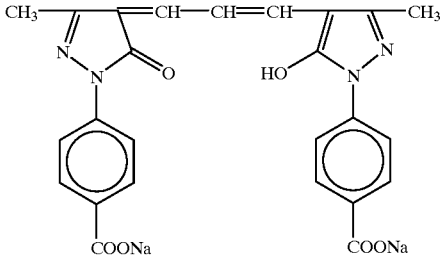
W-2
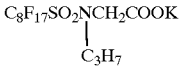
W-3
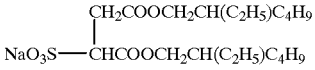
W-4
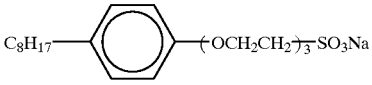
W-5
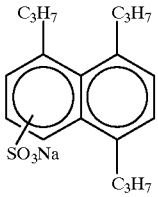
W-6
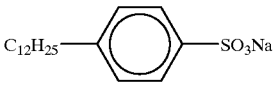
P-1
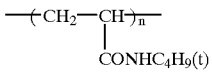
M-1
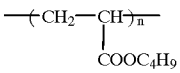

-continued
F-1
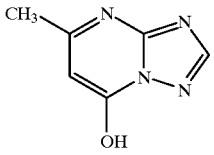
F-2
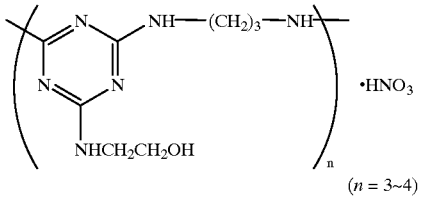
F-3
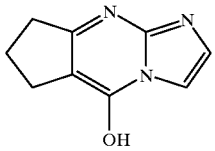
F-4
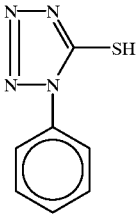
F-5
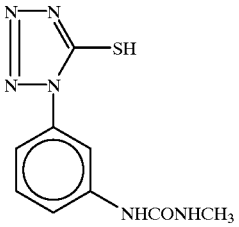
F-6
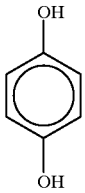
F-7
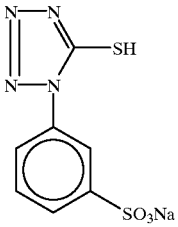
F-8
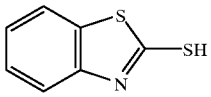
S-1
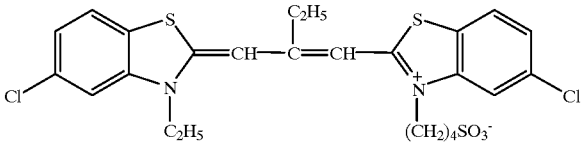
S-2
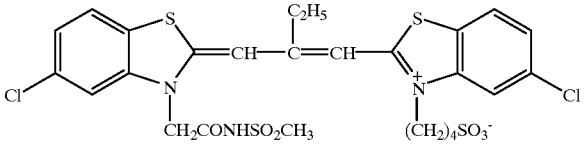
S-3
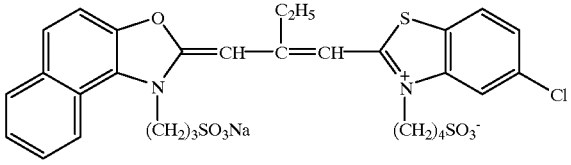

-continued
S-4
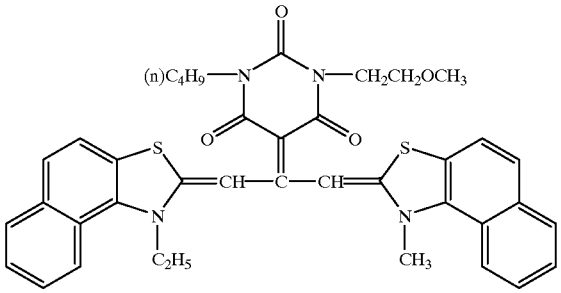
S-5
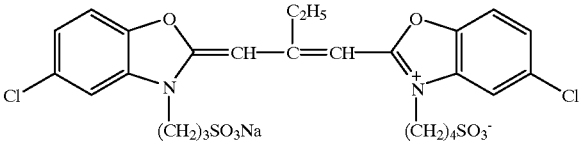
S-6
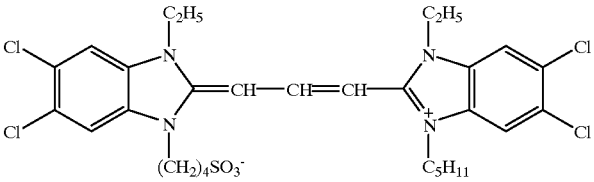
S-7
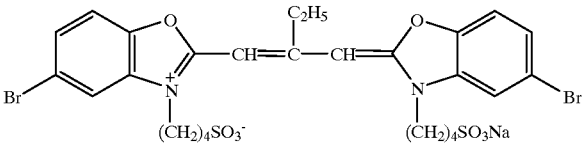
S-8
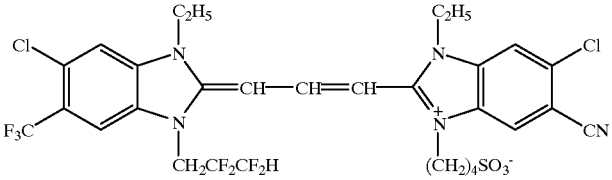
S-9
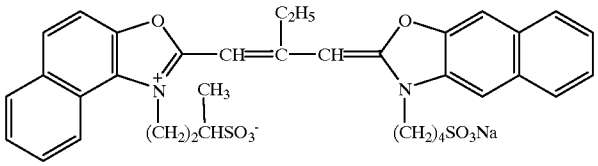
S-10
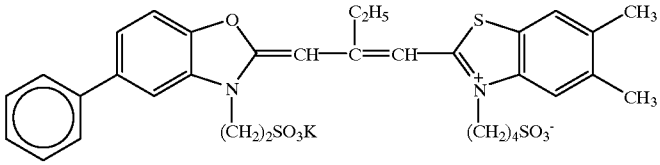
S-11
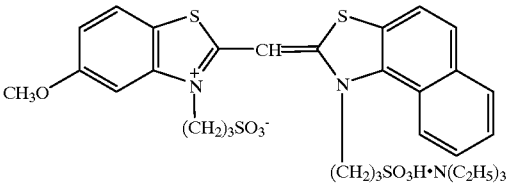
S-12
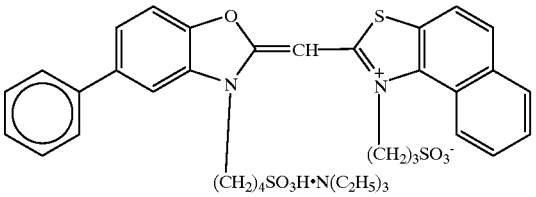

-continued

S-13

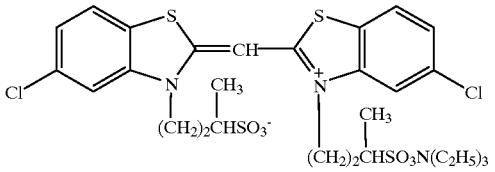

(2) Preparation of Samples 302 to 318

Samples 302 to 316 were prepared in the same manner as Sample 301, except that, instead of the Emulsion E2 added into the sixth layer of Sample 301, one of Emulsions Em-11 to Em-25 was used. Sample 317 was prepared in the same manner as Sample 303, except that immediately before the application of the sixth layer, Compound 2 was added in an amount of 29 mg, per mol of silver. Sample 318 was prepared in the same manner as Sample 310, except that immediately before the application of the sixth layer, Compound 2 was added in an amount of 29 mg, per mol of silver.

(3) Evaluation of the Samples a. Sensitivity

Each of the thus prepared Samples 301 to 318 was subjected to wedge exposure using a white light source of 2,000 lux and a color temperature of 4800 K for 1/50 sec, and it was subjected to development processing as shown below, and the sensitivity was measured from the relative value of the reciprocal of the relative exposure amount giving a cyan density of 2.5.

b. RMS granularity

The RMS granularity with the magenta density of 2.5 was measured. The RMS granularity of Sample 302 was assigned to be 100 and the relative values to it were shown. The smaller the value is, the more excellent the granularity is.

c. Evaluation of development progress balance (sensitivity difference and tint change)

After the samples were exposed to light, they were subjected to a first development process, for 6 min, and they were subjected to a forced development process, for 8 min. Thereafter, the samples were subjected to the usual reversal, color development process, and the sensitivity difference at a magenta density of 2.5 was read out, for the evaluation. Further, the tint change was evaluated on a 1 to 5 scale by five persons, and the average value of the results was calculated.

(Processing steps and processing solutions of standard developing process)

| Process | Time | Temperature | Tank volume | Replenisher amount |
|---|---|---|---|---|
| 1st development | 6 min | 38° C. | 12 liter | 2,200 ml/m$^2$ |
| water-washing | 2 min | 38° C. | 4 liter | 7,500 ml/m$^2$ |
| Reversal | 2 min | 38° C. | 4 liter | 1,100 ml/m$^2$ |
| Color development | 6 min | 38° C. | 12 liter | 2,200 ml/m$^2$ |
| Pre-bleaching | 2 min | 38° C. | 4 liter | 1,100 ml/m$^2$ |
| Bleaching | 6 min | 38° C. | 12 liter | 220 ml/m$^2$ |
| Fixing | 4 min | 38° C. | 8 liter | 1,100 ml/m$^2$ |

-continued

| Process | Time | Temperature | Tank volume | Replenisher amount |
|---|---|---|---|---|
| Water-washing | 4 min | 38° C. | 8 liter | 7,500 ml/m$^2$ |
| Final-rinsing | 1 min | 25° C. | 2 liter | 1,100 ml/m$^2$ |

Compositions of processing solutions used were as follows:

| First developer | Tank solution | Replenisher |
|---|---|---|
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide) | | |
| Reversal solution | | |
| (Both tank solution and replenisher) | | 3.0 g |
| Pentasodium nitrilo-N,N,N-trimethylenephosphonate | | |
| Stannous chloride dihydrate | | 1.0 g |
| p-Aminophenol | | 0.1 g |
| Sodium hydroxide | | 8 g |
| Glacial acetic acid | | 15 ml |
| Water to make | | 1,000 ml |
| pH | | 6.00 |
| (pH was adjusted by using acetic acid or sodium hydroxide) | | |

| Color developer | Tank solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate mono hydrate | 11 g | 11 g |
| 3,6-Dithiaoctane-1,8-diol | 1.0 g | 1.0 g |
| Water to make | 1,000 ml | 1,000 ml |

-continued

| | | |
|---|---|---|
| pH (pH was adjusted by using sulfuric acid or potassium hydroxide) | 11.80 | 12.00 |

| Pre-bleaching solution | Tank Solution | Reple-nisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde · sodium bisulfite adduct | 30 g | 35 g |
| Water to make | 1,000 ml | 1,000 ml |
| pH (pH was adjusted by using acetic acid or sodium hydroxide) | 6.30 | 6.10 |

| Bleaching solution | Tank solution | Reple-nisher |
|---|---|---|
| Disodium ethylenediaminetetraacetate dihydrate | 2.0 g | 4.0 g |
| Iron (III) ammonium ethylenediamine-tetraacetate dihydrate | 120 g | 240 g |
| Potassium bromide | 100 g | 200 g |
| Ammonium nitrate | 10 g | 20 g |
| Water to make | 1,000 ml | 1.000 ml |
| pH (pH was adjusted by using nitric acid or sodium hydroxide) | 5.70 | 5.50 |

-continued

| | |
|---|---|
| Fixing solution | 80 g |
| (Both tank solution and replenisher) | |
| Ammonium thiosulfate | |
| Sodium sulfite | 5.0 g |
| Sodium bisulfite | 5.0 g |
| Water to make | 1,000 ml |
| pH (pH was adjusted by using acetic acid or aqueous ammonia) | 6.60 |

| Final-rinsing solution | Tank solution | Reple-nisher |
|---|---|---|
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

The results together with the characteristics of the coated samples are shown in Table 6.

TABLE 6

| Sample No. | Emulsion in 6th layer | Timing of addition of (100) plane-selective compound | Relative sensitivity | Difference between 6 min First-development and 8 min one: Sensitivity difference | Tint change | RMS granularity | Remarks |
|---|---|---|---|---|---|---|---|
| 302 | Em-11 | — | 100 | 0.27 | 4 | 100 | Comparative example |
| 303 | Em-12 | — | 126 | 0.52 | 1 | 168 | Comparative example |
| 304 | Em-13 | at preparation of emulsion | 124 | 0.30 | 5 | 101 | This invention |
| 305 | Em-14 | at preparation of emulsion | 123 | 0.31 | 5 | 102 | This invention |
| 306 | Em-15 | at preparation of emulsion | 123 | 0.31 | 4 | 101 | This invention |
| 307 | Em-16 | at preparation of emulsion | 122 | 0.32 | 5 | 102 | This invention |
| 308 | Em-17 | at preparation of emulsion | 120 | 0.29 | 4 | 102 | This invention |
| 309 | Em-18 | at preparation of emulsion | 120 | 0.31 | 5 | 103 | This invention |
| 310 | Em-19 | — | 138 | 0.55 | 1 | 171 | Comparative example |
| 311 | Em-20 | at preparation of emulsion | 136 | 0.31 | 5 | 100 | This invention |
| 312 | Em-21 | at preparation of emulsion | 135 | 0.30 | 5 | 101 | This invention |
| 313 | Em-22 | at preparation of emulsion | 136 | 0.30 | 5 | 101 | This invention |
| 314 | Em-23 | at preparation of emulsion | 134 | 0.32 | 4 | 102 | This invention |
| 315 | Em-24 | at preparation of emulsion | 134 | 0.31 | 5 | 103 | This invention |
| 316 | Em-25 | at preparation of emulsion | 135 | 0.31 | 5 | 102 | This invention |
| 317 | Em-12 | Compound 2 at application of emulsion | 135 | 0.32 | 4 | 101 | This invention |
| 318 | Em-19 | Compound 2 at application of emulsion | 134 | 0.31 | 5 | 100 | This invention |

Note "—": not added

As is apparent from the results in Table 6, the samples containing the emulsion of the present invention are high in sensitivity and excellent in RMS granularity and development progress balance. The similar investigation was carried out with respect to the green-sensitive emulsion and the blue-sensitive emulsion layer, and it was found that in both systems, similar favorable results were obtained.

Example 4

Preparation of Emulsion A3

A 190 ml (0.825 M) of aqueous silver nitrate solution and (0.825 M) of potassium bromide, which were kept pH 5 and 75° C., were added, over 20 min, by the double-jet manner, to 1.44 liters of an aqueous solution containing 0.53 g of potassium bromide and 60 g of gelatin, with stirring, during which the silver electric potential was kept at 25 mV for a saturated calomel electrode. Thereafter, further, 838 ml (1.65 M) of silver nitrate aqueous solution and (1.65 M) of potassium bromide aqueous solution were added over 30 min, keeping silver electric potential to 70 mV. Then, after the completion of grain formation, followed by desalting by a usual flocculation method, and washing with water, gelatin and water were added, and the pH and pAg were adjusted to 6.3 and 8.4, respectively. The resulting silver bromide emulsion A3 comprised monodisperse tetradecahedron emulsion wherein the grain diameter was 0.45 μm and the deviation coefficient of the grain diameter was 12%.

Plane Selectivity of Dyes

On a part of Emulsion A3, was adsorbed one of various dyes (Dyes 1 to 8), in an amount of $5\times10^{-4}$ mol per mol of silver contained in the Emulsion, at 40° C. for 20 min; then 933 ml of an aqueous silver nitrate solution (1.65 M) and an aqueous potassium bromide solution (1.65 M) were added, over 20 min, with the silver electric potential kept at 35 mV, and the shapes were observed. The ratios of (100) plane selectivity to the whole are shown in Table 7. If the value was 0.63 or over, the compound was defined as a (100) plane-selective compound.

1

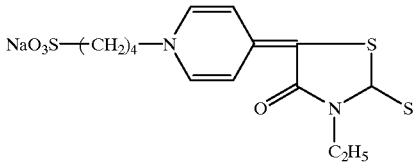

2

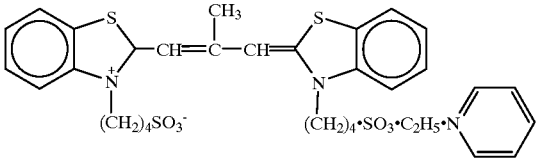

3

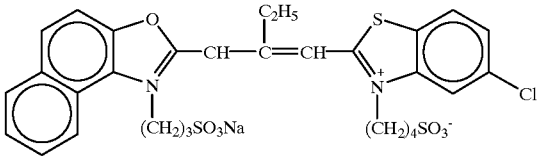

-continued

4

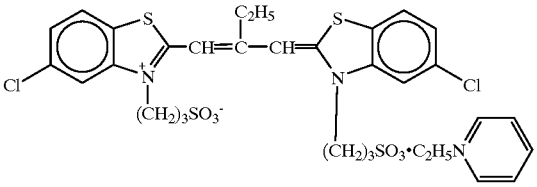

5

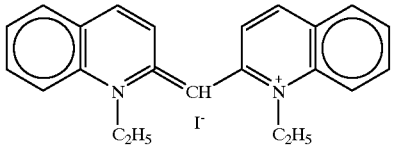

6

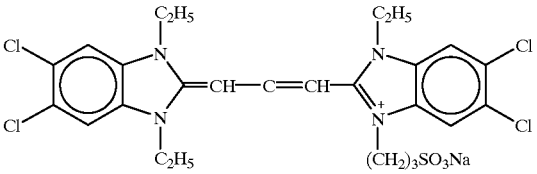

7

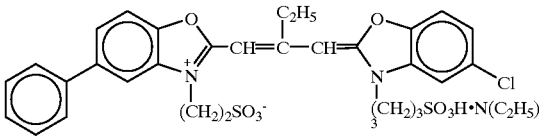

8

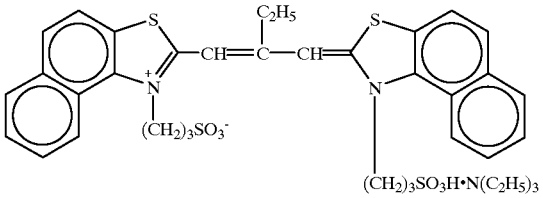

TABLE 7

| Dye No. | (100) plane ratio of grain formed by attaching a shell on tetradecahedral grain to which a dye adsorbed | Plane-selectivity |
|---|---|---|
| 1 | 0.51 | — |
| 2 | 0.95 | (100) plane-selectivity |
| 3 | 0.72 | (100) plane-selectivity |
| 4 | 0.32 | — |
| 5 | 0.40 | — |
| 6 | 0.89 | (100) plane-selectivity |
| 7 | 0.70 | (100) plane-selectivity |
| 8 | 0.85 | (100) plane-selectivity |
| no dye | 0.50 | — |
| Compound 2 | 0.90 | (100) plane-selectivity |

Preparation of Emulsion B3

79 ml of an aqueous silver nitrate solution (containing silver nitrate in an amount of 31.3 g in 100 ml), and 79 ml of an aqueous potassium bromide solution (containing potassium bromide in an amount of 22.8 g in 100 ml), were simultaneously added into 1.5 liters of an aqueous solution containing 6.3 g of potassium bromide and 10.0 g of a gelatin having an average molecular weight (M) of 15,000, at 52° C. and at 47.2 ml/min by the double-jet process, with stirring. After an aqueous gelatin solution (containing inactive gelatin in an amount of 40.4 g in 300 ml of water) was added, the temperature was elevated to 75° C., and an aqueous potassium bromide solution (containing 4.1 g of potassium bromide) was added, over 30 sec. Further, an aqueous ammonium nitrate solution (containing 21 g of ammonium nitrate) was added, the pH was adjusted with an aqueous sodium hydroxide solution to 6.4, and ripening was effected for 15 min. Then acetic acid was added thereto, to bring the pH to 5.3. An aqueous silver nitrate solution containing 50.7 g of silver nitrate, and an aqueous potassium bromide solution, were added, over 15 min, with the pAg being kept at 8.0. After the temperature was dropped to 45° C., an aqueous silver nitrate (6.89 g) solution and an aqueous potassium iodide (6.77 g) solution were added, by the double-jet process (up to here the process was for the formation of cores). Thereafter, an aqueous silver nitrate solution containing 100.5 g of silver nitrate, and an aqueous potassium bromide solution, were added, with the pAg kept at 9.2 (the process for forming shells). Then the temperature was dropped to 35° C., followed by washing with water by a usual flocculation method, and then 70 g of gelatin was added, and the pH and pAg were adjusted to 6.1 and 8.8, respectively. The resulting emulsion comprised tabular grains wherein the average circle-equivalent diameter was 0.82 μm, the average thickness was 0.20 μm, the average aspect ratio was 4.2, and the average silver iodide content was 3.8 mol %.

Preparation of Emulsion C3

Emulsion C3 was prepared in the same manner as Emulsion B3, except that, after the process for the formation of cores, in the process of forming shells, an aqueous silver nitrate solution containing 100.5 g of silver nitrate, and an aqueous potassium bromide solution, were added, with the pAg kept at 8.5. The resulting emulsion comprised tabular grains wherein the average circle-equivalent diameter was 0.61 μm, the average thickness was 0.38 μm, and the average aspect ratio was 1.6.

Preparation of Emulsions D3 to M3

One selected from Dyes 1 to 8 and Compound 2 were added, in an amount of $7\times10^{-4}$ mol/mol of Ag, in the process of forming shells for the formation of grains of Emulsion B3, and after the steps of dispersing and washing, a chemical sensitization was carried out, optimally, in the presence of the spectral sensitizer ExS-3, to obtain Emulsions D3, E3, F3, G3, H3, I3, J3, K3, and M3. Separately, Dye 2 was added, in an amount of $7\times10^{-4}$ mol/mol of Ag, in the process for forming shells for the formation of grains of C3, and after the steps of dispersing and washing, a chemical sensitization was carried out, optimally, in the presence of the spectral sensitizer ExS-3, to obtain Emulsion L3. The below-shown compound was added to each of the Emulsions B3 to M3; then each of the Emulsions was respectively coated, together with a protective layer, onto a triacetyl cellulose film support having an undercoat layer, by the co-extrusion method, thereby obtaining Samples 401 to 412.

(1) Emulsion Layers

Emulsion: Emulsions B3 to L3 (corresponding to Samples 401 to 412, respectively)

Stabilizer: 4-hydroxy-6-methyl-1,3,3a,7-tetrazaindene (2) Protective Layer

Gelatin

These samples were exposed, for 10 sec, to blue light for sensitometry, which had been passed through a Fuji Gelatin Filter BPN 42; then they were subjected to black-and-white development processing, for 10 min at 20° C., with the below-shown D-19 developer. Then, in the usual manner, the development was stopped, fixing, washing, and drying were carried out, and with respect to the graininess wherein the optical sensitivity was 1, the RMS granularity was measured, with the aperture being 48 μm.

The composition of the processing solution is shown below.

| | |
|---|---|
| Metol | 2.2 g |
| $Na_2SO_3 \cdot 7H_2O$ | 96 g |
| Hydroquinone | 8.8 g |
| $Na_2CO_3$ | 56 g |
| KBr | 5.0 g |
| Water to make | 1.0 liter |

The results obtained in the above evaluation are shown in Table 8. It is apparent that, in comparison with Comparative Example 401, Samples 404, 405, 408, 409, 410, and 412 of the present invention, corresponding respectively to Dyes 2, 3, 6, 7, 8 and Compound 2, having (100) plane-selectivity, are remarkably excellent in granularity. It is also seen that Dye 2 is effective for 404, whose grains are thin, but its effect is low for 411, whose grains are thick.

TABLE 8

| Sample No. | Emulsion | Dye | Thickness of emulsion grain (μm) | RMS granularity |
|---|---|---|---|---|
| 401 | B3 | — | 0.20 | 100 |
| 402 | C3 | — | 0.38 | 100 |
| 403 | D3 | 1 | 0.20 | 98 |
| 404 | E3 | 2 | " | 75 |
| 405 | F3 | 3 | " | 83 |
| 406 | G3 | 4 | " | 97 |
| 407 | H3 | 5 | " | 97 |
| 408 | I3 | 6 | " | 79 |
| 409 | J3 | 7 | " | 84 |
| 410 | K3 | 8 | " | 81 |
| 411 | L3 | 2 | 0.38 | 95 |
| 412 | M3 | Compound 2 | 0.20 | 75 |

Example 5

Similarly to Example 4, Additive 2, in an amount corresponding to $1\times10^{-3}$ mol to 1 mol of silver in the emulsion, was added, with the addition timing varied during the preparation of Emulsion B3, as shown in Table 9, and after the steps of dispersing and washing were carried out, the chemical sensitization was carried out, optimally, in the presence of Spectral Sensitizers S-4, S-5, and S-9, thereby obtaining Emulsions N3, O3, P3, and Q3.

Dye 8, in an amount corresponding to $1\times10^{-3}$ mol to 1 mol of silver, was added, with the addition timing varied during the preparation of Emulsion C3, and after the steps of dispersing and washing were carried out, the chemical sensitization was carried out, optimally, in the presence of the below-shown Spectral Sensitizers S-4, S-5, and S-9, thereby obtaining Emulsions R3, S3, T3, and U3.

TABLE 9

| Emulsion | Original emulsion to be modified | Timing of addition of Compound 2, Dye 8 |
|---|---|---|
| N3 | B3 | Immediately before shell attaching process |
| O3 | " | After 5 minutes of start of shell attaching process |
| P3 | " | After 15 minutes of start of shell attaching process |
| Q3 | " | One minute before completion of emulsion preparation |
| R3 | C3 | Immediately before shell attaching process |
| S3 | " | After 5 minutes of start of shell attaching process |
| T3 | " | After 15 minutes of start of shell attaching process |
| U3 | " | One minute before completion of emulsion preparation |

Layers having the below-shown compositions, with the medium-sensitive green-sensitive emulsion layer of the tenth layer being Emulsion B3, were formed on a triacetyl cellulose film support having an undercoat layer, to prepare a multi-layer color light-sensitive material, which was named Sample 512. Each figure shows the added amount per $m^2$. Samples 513 to 521 were prepared in the same manner as Sample 512, except that, instead of the emulsion used in the medium-sensitive green-sensitive emulsion layer of the tenth layer of Sample 512, Emulsion C3 and Emulsions N3 to U3 were used, respectively.

First Layer (Halation-prevention layer)

| | |
|---|---|
| Black colloidal silver | 0.10 g |
| Gelatin | 0.90 g |
| Ultraviolet ray absorbent U-1 | 0.10 g |
| Ultraviolet ray absorbent U-3 | 0.040 g |
| Ultraviolet ray absorbent U-4 | 0.10 g |
| High-boiling organic solvent Oil-1 | 0.10 g |
| Fine crystal solid dispersion of Dye E-1 | 0.10 g |

Second Layer (Intermediate layer)

| | |
|---|---|
| Gelatin | 0.40 g |
| Compound Cpd-C | 5.0 mg |
| Compound Cpd-J | 5.0 mg |
| Compound Cpd-K | 3.0 mg |
| High-boiling organic solvent Oil-3 | 0.10 g |
| Dye D-4 | 0.80 mg |

Third Layer (Intermediate layer)

| | |
|---|---|
| Silver iodobromide emulsion of fine grains, surface and inner part of which were fogged (av. grain diameter: 0/06 μm, deviation coefficient: 18%, AgI content: 1 mol %) | silver 0.050 g |
| Yellow colloidal silver | silver 0.030 g |
| Gelatin | 0.40 g |

Fourth Layer (Low sensitivity red-sensitive emulsion layer)

| | |
|---|---|
| Emulsion A11 | silver 0.30 g |
| Emulsion A12 | silver 0.20 g |
| Gelatin | 0.80 g |

-continued

| | |
|---|---|
| Coupler C-1 | 0.15 g |
| Coupler C-2 | 0.050 g |
| Coupler C-3 | 0.050 g |
| Coupler C-9 | 0.050 g |
| Compound Cpd-C | 5.0 mg |
| Compound Cpd-J | 5.0 mg |
| High-boiling organic solvent Oil-2 | 0.10 g |
| Additive P-1 | 0.10 g |

Fifth Layer (Medium sensitivity red-sensitive emulsion layer)

| | |
|---|---|
| Emulsion A12 | silver 0.20 g |
| Emulsion A13 | silver 0.30 g |
| Gelatin | 0.80 g |
| Coupler C-1 | 0.20 g |
| Coupler C-2 | 0.050 g |
| Coupler C-3 | 0.20 g |
| High-boiling organic solvent Oil-2 | 0.10 g |
| Additive P-1 | 0.10 g |

Sixth Layer (High sensitivity red-sensitive emulsion layer)

| | |
|---|---|
| Emulsion A14 | silver 0.40 g |
| Gelatin | 1.10 g |
| Coupler C-1 | 0.30 g |
| Coupler C-2 | 0.10 g |
| Coupler C-3 | 0.70 g |
| Additive P-1 | 0.10 g |

Seventh Layer (Intermediate layer)

| | |
|---|---|
| Gelatin | 0.60 g |
| Additive M-1 | 0.30 g |
| Color-mix preventing agent Cpd-I | 2.6 mg |
| Dye D-5 | 0.020 g |
| Dye D-6 | 0.010 g |
| Compound Cpd-J | 5.6 mg |
| High-boiling organic solvent Oil-1 | 0.020 g |

Eighth Layer (Intermediate layer)

| | |
|---|---|
| Silver iodobromide emulsion, surface and inner part of which were fogged (av. grain diameter: 0.06 μm, deviation coefficient: 16%, AgI content: 0.3 mol %) | silver 0.020 g |
| Yellow colloidal silver | silver 0.020 g |
| Gelatin | 1.00 g |
| Additive P-1 | 0.20 g |
| Color-mix preventing agent Cpd-A | 0.10 mg |
| Compound Cpd-C | 0.10 g |

Ninth Layer (Low sensitivity green-sensitive emulsion layer)

| | |
|---|---|
| Emulsion A15 | silver 0.10 g |
| Emulsion A16 | silver 0.20 g |
| Emulsion A17 | silver 0.20 g |
| Gelatin | 0.50 g |
| Coupler C-4 | 0.10 g |
| Coupler C-7 | 0.050 g |

-continued

| | |
|---|---|
| Coupler C-8 | 0.10 g |
| Compound Cpd-B | 0.030 g |
| Compound Cpd-D | 0.020 g |
| Compound Cpd-E | 0.020 g |
| Compound Cpd-F | 0.040 g |
| Compound Cpd-J | 10 mg |
| Compound Cpd-L | 0.020 g |
| High-boiling organic solvent Oil-1 | 0.10 g |
| High-boiling organic solvent Oil-2 | 0.10 g |

Tenth Layer (Medium sensitivity green-sensitive emulsion layer)

| | |
|---|---|
| Emulsion B3 | silver 0.4 g |
| Gelatin | 0.60 g |
| Coupler C-4 | 0.070 g |
| Coupler C-7 | 0.050 g |
| Coupler C-8 | 0.050 g |
| Compound Cpd-B | 0.030 g |
| Compound Cpd-D | 0.020 g |
| Compound Cpd-E | 0.020 g |
| Compound Cpd-F | 0.050 g |
| COmpound Cpd-L | 0.050 g |
| High-boiling organic solvent Oil-2 | 0.010 g |

Eleventh Layer (High sensitivity green-sensitive emulsion layer)

| | |
|---|---|
| Emulsion A18 | silver 0.50 g |
| Gelatin | 1.00 g |
| Coupler C-4 | 0.20 g |
| Coupler C-7 | 0.10 g |
| Coupler C-8 | 0.050 g |
| Compound Cpd-B | 0.080 g |
| Compound Cpd-E | 0.020 g |
| Compound Cpd-F | 0.040 g |
| Compound Cpd-K | 5.0 mg |
| Compound Cpd-L | 0.020 g |
| High-boiling organic solvent Oil-1 | 0.020 g |
| High-boiling organic solvent Oil-2 | 0.020 g |

Twelfth Layer (Intermediate layer)

| | |
|---|---|
| Gelatin | 0.60 g |
| Compound Cpd-L | 0.050 g |
| High-boiling organic solvent Oil-1 | 0.050 g |

Thirteenth Layer (Yellow filter layer)

| | |
|---|---|
| Yellow colloidal silver | silver 0.020 g |
| Gelatin | 1.10 g |
| Color-mix preventing agent Cpd-A | 0.010 g |
| Compound Cpd-L | 0.010 g |
| High-boiling organic solvent Oil-1 | 0.010 g |
| Fine crystal solid dispersion of Dye E-2 | 0.030 g |
| Fine crystal solid dispersion of Dye E-3 | 0.020 g |

Fourteenth Layer (Intermediate layer)

| | |
|---|---|
| Gelatin | 0.60 g |

Fifteenth Layer (Low sensitivity blue-sensitive emulsion layer)

| | |
|---|---|
| Emulsion A19 | silver 0.20 g |
| Emulsion A20 | silver 0.30 g |
| Gelatin | 0.80 g |
| Coupler C-5 | 0.20 g |
| Coupler C-6 | 0.10 g |
| Coupler C-10 | 0.40 g |

Sixteenth Layer (Medium sensitivity blue-sensitive emulsion layer)

| | |
|---|---|
| Emulsion A21 | silver 0.30 g |
| Emulsion A22 | silver 0.30 g |
| Gelatin | 0.90 g |
| Coupler C-5 | 0.10 g |
| Coupler C-6 | 0.10 g |
| Coupler C-10 | 0.60 g |

Seventeenth Layer (High sensitivity blue-sensitive emulsion layer)

| | |
|---|---|
| Emulsion A23 | silver 0.20 g |
| Emulsion A24 | silver 0.20 g |
| Gelatin | 1.20 g |
| Coupler C-5 | 0.10 g |
| Coupler C-6 | 0.10 g |
| Coupler C-10 | 0.60 g |
| High-boiling organic solvent Oil-2 | 0.10 g |

Eighteenth Layer (First protective layer)

| | |
|---|---|
| Gelatin | 0.70 g |
| Ultraviolet ray absorber U-1 | 0.20 g |
| Ultraviolet ray absorber U-2 | 0.050 g |
| Ultraviolet ray absorber U-5 | 0.30 g |
| Formalin scavenger Cpd-H | 0.40 g |
| Dye D-1 | 0.15 g |
| Dye D-2 | 0.050 g |
| Dye D-3 | 0.10 g |

Nineteenth Layer (Second protective layer)

| | |
|---|---|
| Colloidal silver | silver 0.10 g |
| Silver iodobromide emulsion of fine grains (av. grain diameter: 0.06 $\mu$m, AgI content: 1 mol %) | silver 0.10 g |
| Gelatin | 0.40 g |

Twentieth Layer (Third protective layer)

| | |
|---|---|
| Gelatin | 0.40 g |
| Poly(methyl methacrylate) (average grain diameter 1.5 $\mu$m) | 0.10 g |

-continued

| | |
|---|---|
| Copolymer of methyl methacrylate and acrylic acid (4:6) (average grain diameter 1.5 μm) | 0.10 g |
| Silicon oil | 0.030 g |
| Surface active agent W-1 | 3.0 mg |
| Surface active agent W-2 | 0.030 g |

Further, to all emulsion layers, in addition to the above-described components, additives F-1 to F-8 were added. Further, to each layer, in addition to the above-described components, gelatin hardener H-1 and surface active agents W-3, W-4, W-5, and W-6 for coating and emulsifying were added. Further, as antifungal and antibacterial agents, phenol, 1,2-benzisothiazoline-3-one, 2-phenoxyethanol, phenetylalcohol, and p-benzoic acid butyl ester were added.

TABLE 10

Silver iodobromide emulsions used for preparation of Samples in this Example were as follows.

| Emulsion | Feature of grain | Average grain-diameter corresponding to sphere (μm) | Deviation coefficient (%) | AgI content (%) |
|---|---|---|---|---|
| A11 | Monodisperse tetradecahedral grain | 0.28 | 16 | 4.0 |
| A12 | Monodisperse cubic internal latent image-type grain | 0.30 | 10 | 4.0 |
| A13 | Monodisperse cubic grain | 0.38 | 10 | 5.0 |
| A14 | Monodisperse tabular grain, average aspect ratio: 3.0 | 0.68 | 8 | 2.0 |
| A15 | Monodisperse cubic grain | 0.20 | 17 | 4.0 |
| A16 | Monodisperse tetradecahedral grain | 0.25 | 16 | 4.0 |
| A17 | Monodisperse cubic internal latent image-type grain | 0.40 | 11 | 4.0 |
| A18 | Monodisperse tabular grain, average aspect ratio: 5.0 | 0.80 | 10 | 2.0 |
| A19 | Monodisperse cubic grain | 0.30 | 18 | 4.0 |
| A20 | Monodisperse tetradecahedral grain | 0.45 | 17 | 4.0 |
| A21 | Monodisperse tabular grain, average aspect ratio: 5.0 | 0.55 | 10 | 2.0 |
| A22 | Monodisperse tabular grain, average aspect ratio: 8.0 | 0.70 | 13 | 2.0 |
| A23 | Monodisperse tabular grain, average aspect ratio: 6.0 | 1.00 | 10 | 1.5 |
| A24 | Monodisperse tabular grain, average aspect ratio: 9.0 | 1.20 | 15 | 1.5 |

TABLE 11

Spectral sensitization of Emulsions A11 to A18

| Emulsion | Sensitizing dye added | Amount added (g) per mol of silver halide |
|---|---|---|
| A11 | S - 2 | 0.025 |
| | S - 3 | 0.25 |
| | S - 8 | 0.010 |
| A12 | S - 1 | 0.010 |
| | S - 3 | 0.25 |
| | S - 8 | 0.010 |
| A13 | S - 1 | 0.010 |
| | S - 2 | 0.010 |
| | S - 3 | 0.25 |
| | S - 8 | 0.010 |
| A14 | S - 2 | 0.010 |
| | S - 3 | 0.10 |
| | S - 8 | 0.010 |

TABLE 11-continued

Spectral sensitization of Emulsions A11 to A18

| Emulsion | Sensitizing dye added | Amount added (g) per mol of silver halide |
|---|---|---|
| A15 | S - 4 | 0.50 |
| | S - 5 | 0.10 |
| A16 | S - 4 | 0.30 |
| | S - 5 | 0.10 |
| A17 | S - 4 | 0.25 |
| | S - 5 | 0.08 |
| | S - 9 | 0.05 |
| A18 | S - 4 | 0.30 |
| | S - 5 | 0.070 |
| | S - 9 | 0.10 |

TABLE 12

Spectral sensitization of Emulsions A19 to A24

| Emulsion | Sensitizing dye added | Amount added (g) per mol of silver halide |
|---|---|---|
| A19 | S - 6 | 0.050 |
| | S - 7 | 0.20 |
| A20 | S - 6 | 0.05 |
| | S - 7 | 0.20 |
| A21 | S - 6 | 0.060 |
| | S - 7 | 0.22 |
| A22 | S - 6 | 0.050 |
| | S - 7 | 0.17 |
| A23 | S - 6 | 0.040 |
| | S - 7 | 0.15 |
| A24 | S - 6 | 0.060 |
| | S - 7 | 0.22 |

C-1
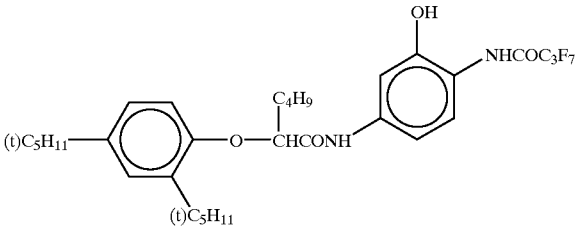
C-2
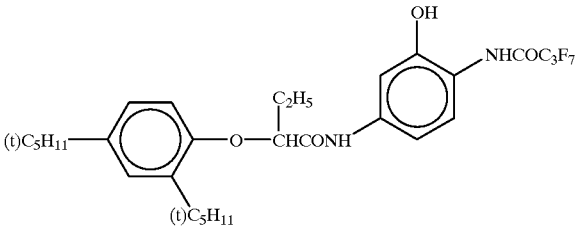
C-3
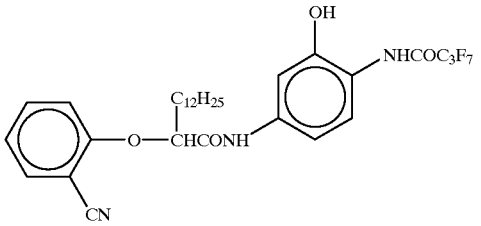
C-4
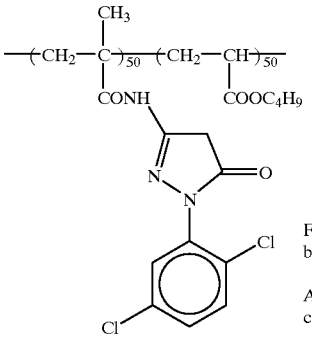
Figures indicates amounts by % by weight
Average molecular weight ca. 25,000
C-5
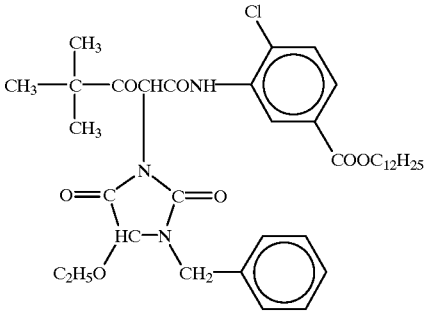
C-6
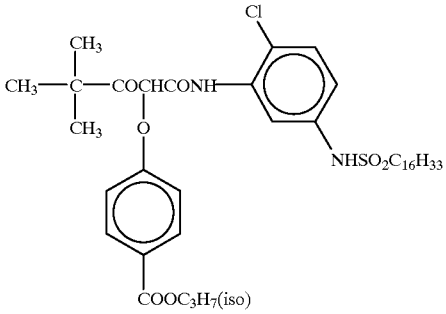
C-7
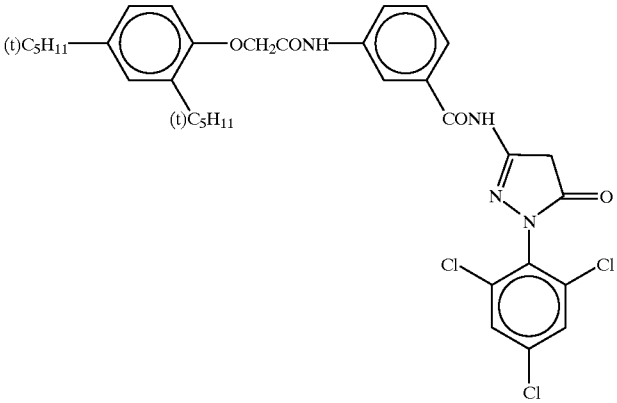

-continued
C-8
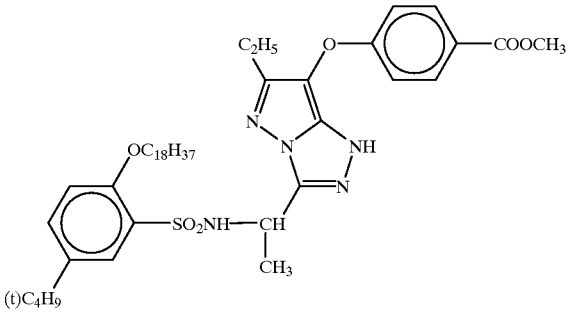
C-9
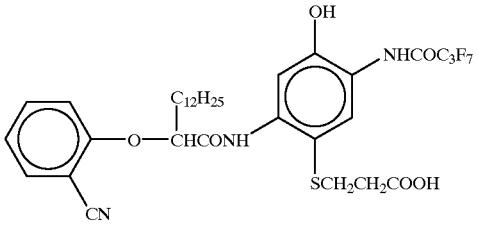
C-10
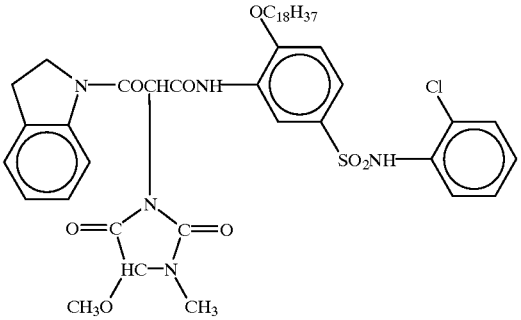
Oil-1
Dibutyl phthalate
Oil-2
Tricresyl phosphate
Oil-3
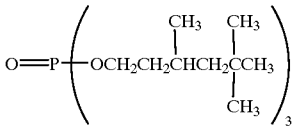
Cpd-A
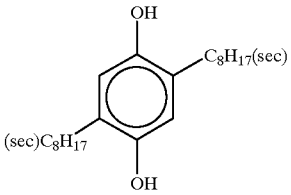
Cpd-B
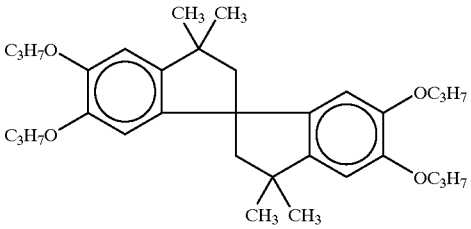
Cpd-C
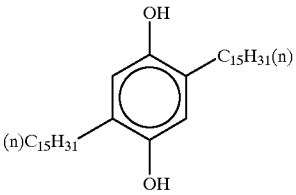
Cpd-D
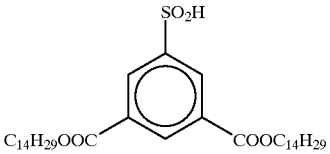
Cpd-E
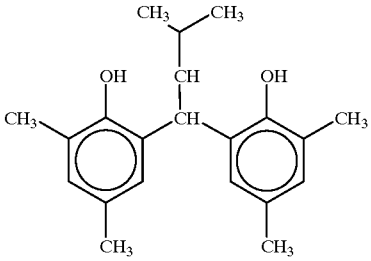

-continued
Cpd-F
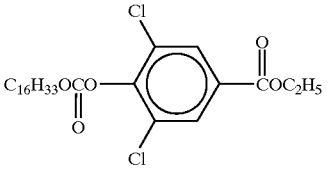
Cpd-H
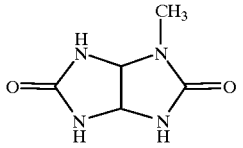
Cpd-I
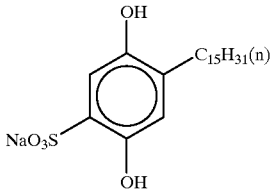
Cpd-J
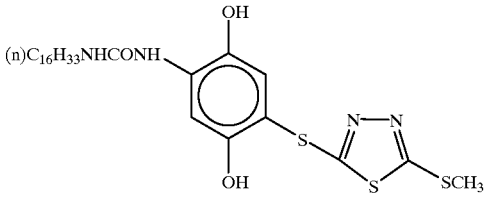
Cpd-K
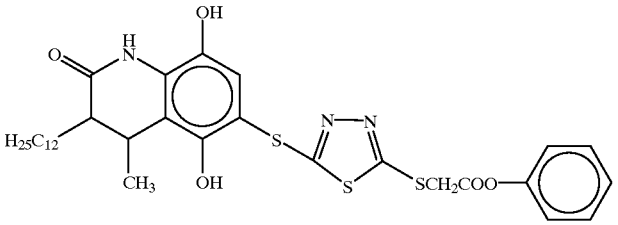
Cpd-L
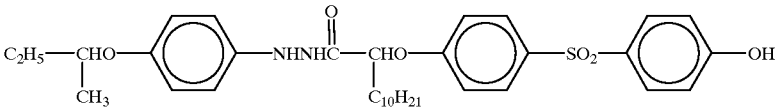
U-1
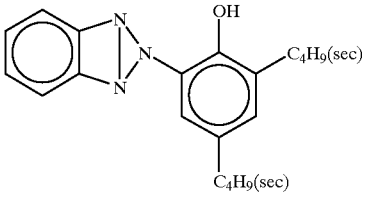
U-2
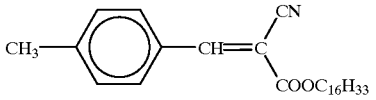
U-3
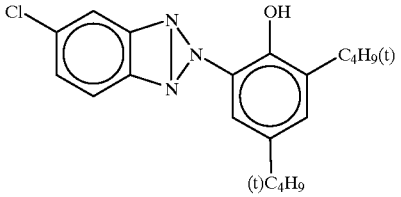
U-4
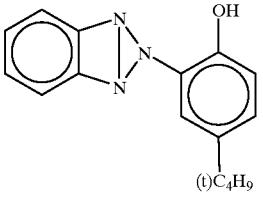
U-5
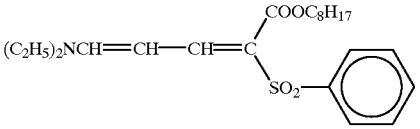
S-1
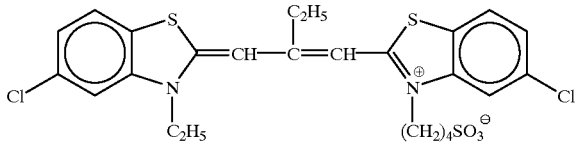
S-2
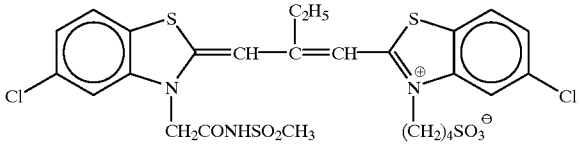

-continued
S-3
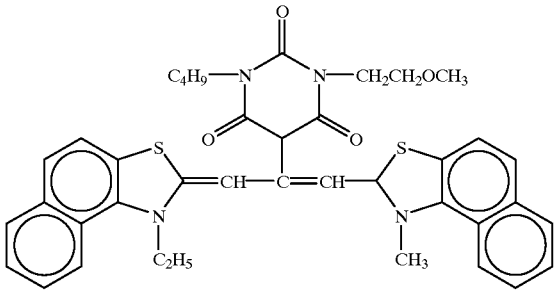
S-4
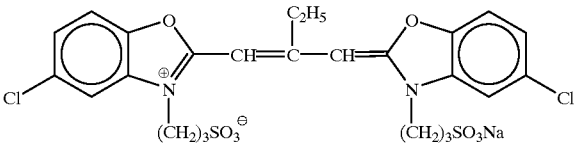
S-5
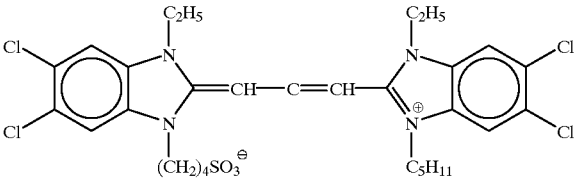
S-6
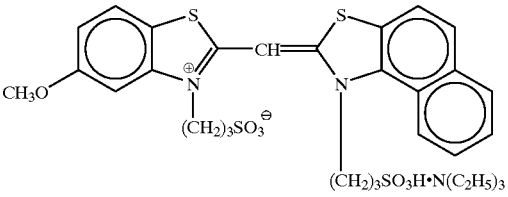
S-7
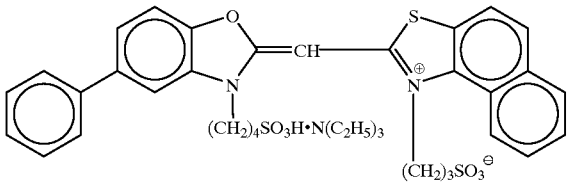
S-8
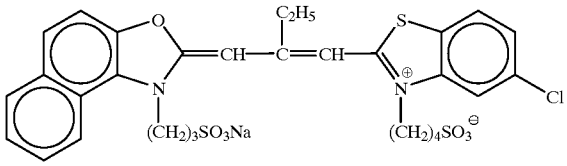
S-9
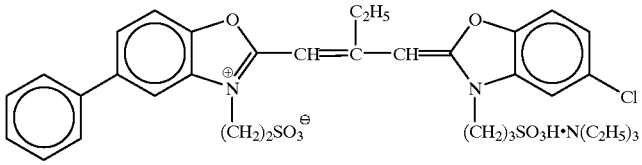

-continued
D-1
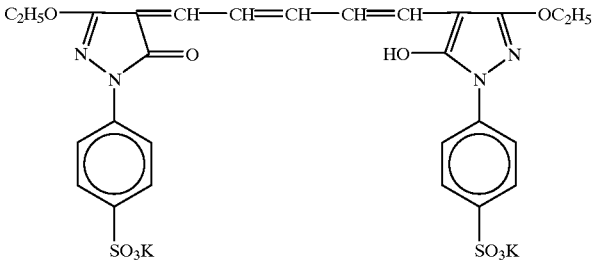
D-2
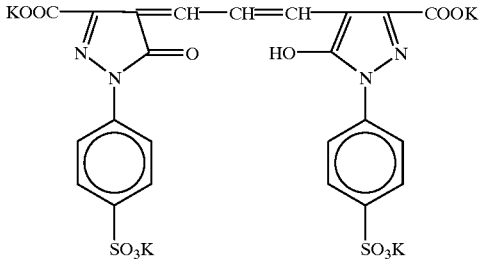
D-3
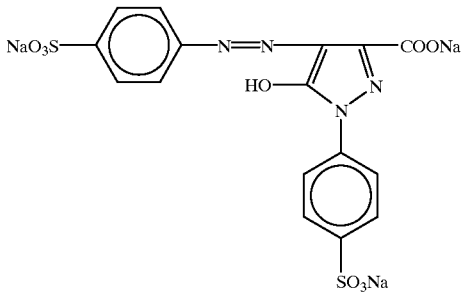
D-4
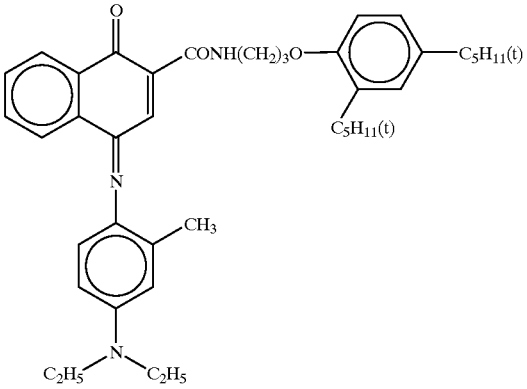
D-5
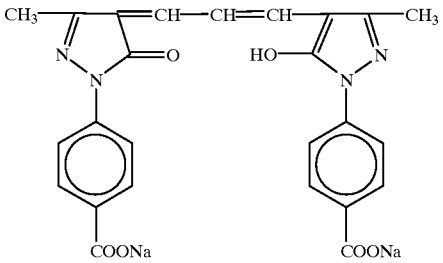
D-6
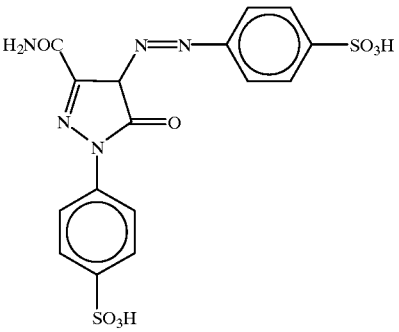
E-1
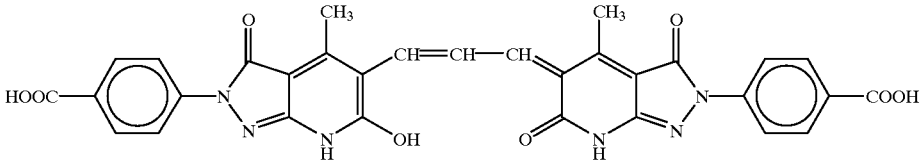

-continued
E-2
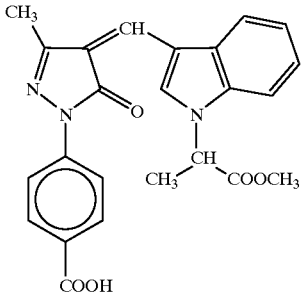
E-3
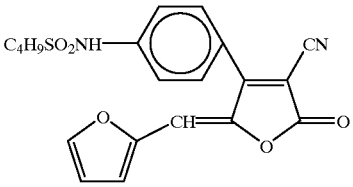
H-1
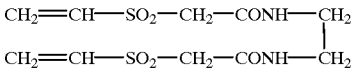
W-1
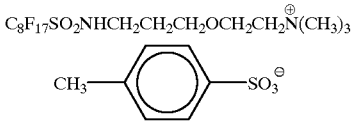
W-2
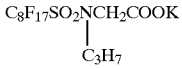
W-3
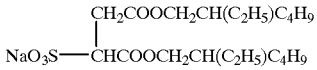
W-4
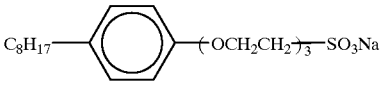
W-5
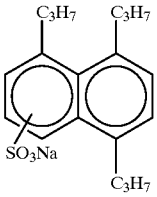
W-6
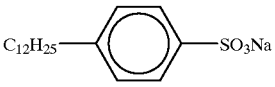
P-1
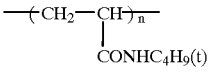
M-1
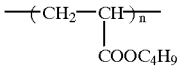
F-1
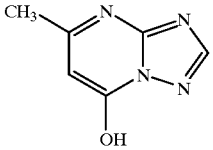
F-2
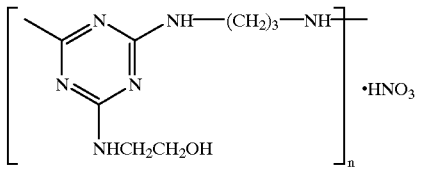
($n$ = 3~4)
F-3
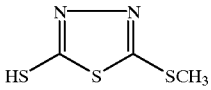

-continued

F-4

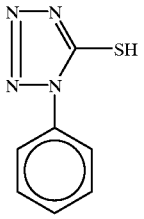

F-5

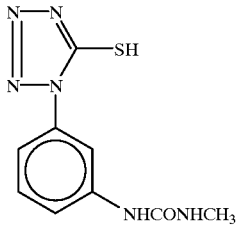

F-6

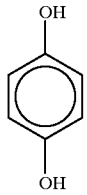

F-7

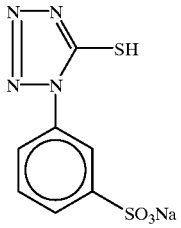

F-8

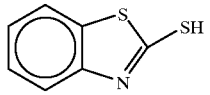

Evaluation of the Coated Samples

Each of the thus-prepared Samples 512 to 521 was exposed to light through a wedge, using a white light source of 2,000 lux and a color temperature of 4800, for 1/50 sec, and the sample was subjected to development processing as shown below. The sensitivity was evaluated from the relative value of the reciprocal of the exposure amount giving a magenta density of 1.0. Further, the RMS granularity, wherein the magenta density was 1.0, was measured.

The results obtained in the above evaluation are shown in Table 13. It can be seen that, the thinner the grains are, the higher the photographic sensitivity is, and the earlier the stage wherein the additive is added in the preparation of the emulsion is, the better the graininess is, which effect is greater particularly when the grains are thinner tabular grains.

TABLE 13

| Sample No. | Emulsion | Photographic sensitivity | RMS granularity |
|---|---|---|---|
| 512 | B3 | 100 | 100 |
| 513 | C3 | 80 | 101 |
| 514 | N3 | 107 | 78 |
| 515 | O3 | 105 | 81 |
| 516 | P3 | 103 | 83 |
| 517 | Q3 | 103 | 86 |
| 518 | R3 | 81 | 93 |
| 519 | S3 | 79 | 93 |
| 520 | T3 | 80 | 95 |
| 521 | U3 | 80 | 96 |

The processing steps and processing solution compositions are shown below.

| Process | Time | Temperature | Tank volume | Replenisher amount |
|---|---|---|---|---|
| 1st development | 6 min | 38° C. | 12 liter | 2,200 ml/m2 |
| 1st water-washing | 2 min | 38° C. | 4 liter | 7,500 ml/m$^2$ |
| Reversal | 2 min | 38° C. | 4 liter | 1,100 ml/m$^2$ |
| Color development | 6 min | 38° C. | 12 liter | 2,200 ml/m$^2$ |
| Pre-bleaching | 2 min | 38° C. | 4 liter | 1,100 ml/m$^2$ |
| Bleaching | 6 min | 38° C. | 12 liter | 220 ml/m$^2$ |
| Fixing | 4 min | 38° C. | 8 liter | 1,100 ml/m$^2$ |
| 2nd water-washing | 4 min | 38° C. | 8 liter | 7,500 ml/m$^2$ |
| Final-rinsing | 1 min | 25° C. | 2 liter | 1,100 ml/m$^2$ |

Compositions of each processing solution used were as follows:

| First developer | Tank solution | Replenisher |
|---|---|---|
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| N-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide) | | |

-continued

| Reversal solution | |
|---|---|
| (Both tank solution and replenisher) | 3.0 g |
| Pentasodium nitrilo-N,N,N-trimethylenephosphonate | |
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 6.00 |
| (pH was adjusted by using acetic acid or sodium hydroxide) | |

| Color developer | Tank solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate mono hydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using sulfuric acid or potassium hydroxide) | | |

| Pre-bleaching solution | Tank Solution | Replenisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde · sodium bisulfite adduct | 30 g | 35 g |
| Water to make | 1,000 ml | 1,000 ml |
| pH | 6.30 | 6.10 |
| (pH was adjusted by using acetic acid or sodium hydroxide) | | |

| | Tank solution | Replenisher |
|---|---|---|
| Bleaching solution | | |
| Disodium ethylenediaminetetraacetate dihydrate | 2.0 g | 4.0 g |
| Iron (III) ammonium ethylenediamine tetraacetate dihydrate | 120 g | 240 g |
| Potassium bromide | 100 g | 200 g |
| Ammonium nitrate | 10 g | 20 g |
| Water to make | 1,000 ml | 1.000 ml |
| pH | 6.70 | 5.50 |
| (pH was adjusted by using nitric acid or sodium hydroxide) | | |
| Fixing solution | | |
| (Both tank solution and replenisher) | | |
| Ammonium thiosulfate | | 80 g |
| Sodium sulfite | | 5.0 g |
| Sodium bisulfite | | 5.0 g |
| Water to make | | 1,000 ml |
| pH | | 6.60 |
| (pH was adjusted by using acetic acid or aqueous ammonia) | | |

| Stabilizing solution | Tank solution | Replenisher |
|---|---|---|
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

Having described our invention as related to the present embodiments, it is our intention that the invention not be limited by any of the details of the description, unless otherwise specified, but rather be construed broadly within its spirit and scope as set out in the accompanying claims.

What we claim is:

1. A light-sensitive silver halide photographic emulsion, comprising light-sensitive silver halide grains mainly composed of (100) planes and (111) planes, at least one compound that is adsorbed selectively on the (100) planes of the silver halide grains, and at least one spectrally sensitizing dye that is adsorbed selectively to (111) planes of the silver halide grains, wherein tabular grains having an aspect ratio in the range of 2 to 100 amount to at least 50% of all the silver halide grains in number, dislocation lines are observed in the tabular grains, and the tabular grains are composed of principal planes and side planes, wherein the side planes comprise (100) planes.

2. The light-sensitive silver halide photographic emulsion as claimed in claim 1, wherein the (100) plane-selective compound that is more selectively adsorbed on the (100) planes than on the (111) planes is a compound represented by formula (I):

formula (I)

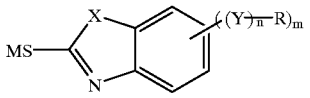

wherein R's each represent an alkyl group, an alkenyl group, an alkynyl group, an aryl group, or an aralkyl group; Y represents —O—, —S—, —$NR_1$—, —$NR_2CO$—, —$CONR_3$—, —$NR_4SO_2$—, —$SO_2NR_5$—, —COO—, —OCO—, —CO—, —$SO_2$—, —$NR_6CONR_7$—, —$NR_8CSNR_9$—, or —$NR_{10}COO$—, in which $R_1$, $R_2$, $R_3$, $R_4$, $R_5$, $R_6$, $R_7$, $R_8$, $R_9$, and $R_{10}$ each represent a hydrogen atom, an alkyl group, an alkenyl group, an alkynyl group, an aryl group, or an aralkyl group; n is 0 or 1, m is from 1 to 4; X represents —O—, —S—, or —NR'—, in which R' represents a hydrogen atom, an alkyl group, or an alkenyl group; and M represents a hydrogen atom, an alkali metal atom, an alkali earth metal atom, an ammonium group, or a group capable of cleaving under alkaline condition, provided that the total number of carbon atoms of —$((Y)_n$—$R)_m$ is from 1 to 30.

3. The light-sensitive silver halide photographic emulsion as claimed in claim 1, comprising tabular silver halide grains having an aspect ratio in the range of 2 to 100, that comprise (111) planes and side planes having (100) planes, and that have been subjected to reduction sensitization, and comprising at least one compound having (100) plane selectivity.

4. The light-sensitive silver halide photographic emulsion as claimed in claim 3, wherein at least 50% of the said tabular silver halide grains in number have dislocation lines.

5. The light-sensitive silver halide photographic emulsion as claimed in claim 3, wherein the said (100) plane-selective compound is a compound represented by formula (I):

formula (I)

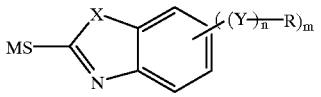

wherein R's each represent an alkyl group, an alkenyl group, an alkynyl group, an aryl group, or an aralkyl group; Y represents —O—, —S—, —$NR_1$—, —$NR_2CO$—, —$CONR_3$—, —$NR_4SO_2$—, —$SO_2NR_5$—, —COO—, —OCO—, —CO—, —$SO_2$—, —$NR_6CONR_7$—, —$NR_8CSNR_9$—, or —$NR_{10}COO$—, in which $R_1$, $R_2$, $R_3$, $R_4$, $R_5$, $R_6$, $R_7$, $R_8$, $R_9$, and $R_{10}$ each represent a hydrogen atom, an alkyl group, an alkenyl group, an alkynyl group, an aryl group, or an aralkyl group; n is 0 or 1, m is from 1 to 4; X represents —O—, —S—, or —NR'—, in which R' represents a hydrogen atom, an alkyl group, or an alkenyl group; and M represents a hydrogen atom, an alkali metal atom, an alkali earth metal atom, an ammonium group, or a group capable of cleaving under alkaline condition, provided that the total number of carbon atoms of —$((Y)_n$—$R)_m$ is from 1 to 30.

6. The light-sensitive silver halide emulsion as claimed in claim 1, which is prepared by allowing, in a step of forming silver halide grains having a thickness in the range of 0.01 μm to 0.30 μm, a compound that will be adsorbed more selectively on the (100) planes of the said silver halide grains than on the (111) planes of the said silver halide grains, to be present during the formation of the said grains.

7. The light-sensitive silver halide emulsion as claimed in claim 6, wherein the said silver halide grains are tabular grains composed of principal planes and side planes, and the said side planes comprise (100) planes.

8. The light-sensitive silver halide emulsion as claimed in claim 7, wherein the said compound that is adsorbed is a spectrally sensitizing dye.

9. The light-sensitive silver halide emulsion as claimed in claim 7, wherein the said compound that is adsorbed is a compound represented by the following formula (I):

formula (I)

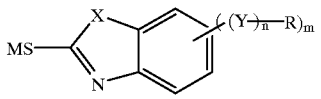

wherein R's each represent an alkyl group, an alkenyl group, an alkynyl group, an aryl group, or an aralkyl group; Y represents —O—, —S—, —$NR_1$—, —$NR_2CO$—, —$CONR_3$—, —$NR_4SO_2$—, —$SO_2NR_5$—, —COO—, —OCO—, —CO—, —$SO_2$—, —$NR_6CONR_7$—, —$NR_8CSNR_9$—, or —$NR_{10}COO$—, in which $R_1$, $R_2$, $R_3$, $R_4$, $R_5$, $R_6$, $R_7$, $R_8$, $R_9$, and $R_{10}$ each represent a hydrogen atom, an alkyl group, an alkenyl group, an alkynyl group, an aryl group, or an aralkyl group; n is 0 or 1, m is from 1 to 4; X represents —O—, —S—, or —NR'—, in which R' represents a hydrogen atom, an alkyl group, o r an alkenyl group; and M represents a hydrogen atom, an alkali metal atom, an alkali earth metal atom, an ammonium group, or a group capable of cleaving under alkaline condition, provided that the total number of carbon atoms of —$((Y)_n$—$R)_m$ is from 1 to 30.

10. The light sensitive silver halide emulsion of claim 1, wherein said at least one compound is selected from the group consisting of

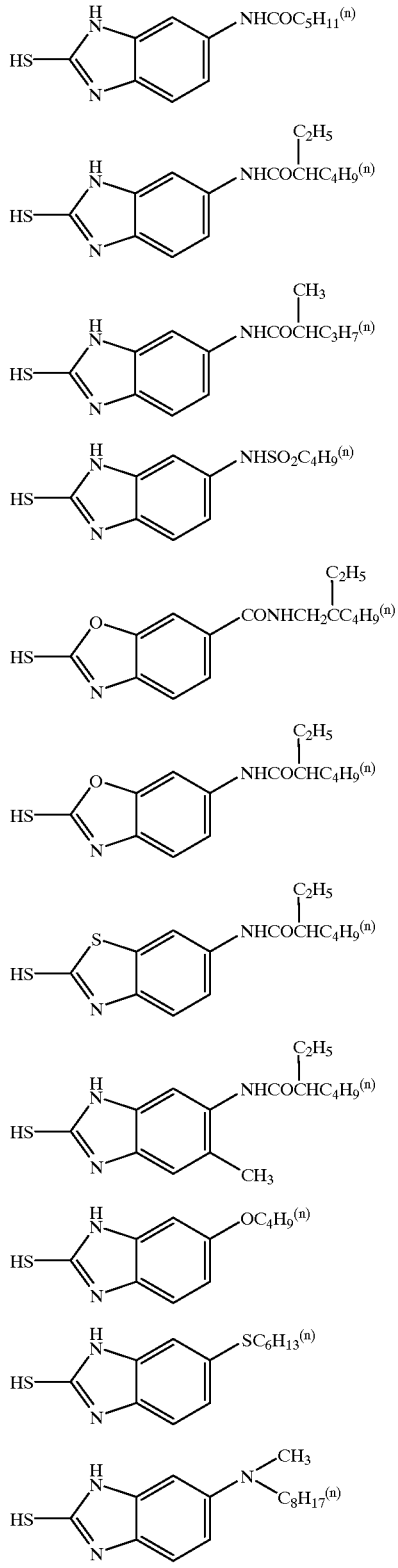

-continued
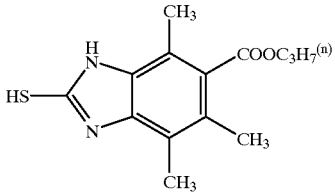
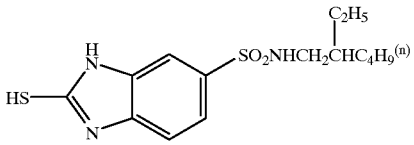
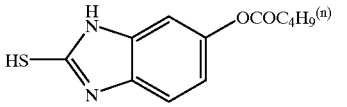
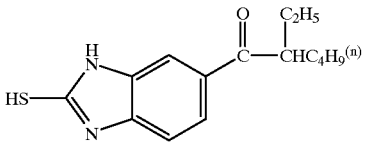
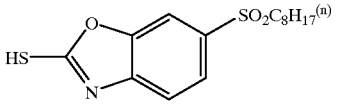
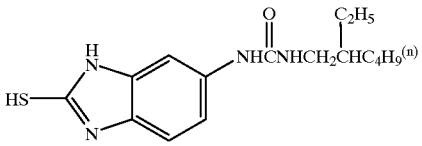
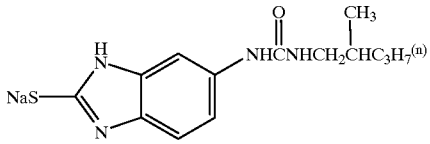
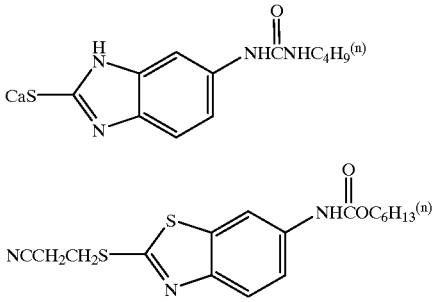
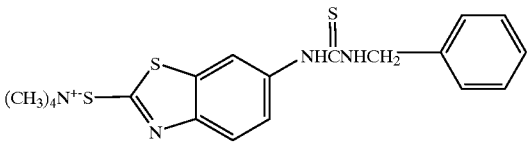
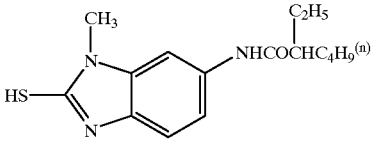
-continued
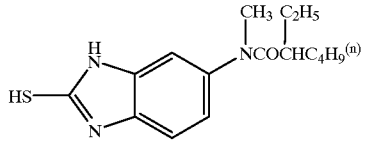
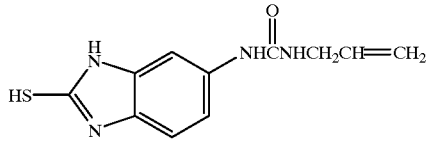
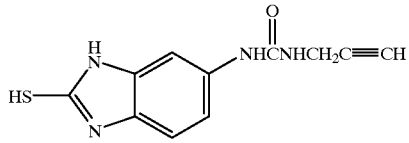
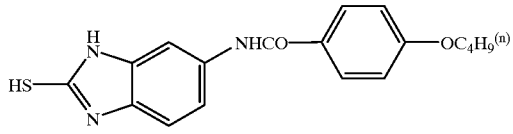
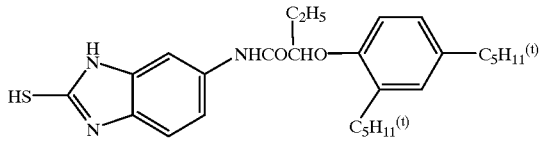
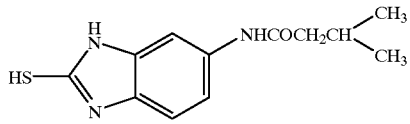
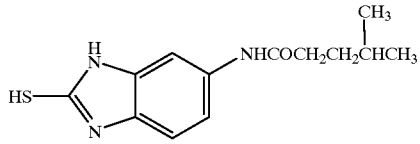
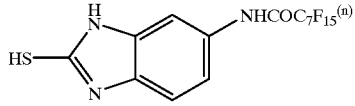
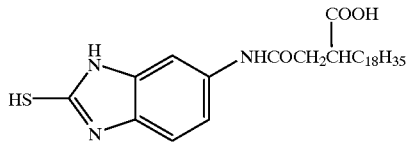
and
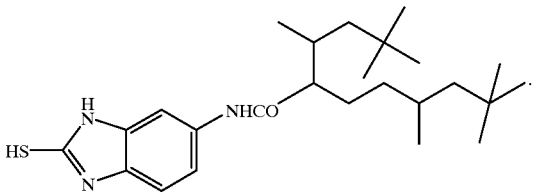
11. A silver halide photographic light-sensitive material, having at least one light-sensitive silver halide emulsion layer on a support, wherein at least one of emulsion layers contains a light-sensitive silver halide photographic emulsion, the light-sensitive silver halide photographic emulsion comprising light-sensitive silver halide grains mainly composed of (100) planes and (111) planes, at least one compound that is adsorbed selectively on the (100) planes of the silver halide grains, and at least one spectrally sensitizing dye that is adsorbed selectively to (111) planes of the silver halide grains, wherein tabular grains having an aspect ratio in the range of 2 to 100 amount to at least 50% of all the silver halide grains in number and dislocation lines are observed in the tabular grains.

12. A light-sensitive silver halide photographic light-sensitive material having at least one light-sensitive silver halide emulsion layer on a support, wherein at least one of silver halide emulsion layers contains a light-sensitive silver halide photographic emulsion, which emulsion comprises silver halide grains mainly composed of (100) planes and (111) planes, at least one compound that is adsorbed selectively on the (100) planes of the silver halide grains, and at least one spectrally sensitizing dye that is adsorbed selectively to (111) planes of the silver halide grains, wherein tabular grains having an aspect ratio of 2 to 100, amount to at least 50% of all the silver halide grains in number, dislocation lines are observed in the tabular grains, and the tabular grains comprise (111) planes and side planes having (100) planes, and have been subject to reduction sensitization.

13. A silver halide photographic light sensitive material, comprising at least one silver halide emulsion in a light sensitive layer, wherein said at least one silver halide emulsion has light-sensitive silver halide grains mainly composed of (100) planes and (111) planes, at least one compound that is adsorbed selectively on the (100) planes of the silver halide grains, and at least one spectrally sensitizing dye that is adsorbed selectively to (111) planes of the silver halide grains, wherein tabular grains having an aspect ratio in the range of 2 to 100 amount to at least 50% of all the silver halide grains in number, dislocation lines are observed in the tabular grains, and the tabular grains are composed of principal planes and side planes, wherein the side planes comprise (100) planes; and wherein said at least one silver halide layer is prepared by allowing, in a step of forming silver halide grains having a thickness in the range of 0.01 $\mu$m to 0.30 $\mu$m, a compound that will be adsorbed more selectively on the (100) planes of said silver halide grains than on the (111) planes of said silver halide grains, to be present during the formation of the said grains.

* * * * *